US006681529B1

(12) United States Patent
Baloga et al.

(10) Patent No.: US 6,681,529 B1
(45) **Date of Patent: *Jan. 27, 2004**

(54) WORK ENVIRONMENT

(75) Inventors: Mark A. Baloga, East Grand Rapids, MI (US); Carl V. Forslund, III, East Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 394 days.

This patent is subject to a terminal disclaimer.

(21) Appl. No.: 09/650,210

(22) Filed: Aug. 29, 2000

Related U.S. Application Data

(62) Division of application No. 09/183,021, filed on Oct. 30, 1998, now Pat. No. 6,463,701.

(51) Int. Cl.[7] ..... A47F 10/00; G09F 15/00; E04B 2/00; E04H 1/00

(52) U.S. Cl. ..... 52/29; 52/32; 52/36.1; 52/220.7; 52/243.1; 52/239; 211/169; 160/214; 40/491; 40/492

(58) Field of Search ..... 52/29, 36.1, 32, 52/220.7, 243.1, 239; 40/491, 492; 160/214; 211/169

(56) References Cited

U.S. PATENT DOCUMENTS

| | | | |
|---|---|---|---|
| 119,054 A | 9/1871 | Shryock | |
| 241,600 A | 5/1881 | Bray | 119/412 |
| 241,925 A | 5/1881 | Cadwell | |

(List continued on next page.)

FOREIGN PATENT DOCUMENTS

| | | |
|---|---|---|
| AT | 164466 | 4/1949 |
| DE | 232680 | 8/1963 |

(List continued on next page.)

OTHER PUBLICATIONS

M.A. Baloga, C.V. Forslund III, et al., Compilation titled "Bluespace" dated Aug. 29, 2000 (internal document proprietary to Steelcase Inc.).

(List continued on next page.)

*Primary Examiner*—Robert Canfield
(74) *Attorney, Agent, or Firm*—Foley & Lardner

(57) ABSTRACT

An information display system is disclosed. A work environment providing a work area and a workstation including the information display system are also disclosed. The information display system includes a track system adapted to attach to a mounting structure and a plurality of display panels coupled to the track system for movement with respect to the mounting structure. The display panels are adapted to present information selectively for display by pivotal and translating movement of the plurality of display panels. The track system may include at least one rail. The display panels may be cantilevered away from the track system at a vertical elevation to provide clearance below the display panels for a seated worker. The information display system may include a plurality of containers coupled to the track system for movement with respect to the mounting structure, with each of the plurality of containers is adapted to include at least one display panel. Each of the display panels is adapted to present information and the information can selectively be presented for display by movement of the plurality of containers. Each of the display panels may include at least one display board. A docking area may be positioned along the track system and configured to at least partially conceal at least one of the display panels. A utility threshold may be adapted for movement along a predefined path about the work area to selectively deliver utilities to at least one portion of the work area. The work environment may provide a work space that can be arranged or divided to include at least one work area within the available floor space. In the work area, the display panels may be moved from a first arrangement to at least a second arrangement. The first arrangement allows one worker to use substantially all available floor space; the second arrangement allows a plurality of workers to share the available floor space so as to facilitate the utilization of the floor space by workers present in the work environment.

83 Claims, 45 Drawing Sheets

U.S. PATENT DOCUMENTS

| | | | | | |
|---|---|---|---|---|---|
| 249,198 | A | | 11/1881 | Moon | |
| 253,538 | A | | 2/1882 | McLane | |
| 454,844 | A | | 6/1891 | Brewerton et al. | |
| 475,126 | A | | 5/1892 | Lorenz | |
| 549,347 | A | | 11/1895 | Clark | |
| 605,148 | A | | 6/1898 | Sylvester | |
| 621,835 | A | | 3/1899 | Macdonald | |
| 627,396 | A | | 6/1899 | Daly | |
| 713,417 | A | | 11/1902 | Feldmann et al. | |
| 821,144 | A | | 5/1906 | Walsh | |
| 943,821 | A | | 12/1909 | Feldmann, Jr. | |
| 950,006 | A | | 2/1910 | McCarty | |
| 955,586 | A | | 4/1910 | Emerich | |
| 997,866 | A | | 7/1911 | Smith | |
| 1,086,236 | A | | 2/1914 | Staples | |
| 1,116,484 | A | | 11/1914 | Ralph | |
| 1,122,926 | A | | 12/1914 | Hick | |
| 1,141,404 | A | | 6/1915 | Moseley | |
| 1,203,659 | A | | 11/1916 | Smith | |
| 1,254,036 | A | | 1/1918 | Grant | |
| 1,326,832 | A | | 12/1919 | Baily | |
| 1,457,990 | A | | 6/1923 | Morgan | |
| 1,599,888 | A | | 9/1926 | Haskell | |
| 1,616,897 | A | | 2/1927 | Hayes | 40/398 |
| 1,688,456 | A | | 10/1928 | Dolph | |
| 1,770,755 | A | | 7/1930 | Kleinpell | |
| 1,826,469 | A | | 10/1931 | Hunt et al. | |
| 1,881,636 | A | | 10/1932 | Johnson et al. | |
| 1,887,539 | A | | 11/1932 | Brown | |
| 1,943,629 | A | | 1/1934 | Schwartz | |
| 1,958,579 | A | | 5/1934 | Johnson et al. | 35/15 |
| 1,997,829 | A | | 4/1935 | McKee | 211/55 |
| 2,070,408 | A | | 2/1937 | Leidgen | 211/96 |
| 2,144,083 | A | | 1/1939 | Rentfrow, Sr. | 155/124 |
| 2,348,414 | A | | 5/1944 | Pierce | 211/41 |
| 2,691,238 | A | | 10/1954 | Svatos | 45/80 |
| 2,812,067 | A | | 11/1957 | Gussack | 211/46 |
| 2,870,459 | A | | 1/1959 | Zabielski | 5/2 |
| 2,886,182 | A | | 5/1959 | Dauman | 211/49 |
| 2,914,873 | A | | 12/1959 | Brennan | 40/125 |
| 2,928,555 | A | | 3/1960 | Childs et al. | 211/169 |
| 2,963,332 | A | | 12/1960 | Breuning | 312/231 |
| 3,017,999 | A | | 1/1962 | Cano | 211/40 |
| 3,042,978 | A | | 7/1962 | Eames et al. | 20/1.11 |
| 3,060,521 | A | | 10/1962 | Greco | 52/65 |
| 3,078,133 | A | | 2/1963 | Schauer | 312/223 |
| 3,141,207 | A | | 7/1964 | Kahler | 20/19 |
| 3,181,274 | A | | 5/1965 | Izenour | 50/24 |
| 3,251,477 | A | | 5/1966 | Parstorfer | 211/169 |
| 3,286,382 | A | | 11/1966 | Newman | 40/102 |
| 3,351,211 | A | | 11/1967 | Best | 211/169 |
| 3,391,796 | A | | 7/1968 | Cross | 211/169 |
| 3,412,868 | A | | 11/1968 | Carter | 211/163 |
| 3,425,568 | A | | 2/1969 | Albright | 211/87 |
| 3,514,883 | A | | 6/1970 | Albright | 40/67 |
| 3,537,769 | A | * | 11/1970 | Carlo | |
| 3,557,499 | A | | 1/1971 | Dickie et al. | 52/36 |
| 3,581,423 | A | | 6/1971 | Mascolo | 40/158 B |
| 3,683,100 | A | | 8/1972 | Deal et al. | 174/48 |
| 3,732,633 | A | | 5/1973 | Margolis et al. | 35/55 |
| 3,760,952 | A | | 9/1973 | White | 211/168 |
| 3,777,896 | A | | 12/1973 | Ehrlich | 211/49 D |
| 3,797,146 | A | | 3/1974 | Holes | 40/104.18 |
| 3,857,731 | A | | 12/1974 | Merrill, Jr. et al. | 117/122 PA |
| 3,883,972 | A | | 5/1975 | Propst et al. | 40/128 |
| 3,921,320 | A | | 11/1975 | McWiliams | 40/32 |
| 3,924,749 | A | | 12/1975 | Weston | 211/4 |
| 3,952,133 | A | | 4/1976 | Amos et al. | 428/354 |
| 3,975,837 | A | | 8/1976 | Baars | 35/63 |
| 3,984,930 | A | | 10/1976 | Booland | 40/65 |
| 4,033,058 | A | | 7/1977 | Lyman | 40/97 |
| 4,135,775 | A | | 1/1979 | Driscoll | 339/22 R |
| 4,166,332 | A | | 9/1979 | Donovan | 40/605 |
| 4,180,298 | A | | 12/1979 | Borgerson, Jr. | 312/242 |
| 4,194,313 | A | | 3/1980 | Downing | 40/610 |
| 4,239,170 | A | | 12/1980 | Planebo | 248/441 B |
| 4,270,290 | A | | 6/1981 | Eckert | 40/389 |
| 4,310,978 | A | | 1/1982 | Stern | 40/600 |
| 4,360,240 | A | | 11/1982 | Koncelik et al. | 312/238 |
| 4,360,991 | A | | 11/1982 | West | 52/29 |
| 4,428,136 | A | | 1/1984 | Franklin | 40/605 |
| 4,447,973 | A | | 5/1984 | Wihlke | 40/159 |
| 4,457,436 | A | | 7/1984 | Kelley | 211/88 |
| 4,478,467 | A | | 10/1984 | Tyndall | 312/250 |
| 4,569,448 | A | | 2/1986 | Graham | 211/74 |
| 4,588,190 | A | | 5/1986 | Stewart et al. | 473/435 |
| 4,606,394 | A | | 8/1986 | Bannister | 160/351 |
| 4,620,635 | A | | 11/1986 | Morand | 211/47 |
| 4,648,514 | A | * | 3/1987 | Niles | |
| 4,652,239 | A | | 3/1987 | Brimberg | 434/80 |
| 4,658,966 | A | | 4/1987 | Broek | 211/46 |
| 4,715,154 | A | | 12/1987 | Baloga | 52/239 |
| 4,723,665 | A | | 2/1988 | Benedict et al. | 211/168 |
| 4,723,821 | A | | 2/1988 | Montgomery | 312/231 |
| 4,750,305 | A | | 6/1988 | Bastian | 52/127.11 |
| 4,757,901 | A | | 7/1988 | Woods | 206/575 |
| 4,771,557 | A | | 9/1988 | Bowman | 40/158.1 |
| 4,793,495 | A | | 12/1988 | Preu | 211/41 |
| 4,805,331 | A | | 2/1989 | Boggess et al. | 40/651 |
| 4,831,791 | A | * | 5/1989 | Ball | |
| 4,902,229 | A | | 2/1990 | Pedersen et al. | 434/80 |
| 4,913,297 | A | | 4/1990 | Wells | 211/96 |
| 4,928,465 | A | | 5/1990 | Del Castillo Von Haucke | 52/239 |
| 4,932,172 | A | | 6/1990 | Maas | 52/71 |
| 4,954,382 | A | | 9/1990 | Riefler et al. | 428/116 |
| 4,979,785 | A | | 12/1990 | Richards | 312/201 |
| 4,996,110 | A | | 2/1991 | Tanuma et al. | 428/343 |
| 5,016,373 | A | | 5/1991 | Theno | 40/594 |
| 5,090,171 | A | | 2/1992 | Kano et al. | 52/243.1 |
| 5,094,053 | A | * | 3/1992 | Militzer | 52/238.1 |
| 5,105,952 | A | | 4/1992 | Krattiger | 211/41 |
| 5,109,994 | A | | 5/1992 | Kidd et al. | 211/162 |
| 5,112,020 | A | | 5/1992 | Ginsberg | 248/456 |
| 5,125,202 | A | | 6/1992 | Kissinger | 52/239 |
| 5,139,155 | A | | 8/1992 | Laxson | 211/169 |
| 5,148,925 | A | | 9/1992 | Althoff et al. | 211/41 |
| 5,160,050 | A | | 11/1992 | Russo | 211/40 |
| 5,160,189 | A | | 11/1992 | Johnston et al. | 312/201 |
| 5,161,321 | A | | 11/1992 | Kuhnke | 40/493 |
| 5,181,334 | A | | 1/1993 | Mima | 40/524 |
| 5,186,499 | A | | 2/1993 | Mason | 283/81 |
| 5,214,885 | A | | 6/1993 | Maas et al. | 52/71 |
| 5,226,548 | A | | 7/1993 | Koeppel | 211/144 |
| 5,241,796 | A | | 9/1993 | Hellwig et al. | 52/36.4 |
| 5,248,536 | A | | 9/1993 | Du Katz | 428/40 |
| 5,282,341 | A | | 2/1994 | Baloga et al. | 52/32 |
| 5,289,926 | A | | 3/1994 | Lewis et al. | 211/45 |
| 5,290,002 | A | | 3/1994 | Cohen | 248/456 |
| 5,309,686 | A | | 5/1994 | Underwood et al. | 52/29 |
| 5,321,579 | A | | 6/1994 | Brown et al. | 361/681 |
| 5,342,665 | A | | 8/1994 | Krawitz | 428/40 |
| 5,368,486 | A | | 11/1994 | Kurzman | 434/79 |
| 5,375,802 | A | | 12/1994 | Branham, II | 248/231.4 |
| 5,384,999 | A | | 1/1995 | Roche et al. | 52/764 |
| 5,392,934 | A | | 2/1995 | Fox | 211/94 |
| 5,394,631 | A | | 3/1995 | Bosio | 40/491 |
| 5,406,761 | A | | 4/1995 | Hobbiebrunken et al. | 52/243.1 |
| 5,422,155 | A | | 6/1995 | Spence, Jr. | 428/76 |
| 5,428,928 | A | | 7/1995 | Hellwig et al. | 52/239 |
| 5,486,391 | A | | 1/1996 | Tyner | |

| | | | | | |
|---|---|---|---|---|---|
| 5,495,953 | A | | 3/1996 | Bearth | 211/40 |
| 5,503,278 | A | | 4/1996 | Ishmael | 211/169 |
| 5,511,348 | A | | 4/1996 | Cornell et al. | 52/239 |
| 5,513,574 | A | | 5/1996 | Collins | 108/36 |
| 5,536,080 | A | | 7/1996 | Madimenos et al. | 312/317.1 |
| 5,537,290 | A | | 7/1996 | Brown et al. | 361/681 |
| 5,549,267 | A | | 8/1996 | Armbruster et al. | 248/442.2 |
| 5,558,418 | A | | 9/1996 | Lambright et al. | 312/321.5 |
| 5,569,503 | A | | 10/1996 | Piotroski | 428/41.8 |
| 5,584,546 | A | | 12/1996 | Gurin et al. | 312/200 |
| 5,588,659 | A | | 12/1996 | Boes et al. | 280/47.19 |
| 5,590,940 | A | | 1/1997 | Richard | 312/287 |
| 5,607,214 | A | | 3/1997 | Pierce et al. | 312/310 |
| 5,609,112 | A | | 3/1997 | Meyer et al. | 108/153 |
| 5,617,660 | A | | 4/1997 | Pollack | 40/611 |
| 5,635,265 | A | | 6/1997 | Potokar | 428/43 |
| 5,647,172 | A | | 7/1997 | Rokicki | 49/504 |
| 5,649,631 | A | | 7/1997 | Loflin | 211/44 |
| 5,655,323 | A | | 8/1997 | Lassoff | 40/611 |
| 5,655,672 | A | | 8/1997 | Stuchlik, III | 211/70.7 |
| 5,658,635 | A | | 8/1997 | Davis et al. | |
| 5,675,946 | A | | 10/1997 | Verbeck et al. | 52/205 |
| 5,687,499 | A | | 11/1997 | Brnjac | 40/524 |
| 5,687,513 | A | | 11/1997 | Baloga et al. | 52/32 |
| 5,688,579 | A | | 11/1997 | Konsti et al. | 428/192 |
| 5,695,264 | A | | 12/1997 | Koch | 312/310 |
| 5,697,589 | A | | 12/1997 | Garfinkle | 248/223.41 |
| 5,711,121 | A | | 1/1998 | Garver | 52/239 |
| 5,724,778 | A | | 3/1998 | Cornell et al. | 52/239 |
| 5,743,193 | A | | 4/1998 | Kakuta et al. | 108/147 |
| 5,746,330 | A | | 5/1998 | DiBetta | 211/70.6 |
| 5,765,315 | A | | 6/1998 | Nagamitsu et al. | 52/36.1 |
| 5,771,954 | A | | 6/1998 | Benner et al. | 160/231.2 |
| 5,794,392 | A | | 8/1998 | Forslund, III et al. | 52/220.7 |
| 5,826,385 | A | | 10/1998 | Dykstra et al. | 52/220.7 |
| 5,826,639 | A | | 10/1998 | Miller | 160/135 |
| 5,829,202 | A | | 11/1998 | Canton Gongora et al. | 52/36.1 |
| 5,831,211 | A | | 11/1998 | Gartung et al. | 174/48 |
| 5,848,698 | A | | 12/1998 | Stompe | 206/449 |
| 5,873,205 | A | | 2/1999 | Hanlon et al. | 52/239 |
| 5,901,513 | A | | 5/1999 | Mollenkopf et al. | 52/220.7 |
| 5,913,787 | A | | 6/1999 | Edwards | 52/220.7 |
| 5,931,429 | A | | 8/1999 | Hellwig et al. | 248/235 |
| 5,966,879 | A | | 10/1999 | Verbeek et al. | 52/205 |
| 5,984,441 | A | | 11/1999 | Stokhuijzen | 312/240 |
| 6,048,044 | A | | 4/2000 | Biggel et al. | 312/258 |
| 6,076,317 | A | | 6/2000 | Hellwig et al. | 52/239 |
| 6,148,567 | A | * | 11/2000 | DeRuiter et al. | 52/36.1 |
| 6,249,999 | B1 | | 6/2001 | Borge et al. | 40/470 |
| 6,263,602 | B1 | * | 7/2001 | Seiber et al. | 40/606 |
| 6,272,779 | B1 | * | 8/2001 | Seiber et al. | 40/606 |
| 6,279,761 | B1 | * | 8/2001 | Niewiadomski et al. | 211/94.01 |
| 6,374,547 | B1 | * | 4/2002 | Baloga et al. | 52/36.1 |
| 6,449,909 | B1 | * | 9/2002 | Baloga et al. | 52/36.1 |
| 6,463,701 | B1 | * | 10/2002 | Baloga et al. | 52/29 |
| 6,540,094 | B1 | * | 4/2003 | Baloga et al. | 211/94.01 |

FOREIGN PATENT DOCUMENTS

| | | | | |
|---|---|---|---|---|
| DE | 1561580 | | 4/1970 | |
| EP | 0 997 866 | A2 * | 5/2000 | G09F/15/00 |
| GB | 124334 | | 4/1949 | |
| JP | 3-93944 | | 4/1991 | |
| JP | 3-93946 | | 4/1991 | |
| JP | 40-4222787 | | 8/1992 | 52/239 |
| WO | WO 95/24031 | | 9/1995 | |

OTHER PUBLICATIONS

U.S. patent application Ser. No. 09/182,998, titled "Information Display System" as filed on Oct. 30, 1998, including specification, claims, drawings and abstract (104 sheets).

U.S. patent application Ser. No. 09/183,023, titled "Workstation" as filed on Oct. 30, 1998, including specification, claims, drawings and abstract (106 sheets).

U.S. patent application Ser. No. 09/183,021, titled "Work Environment" as filed on Oct. 30, 1998, including specification, claims, drawings and abstract (101 sheets).

U.S. patent application Ser. No. 09/260,474, titled "Information Display System" as filed on Mar. 1, 1999, including specification, claims, drawings and abstract (35 sheets).

U.S. patent application Ser. No. 09/571,521, titled "Information Display System" as filed on May 16, 2000, including specification, claims, drawings and abstract (103 sheets). Preliminary Amendment filed May 16, 2000 (19 sheets).

U.S. patent applicaton Ser. No. 09/645,023, titled "Workstation" as filed on Aug. 23, 2000, including specification, claims, drawings and abstract (106 sheets). Preliminary Amendment filed Aug. 23, 2000 (40 sheets).

U.S. patent application Ser. No. 09/669,913, titled "Display Board System" as filed on Sep. 25, 2000, including specification, claims, drawings and abstract (66 sheets). Preliminary Amendment filed Sep. 25, 2000 (36 sheets).

U.S. patent application Ser. No. 09/563,098, titled "Display Board System" as filed May 2, 2000, including specification, claims, drawings and abstract (113 sheets).

U.S. patent application Ser. No. 09/182,999, titled "Display Board System" as filed on Oct. 30, 1998, inlcuding specification, claims, drawings and abstract (63 sheets).

U.S. patent application Ser. No. 09/182,997, titled "Display Board System" as filed on Oct. 30, 1998, including specification, claims, drawings and abstract (64 sheets).

Brochure by UNIFOR titled "Pannelli PL" (undated) (37 sheets).

Brochure by UNIFOR titled "Progetto 25.90" (undated) (19 sheets).

Promotional material (chart) by Dowing Displays of Milford, Ohio, showing display models (undated), color.

Promotional material for "The Office of the Future", by Tarrant Interiors—of Fort Worth, Texas, (undated), 4 sheets.

Innamorati, Francesco, "The Telematic Tree", Habitat Ufficio, bearing a designation "guigno 1991."

Advertisement for "Ameriwood Oak Armoire", by Office Max, bearing a designation "Instant Rebate ends Nov. 11, 1995", 1 sheet.

Gertsakis, John, "*Durable Yet Future Proof*", bearing a designation "©1996, National Key Centre for Design at RMIT", 4 sheets, printed from Internet site: www.cfd.rmit.edu.au/outcomes/erdnews/ERD6/HOTdesk.html, bearing a designation of "Oct. 27, 1998".

Promotional materials for "A world of possibilities. Introducing Contrada™. The next generation in office furniture.", by Trendway Corporation of Holland, Michigan, bearing a designation of "©1998".

Promotional material for "Village Wall," By Tellus Furniture a Paoli Company of Orleans, Indiania, bearing a designation of "©1998 Tellus Furniture", 8 color sheets.

Yates, JoAnne, "Graphic ROI Reporting," Knowledge Management, bearing a designation of "Oct. 1998," p. 106.

Brochure for "TooGo New Workplace Solutions", by Egan Visual, bearing a designation "©Copyright Egan Visual 1999", 16 color sheets.

* cited by examiner

WORK ENVIRONMENT

CROSS-REFERENCE TO RELATED APPLICATIONS

This application is a division of Ser. No. 09/183,021 filed Oct. 30, 1998 now U.S. Pat. No. 6,463,701.

The following U.S. patent applications are cited by reference and incorporated by reference herein: (a) Ser. No. 09/182,998 titled "INFORMATION DISPLAY SYSTEM" filed Oct. 30, 1998; (b) Ser. No. 09/183,023 titled "WORK STATION" filed Oct. 30, 1998; (c) Ser. No. 09/183,021 titled "WORK ENVIRONMENT" filed Oct. 30, 1998; (d) Ser. No. 09/182,997 titled "DISPLAY BOARD SYSTEM" filed Oct. 30, 1998; (e) Ser. No. 09/182,999 titled "DISPLAY BOARD SYSTEM" filed Oct. 30, 1998.

FIELD OF THE INVENTION

The present invention relates to an information display system adapted for use within a work environment providing one or more workstations.

BACKGROUND OF THE INVENTION

It is well known in a large work environment to define a group work space that may be divided or otherwise arranged to create one or more work areas for use by individual workers or small groups of workers. Work areas are commonly configured to form one or more workstations, by arrangement of one or more articles of furniture, such as panel walls, worksurfaces, storage units, chairs or seating products, etc., typically in a manner intended to support workers in a wide variety of individual and group activities. Typically, such known arrangements are not optimally suited for use in a dynamic work environment, where individual and team spaces are ideally capable of rapid configuration and reconfiguration by the workers themselves in a highly efficient manner, as needed for varied sets of individual or group activities. Recently, these dynamic work environments characterized by the need for flexibility, reconfigurable work areas, and the ability to support a wide variety of activities of both individual workers and project teams of varying sizes, have become prevalent and typically include more mobile forms of such articles of furniture.

All of these work spaces typically are required to accommodate a flow of information, often presented in the form of documents, that is created, used or shared by the workers. Indeed, in known work environments, it is well known to provide for the display of information to support the individual or collaborative activities of one or more workers. A fundamental purpose of any system for the display of information is to facilitate "information persistence"—to provide an organizational framework for the presentation of information that freely enables the collection of information, the presentation of information, and the retention of information as it becomes meaningful or useful to an individual or group. This purpose is best served by a system that allows current information to be prominently displayed and readily accessible. However, known arrangement for the display of information in any work environment, which typically utilize both vertical surfaces and horizontal surfaces provided within the work environment, do not fully achieve this or other purposes that are desirable. This is particularly true in a dynamic work environment.

In some typical work environments it is very common to display information on "fixed" or "static" vertical surfaces, such as full-height walls, partial-height panel walls, or the like. Fixed walls typically provide for the territorial division of the work space, and incidentally provide a stable vertical surface for the prominent display of information (e.g. space for "tiling" of information). However, because the amount of vertical wall surfaces available for use to display information is limited, the volume of information that can be displayed is limited. Moreover, fixed walls are not readily reconfigurable to form work areas since reconfiguration of the work space is generally a time-consuming and labor-intensive process beyond the capability of the workers themselves and requiring a substantial amount of advance planning and the use of tools and other equipment. Because fixed walls are effectively immobile and are not typically positioned for the display of information, their efficiency is further limited. In addition, the commonly known methods of presenting information on fixed walls of such known arrangements, for example, do not provide an organizational framework well suited to achieve an optimal degree of information persistence. In many instances, according to commonly known arrangements, the visual effect or "scenery" provided in the work environment by information displayed on vertical walls and surfaces tends to be static and constantly "on display," rarely being refreshed or interchanged for example, when placing charts in relatively inaccessible locations. In other instances, manner in which the information displayed on the vertical surface renders it fleeting and easily defaced, for example when information is written on a white board. That is, fixed walls are not able to adequately achieve optimum "information persistence" attributes, or to support the reconfigurability necessary in a dynamic work environment.

It is also very common to display and store information on horizontal surfaces, such as provided by desks, tables, shelving units or the like, in stacks or piles. However, given that the amount of horizontal surfaces in a work environment is limited, such information is commonly "stacked" or covered with other information, with other information given precedence—intentionally or inadvertently—over the information beneath it. As layers of information are created on the horizontal surface, it is common for workers to adopt a practice where the information is brought into view from beneath other information only as it is needed. While information presented in this fashion is ordinarily characterized by its accessibility, such information is often forgotten, lost or misplaced as "layers" are rearranged, particularly in situations involving large or varied amounts of information in relation to the available work space. Also, when a horizontal surface is used in this manner, workers are deprived of space that might be put to better use as an actual worksurface instead of as a storage space for information of lower precedence. The use of a horizontal surface in this manner is inconsistent with the dynamic work environment, where information is ideally used, displayed and stored in a highly efficient manner, and where work surfaces may be shared by more than one worker (each of whom may require or desire access to entirely different sets of information).

Hanging display panel systems represent an attempt to achieve the advantages of prominence and accessibility, not achieved either by use of fixed walls or worksurfaces. However, hanging display panel systems do not fully achieve optimum "information persistence" attributes particularly in situations involving large or varied amounts of information in relation to the available work space. Hanging display panel systems attempt to provide a less permanent, but prominent, vertical surface on which to display information, in a work area. Hanging display panel systems have been developed to display information in various formats utilizing individual panels that are portable and can be displayed in layered or other arrangements. At times, these configurations can include arrangements that provide a degree of reconfigurable space division and the mobile display panels do allow information to be refreshed or interchanged. But the mobility of display panels in such systems makes them difficult to "manage" for either an organized framework for providing the optimum degree of information persistence or utilizing the boards for effective space division. Indeed, while such systems may include a wide variety of mounting structures, such as carts, overhead beams or other structures that allow a wide variety of configurations, none provide an optimum framework for such management.

Accordingly, it would be advantageous to provide for an information display system for use in a work environment that facilitates the efficient use, display and storage of information in the work environment. It would also be advantageous to provide for an information display system that more effectively facilitates "information persistence"—the collection and retention of information meaningful to an individual or group—so that information is readily available and can be "revealed" when needed and yet can be "concealed" and conveniently stowed away securely when not needed. It would further be advantageous to have an information display system that facilitates the management and use of information on vertical surfaces, providing an abundance of display surfaces while occupying a minimal amount of work space. It would further be advantageous to have an information display system that provides an organizational scheme for separating, identifying and linking related but distinct fields of displayed information. It would further be advantageous to provide for a workstation using the information display system and associated structures in order to create work areas that can be readily configured and reconfigured for use by individual workers, small groups or workers and large groups or workers. It would further be advantageous to provide for a work environment including the information display system so that workstations and work areas can dynamically be configured and reconfigured. It would further be advantageous to have an information display system for use in a work environment that allows the efficient and complete transformation of the visual context of a work space or workstation during transitions between projects, tasks and personal respites in the course of a work day or work week. It would further be advantageous to have an information display system for use in a work environment providing for an arrangement and proportion of display boards that evoke a spatial sensation or envelopment and immersiveness for an individual or small group viewing the information.

SUMMARY OF THE INVENTION

The present invention relates to an information display system. The information display system includes a track system adapted to attach to a substantially vertical mounting structure and a plurality of display panels coupled to the track system for both pivotal and translating movement with respect to the mounting structure. At least one display panel of the plurality of display panels is adapted to present information selectively for display by movement of the plurality of display panels.

The present invention also relates to a work space providing at least one work area. The work space includes a mounting structure and a track system attached to the mounting structure. A plurality of display boards attached to the track system for both pivotal movement within relative to the mounting structure and translating movement relative to the track system. The display boards are adapted to display information and wherein the display boards are movable between a first arrangement and at least one second arrangement to selectively reveal at least a portion of the information and to selectively conceal at least another portion of the information.

The present invention further relates to a work space for providing at least one work area. The work space includes a track system and an information display system including a plurality of display panels adapted to present information attached to the track system for both pivotal and translating movement with respect to the track system between a first arrangement and at least one second arrangement. In at least one work area the first arrangement of panels within the at least one work area are configured to display information on the panels to individual workers and the second arrangement of panels within the at least one work area is configured to share information or the panels with a group of workers.

The present invention further relates to an information display system. The information display system includes at least one rail and a plurality of display boards attached for movement with respect to the at least one rail. The display boards are cantilevered away from the at least one rail at a vertical elevation to provide clearance below the display boards for a seated worker.

The present invention further relates to an information display system. The information display system includes a track system adapted for attachment to a mounting structure and a plurality of containers coupled to the track system for movement with respect to the mounting structure. Each of the plurality of containers is adapted to provide a first display panel and a second display panel. Each of the display panels is adapted to present information and the information can selectively be presented for display by movement of the plurality of containers.

The present invention further relates to a work space. The work space includes a mounting structure and a track system adapted for attachment to the mounting structure. A plurality of display panels is coupled to the track system for movement along the track system. A docking area is positioned along the track system configured to at least partially conceal at least one of the display panels.

The present invention further relates to a workstation defining a work area. The work area includes at least one utility threshold adapted for movement along a predefined path about the work area to selectively deliver utilities to at least one portion of the work area.

The present invention further relates to a fixed floor space work environment adapted to support a group of workers sharing information contained on a plurality of display panels. The work environment is provided with the plurality of display panels mounted for movement along at least one rail between a first arrangement and at least one second arrangement. The first arrangement allows one worker to use substantially all available floor space, the second arrangement allows a plurality of workers to share the available floor space so as to facilitate the utilization of the floor space by workers present in the work environment.

DETAILED DESCRIPTION OF THE PREFERRED EMBODIMENTS

Referring to the FIGURES, an information display system is shown for use in association with a work environment that may include one or more workstations according to preferred and other exemplary embodiments of the present invention. For purposes of any exemplary or alternative embodiments of the present invention, the work environment may be of any type generally providing a work space for one or more workers. The work space may be divided or otherwise arranged to provide one or more work areas for use by the workers, who may be engaged in any of a wide variety of individual activities or group activities, for example, as may be performed by members of a project team or department. Workstations may be configured within the work environment by including one or more articles of furniture within the work areas in support of the workers and their activities. As indicated in FIGURES, the information display system may be adapted for use within the work environment or included workstations in wide variety of arrangements, each intended to support individual or collaborative activities of one or more workers, for example, by facilitating the efficient creation, use and storage of information or the configuration and reconfiguration of work areas for the activities.

According to a particularly preferred embodiment, the work environment will be defined at least partially by architectural walls and/or a system of panel walls, such as partial height partitions, any of which may provide a mounting structure for the information display system. As will be shown with reference to exemplary embodiments, the work environment and associated workstations may be arranged to include any of a wide variety of articles of furniture and other associated elements, including additional panel walls configured in any of a wide variety of orientations, chairs or other seating products, storage or casegoods products, tables and other worksurfaces, lighting products or systems, as well as other accessories, electronic or computing equipment and other systems (with associated connectivity such as cabling) known and used in the work environment. According to alternative embodiments, any one or more articles of furniture may provide a mounting structure for the information display system.

Figure 1:
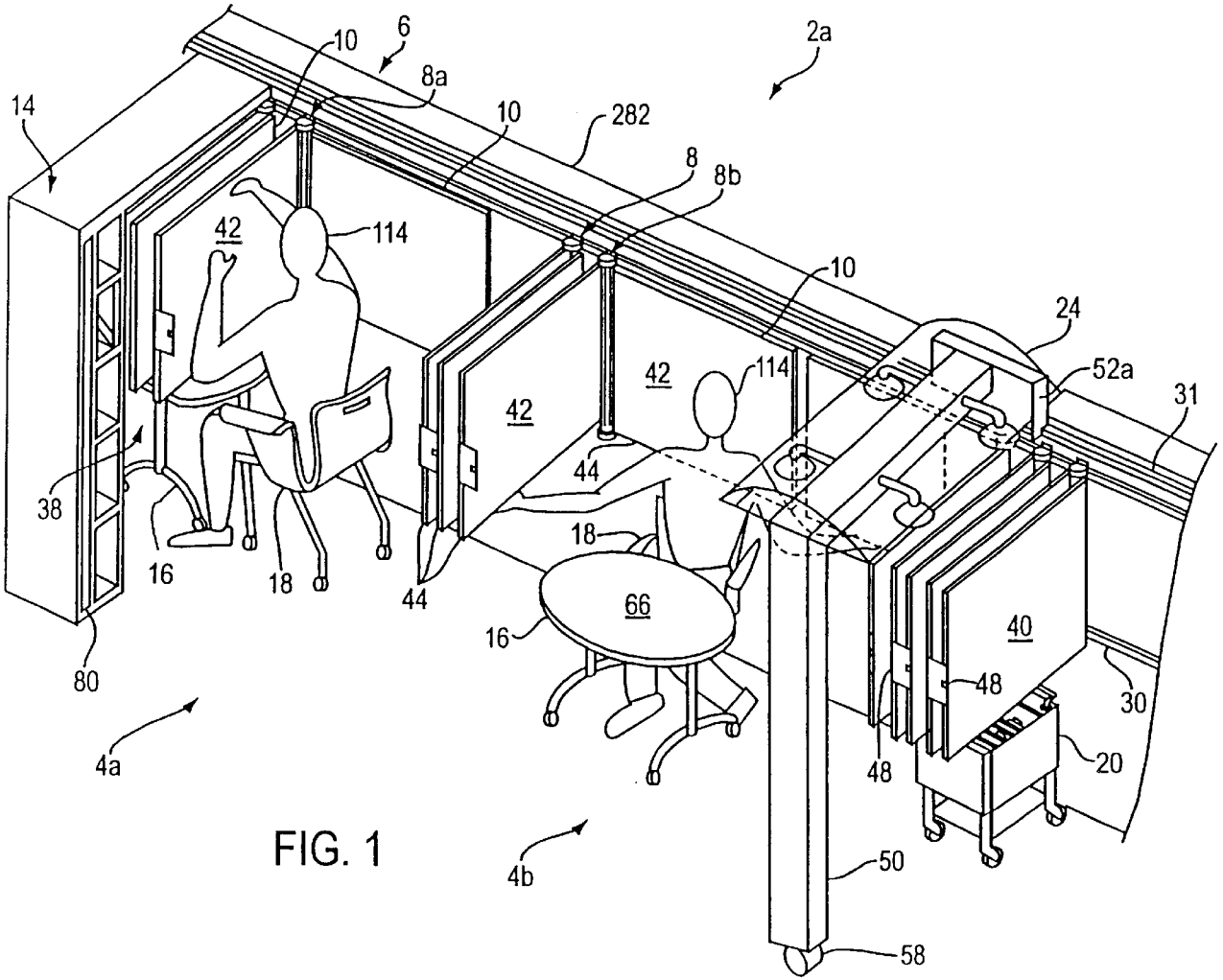
FIG. 1 is a perspective view of a work environment according to an exemplary embodiment of the present invention.

Referring to FIG. 1, a work environment 2*a* defining a work space is shown according to an exemplary embodiment of the present invention. Work areas including workstations 4*a* and 4*b* are provided within the work space defined by work environment 2*a*. Workstations 4*a* and 4*b*, formed along a vertical panel wall 282 standing on a floor 118, can be configured for use by one or more workers 114 (two workers are shown working independently in separate work areas) and to include one or more articles of furniture. Workstation 4*a* includes a shelving unit 14, a mobile table 16 and a chair 18; workstation 4*b* includes a mobile file cart 20, mobile table 16 and chair 18. Work environment 2*a* also includes an information display system 6 and a utility threshold 24 that can be associated with either of workstations 4*a* and 4*b*.

Information display system 6 includes a plurality of information-containing structures shown as containers 8. Each container 8 provides two lateral panels shown as a right display panel 44 and a left display panel 44; each display panel 44 provides one exterior surface 40 and one interior surface 42; each container 8 thus provides two exterior surfaces 40 and two interior surfaces 42 for the display or presentation of information. Each container 8 is coupled to a track system shown as a set of horizontal rails 30 mounted to a mounting structure shown as panel wall 282 through a mounting assembly. According to a particularly preferred embodiment, as shown in FIG. 1, the mounting assembly includes a slide mechanism configured to allow for translating movement of the container along the track system and a pivot mechanism configured to allow for pivotal movement of each display panel about a vertical axis with respect to the mounting structure. According to any preferred embodiment, each display panel of the container is coupled to the pivot mechanism so that either display panel can be pivoted with respect to the other display panel. A docking area 38 shown as associated with shelving unit 14 provides a defined and partially covered space or envelope for convenient stowing of one or more containers 8 (as well as other articles of furniture, such as mobile table 16) within workstation 4*a*.

Utility threshold 24 is coupled to a track system shown as a horizontal rail 31 mounted on the side of panel wall 282. Utility threshold 24 is formed of an "L"-shaped frame with a horizontal frame member shown as a horizontal beam 49 and a vertical frame member shown as post 50. Utility threshold 24 includes a mounting assembly 52*a* having a slide mechanism 54 (including one or more glide blocks) engaging horizontal rail 31, and a canopy 55 associated with light fixtures 56 attached to beam 49; utility threshold 24 also includes a floor wheel assembly (e.g. shown as a caster 58 or the like) at the base of post 50. As shown, utility threshold 24 is configured for sliding movement along panel wall 282 on horizontal rail 31 and rolling movement along floor 118 on wheel assembly. According to any particularly preferred embodiment, the utility threshold is configured to supply utilities (i.e., voice, power, data, etc.) or connectivity to utilities for use in the work area, see FIGS. 16A and 16B.

It should be noted that according to any preferred embodiment, the information display system and its associated elements can be readily and easily be arranged to configure or reconfigure one or more workstations or work areas of varying sizes within the work space given in a work environment, for example by selective arrangement of the containers and/or display panels of the information display system, the utility threshold, and the docking area and other associated articles of furniture, to support one or more workers in individual or group activities. According to alternative embodiments, the docking area may be provided by any of a wide variety of structures or articles of furniture, alone or in combination, that have been arranged to provide a space where containers and/or display panels and articles of furniture can be stowed. In the exemplary embodiment of FIG. 1, two workstations 4*a* and 4*b* have been formed, each configured to support individual workers 114 engaged in independent work using information presented on display panels provided by the information display system.

As shown in FIG. 1 and other FIGURES, information contained on display panels may selectively be revealed or concealed, for example, by selective arrangement of the relative positions of the containers with respect to other containers or associated articles of furniture or by selective arrangement of the pivotal condition of the display panels associated with the containers. When the display panels are oriented so that the interior surface of one display panel of the container is drawn adjacent to and in parallel alignment with respect to the other display panel of the container, the container is said to be in a "closed" condition and information contained on either of the interior surfaces is said to be "concealed." When one display panel of the container is pivoted about the vertical axis out of parallel alignment with respect to the other display panel of the container, the container is said to be in an "open" condition and information contained on both of the interior surfaces is said to be "revealed" (if not otherwise obstructed or concealed from view). Each display panel of the container may independently be pivoted 90 degrees from the closed condition; when each display panel has been pivoted 90 degrees so that the display panels are 180 degrees opposed, the container is in a "fully open" condition and information on both interior surfaces is "revealed", while information on both exterior surfaces is "concealed". Referring to FIG. 1, containers 8 are closed and containers 8*a* and 8*b* are partially open (with one display panel pivoted 90 degrees with respect to the other display panel); no containers are shown fully open. As can be seen any number of combined orientations of display panels can cause information to be "revealed" or "concealed" depending on whether a given surface is visible. As will be shown, a display panel may include or be made up of one or more display boards, typically selectively removable boards or sheets that contain information intended for display or to which information may be applied.

Figure 2A:
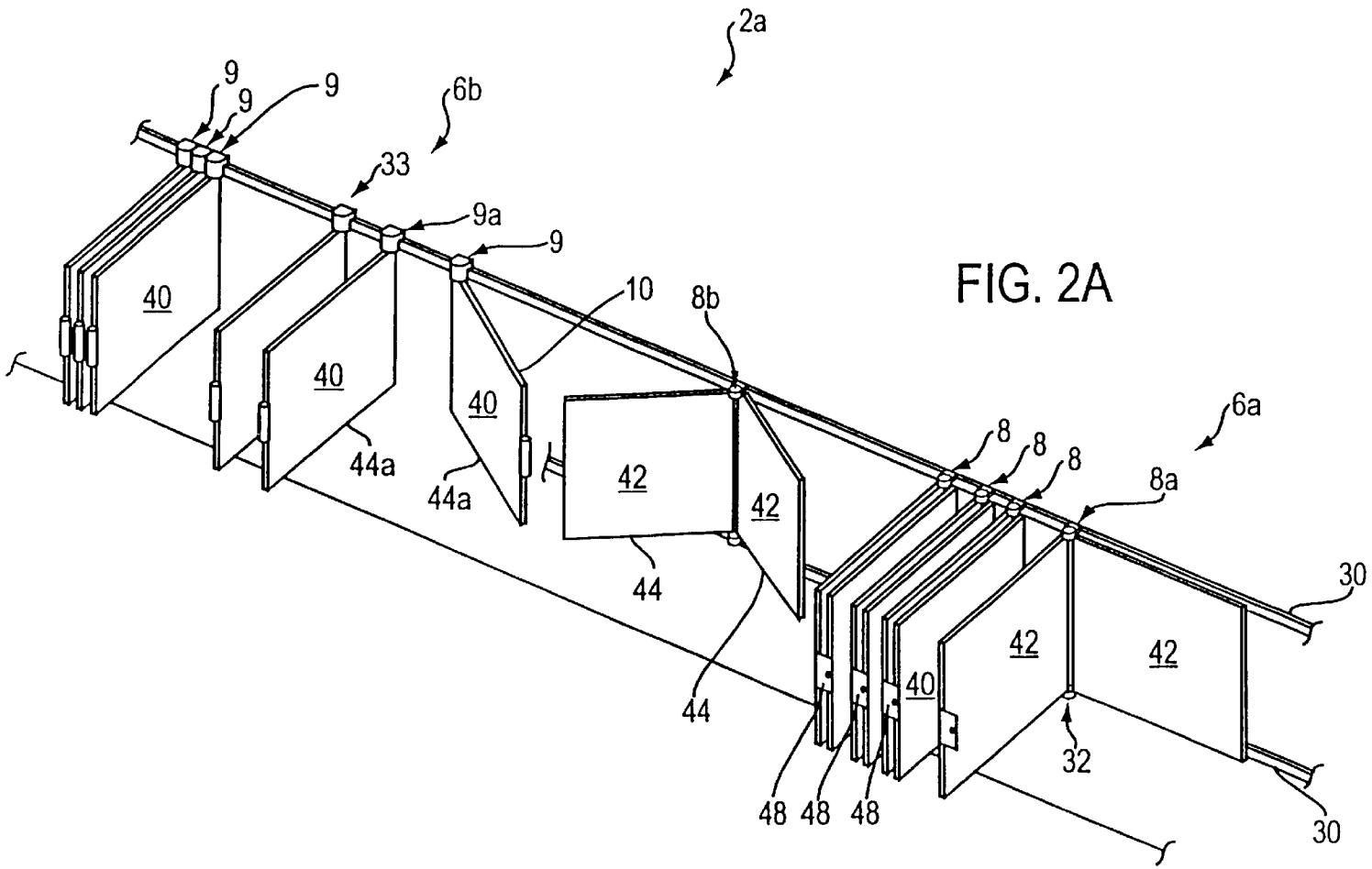
FIG. 2A is a perspective view of an information display system according to an exemplary embodiment of the present invention.

FIG. 2A shows the basic elements of information display systems 6*a* and 6*b* according to a first exemplary embodiment and a second exemplary embodiment. According to the first exemplary embodiment, information display system 6*a* includes containers 8 having a mounting assembly 32 configured for attachment to horizontal rails 30. According to the second exemplary embodiment, information display system 6*b* includes containers 9 having a mounting assembly 33 configured for attachment to a track system including a single horizontal rail 30. As shown, both mounting assembly 32 and mounting assembly 33 also allow for pivotal movement of associated containers 8 and 9, respectively, with respect to the respective mounting structure. According to the first exemplary embodiment, each container 8*a* provides two pivotally coupled display panels 44 (i.e. as shown in FIG. 1). According to the second exemplary embodiment, each container 9 includes a single display panel 44*a* that provides two exterior surfaces 40 (but no interior surfaces). Single display panel 44*a* is coupled to mounting assembly 33 to allow for pivotal movement with respect to the mounting structure. As is evident, according to either exemplary embodiment, information contained on an exterior surface of a display panel of a container is ordinarily revealed and visible but may be concealed when that container is positioned closely adjacent to another container (or when positioned in a suitable docking area or closely adjacent to a wall or other article of furniture). According to any preferred embodiment, regardless of the number of display panels, the information display system will include containers that selectively allow information presented on the display panels to be revealed and concealed.

Figure 2B:
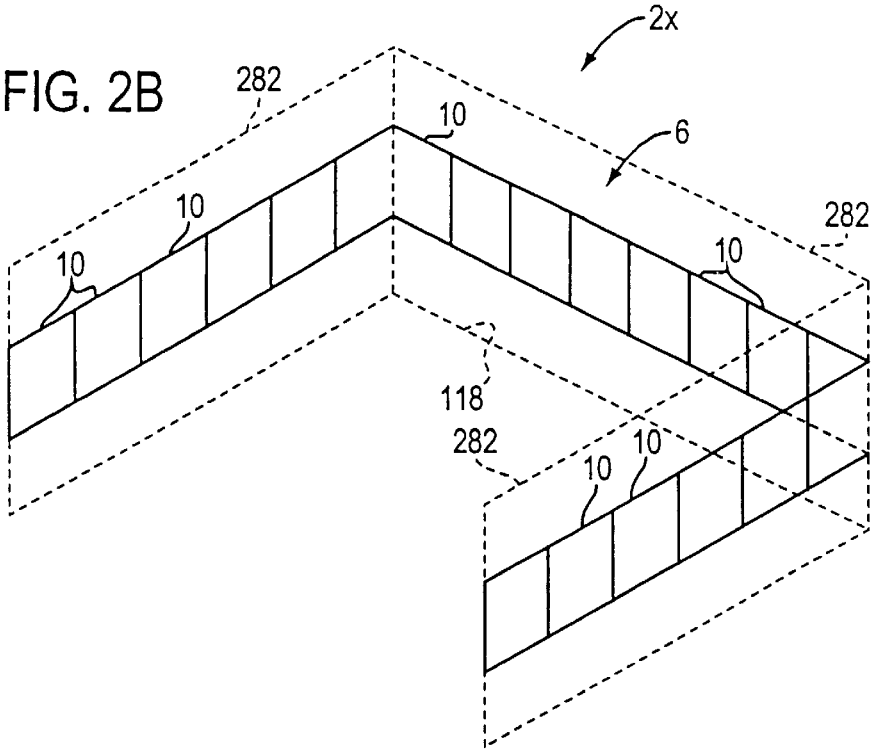
FIG. 2B is a perspective view of a work space provided in a conventional work environment.
Figure 2C:
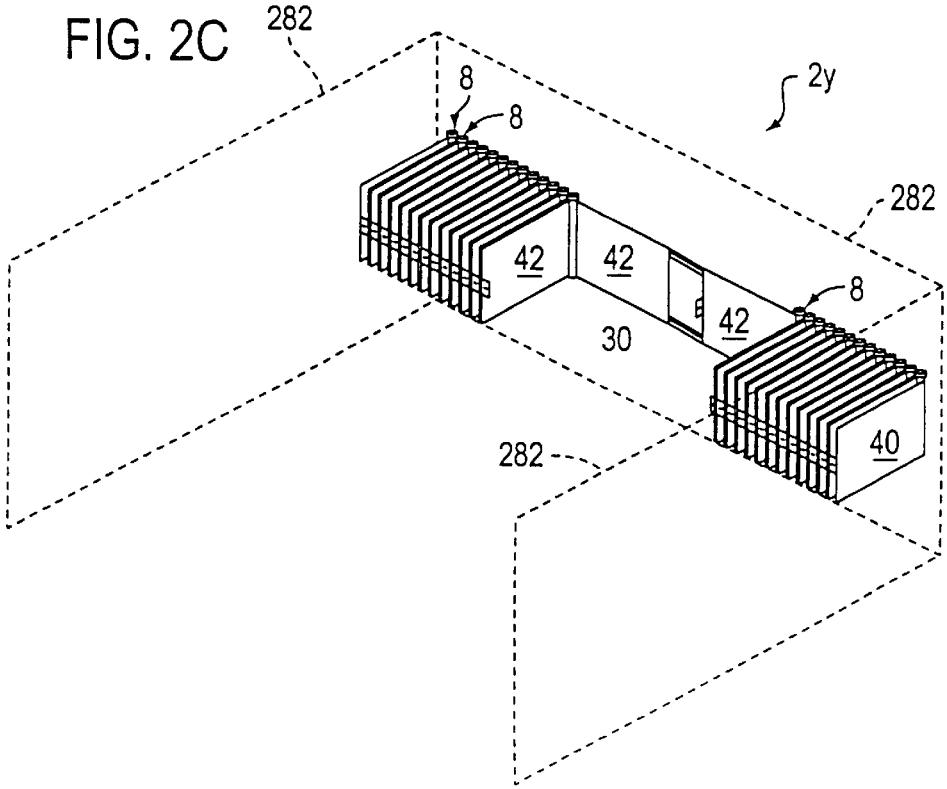
FIG. 2C is a perspective view of a work space provided in a work environment including an information display system according to an exemplary embodiment of the present invention.

As shown in FIGS. 2A and 2C, containers 8 of information display system 6 provide for the display of information in a space-efficient, vertical orientation. As a result, by use of the information display system, the total vertically-oriented and prominent space available for display of information within a work environment can be increased in comparison to conventional work environments that do not include the information display system. Referring to FIG. 2B, a conventional work environment 2*x* is shown as a room (i.e. for purposes of example, a room of 18 feet by 21 feet in dimension). Conventional work environment 2*x* includes four vertical walls (visible are three walls 282) and floor 118; conventional work environment 2*x* has a fixed amount of vertical wall display area and a fixed amount of work space or floor space. As shown, with each of three walls 282 in use, conventional work environment 2*x* may contain a fixed number of display boards 10 (e.g. shown to be 19 display boards), which may be mounted to the walls, hung along the walls, or in a sliding mounting interface, etc. (in any event each display board is parallel to the wall on which it is mounted). (For purposes of example, each display board is 3 feet by 4 feet in dimension.) Referring to FIG. 2C, a work environment 2*y* is shown as a room including an information display system 6 according to an exemplary embodiment of the present invention. Although work environment 2*y* is otherwise identical in size to conventional work environment 2*x*, and therefore has the same amount of vertical wall display area and floor space, installation of information display system 6 on a single wall 282 has substantially increased the number of display boards 10 that may be contained in work environment 2*y*. As shown in the exemplary embodiment, information display system 6 presents a total number of 112 display boards 10 (four associated with corresponding display panels of each of 28 containers) on single wall 282; in conventional work environment 2*x*, single wall 282 presented only seven display boards 10 (while use of all three visible walls presented only a total of 19 display boards). As shown in comparison of FIGS. 2B and 2C, and according to any preferred embodiment, the information display system increases the amount of information that can be presented for display within a work environment giving an otherwise fixed amount of wall space or vertical surface area. As shown in FIG. 2C and other FIGURES, the information display system also facilitates the management of a comparatively large volume of information for access, display and storage in a given work environment.

Figure 4A:
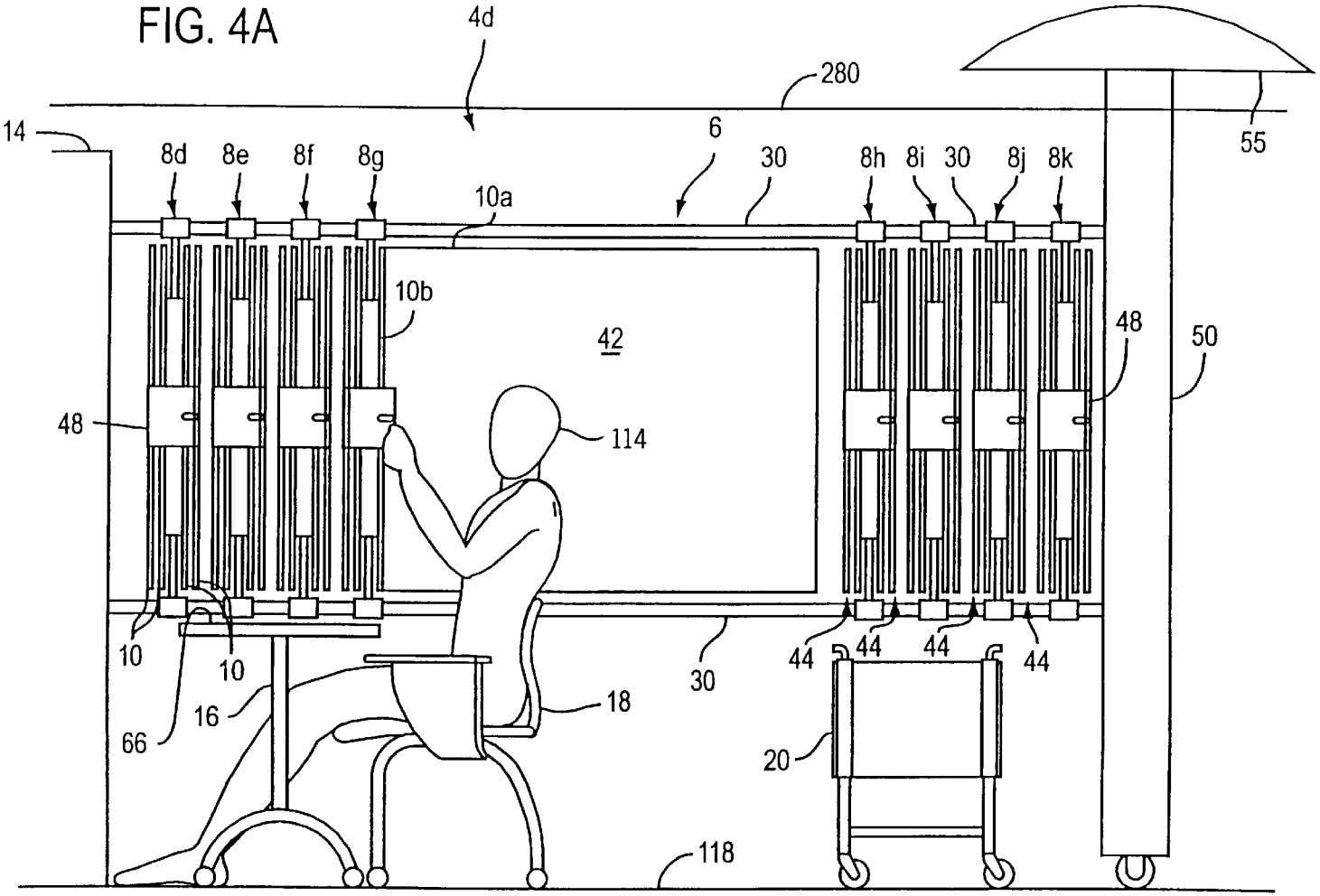
FIG. 4A is a front elevation view of a workstation according to an exemplary embodiment of the present invention.
Figure 4B:
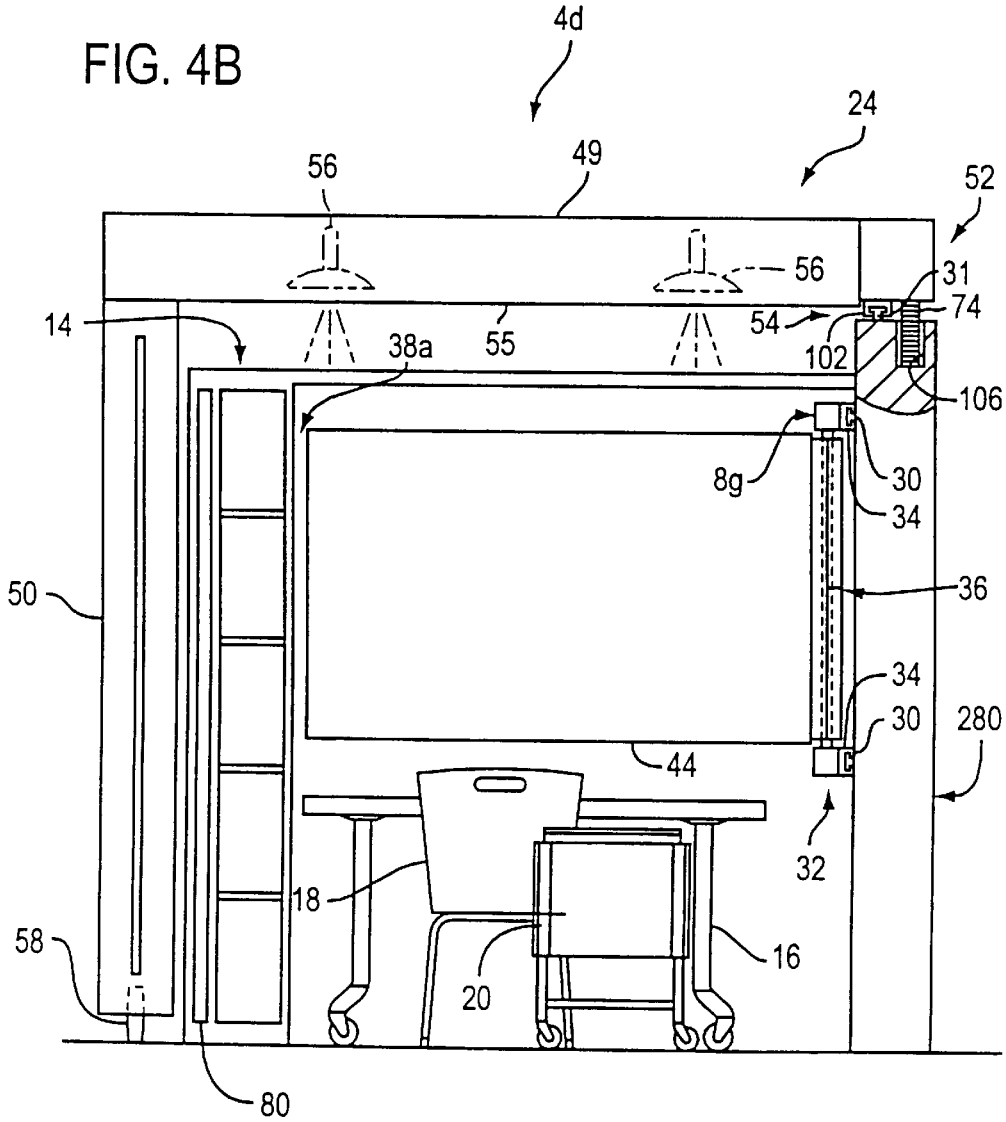
FIG. 4B is a side elevation view of the workstation of FIG. 4A.

Referring to FIGS. 4A and 4B, an exemplary embodiment of a workstation 4*d* including an information display system 6 is shown. Information display system 6 has containers 8*d*, 8*e*, 8*f*, 8*g*, 8*h*, 8*i*, 8*j*, and 8*k* attached for movement along set of rails 30 mounted on a base panel wall 280. FIGS. 4A and 4B illustrate the spatial relationship between the containers, utility threshold 24, shelving unit 14 providing a docking area 38*a*, as well as worker 114 and other articles of furniture, including panel wall 280, a table 16, a chair 18, and a mobile file unit 20, in workstation 4*d*. As shown in FIG. 4A, worker 114 is seated in chair 18 at table 16 which provides a horizontal worksurface 66 directly beneath open container 8*g*, so that worker 114 is "immersed" in the information presented at display boards 10*a* and 10*b* much like a worker would be in relation to information posted on the relatively fixed walls of a conventional workstation. According to a particularly preferred embodiment, as shown in FIGS. 4A and 4B, the containers are configured and installed to allow for free movement along the track system within the workstation above the height of horizontal work-surfaces and other articles of furniture within the work area, yet below the associated utility thresholds or other structures.

As shown in FIG. 4B, container 8*g* includes mounting assembly 32 configured to allow for translating movement along set of rails 30 mounted on the side of panel wall 280. Mounting assembly 32 includes a set of slide mechanisms 34 (each shown as including a glide block) that engage corresponding set of rails 30. Mounting assembly 32 also includes a pivot mechanism 36 allowing independent pivotal movement of each display panel 44 of container 8*g* with respect to panel wall 280 (see, e.g., FIGS. 18A through 18C and 20A through 20E) from the closed condition to the fully open condition. Container 8 may include a locking mechanism 48 that can be engaged to hold container 8 in the closed condition; locking mechanism 48 has elements associated with each display panel of the container that must be disengaged to allow container 8 to be opened (see, e.g., FIG. 21C).

Also as shown in FIG. 4B, utility threshold 24 includes a mounting assembly 52 configured to allow for translating movement along a track system shown as rail 31 mounted on the top of panel wall 280. Mounting assembly 52 includes slide mechanism 54 shown as including a glide block 102 that engages rail 31. Mounting assembly 52 also includes a utility infeed shown as a flexible conduit 74 within a trough or recess 106 in the top of panel wall 280 to allow utilities (e.g. voice, power, data, etc.) to be supplied from panel wall 280 by or through utility threshold 24 into workstation 4*d* (see also FIGS. 16A and 16B). Horizontal beam 49 of utility threshold 24 is shown positioned at an elevation above the other articles of furniture within workstation 4*d*; horizontal beam 49 also includes canopy 55 and lighting fixtures 56 for illuminating workstation 4*d*. Vertical post 50 of utility threshold 24 is shown positioned at a lateral distance outboard of the other articles of furniture within workstation 4*d*; vertical post 50 also includes cast 58 for rolling on floor 118 to facilitate movement of utility threshold 24 along track 31; vertical post 50 may also provide one or more connections for voice, power and data for use within workstation 4*d* (see, e.g., FIGS. 16A and 16B). Utility threshold 24 is free to move along track 31 without interference from either the containers (e.g. containers 8*d*, 8*e*, 8*f*, 8*g*, 8*h*, 8*i*, 8*j*, and 8*k*) or shelving unit 14 (which provides docking area 38*a* for the containers). Utility threshold 24 itself may be considered to be "docked" when positioned over shelving unit 14. According to alternative embodiments, the utility threshold may be "docked" within a docking area provided by a structure that is larger that the utility threshold or that otherwise is wholly or partially capable of containment of the utility threshold (as well as containers).

Referring to FIGS. 3A through 3D, a workstation 4*c* with an associated information display system 6 is shown in a work environment according to an exemplary embodiment of the present invention. Workstation 4*c* includes base panel wall 280 and docking area 38*a* shown as two panel wall sections 62 and 64 (e.g. partial height walls forming a covering "panel wrap") for containers 8*d*, 8*e*, 8*f*, 8*g*, 8*h*, 8*i*, 8*j*, and 8*k* of information display system 6. Workstation 4*c* also includes a mobile table 16 and a mobile storage unit 260. A decorative surface or functional surface treatment (e.g. shown as a dry-erase "white" board 288) may be installed on base panel wall 280 between rails 30, to provide an additional vertical surface within workstation 4*c* adapted for the display of information.

FIGS. 3A through 3D illustrate the ability of the information display system 6 to effect an efficient and complete transformation of the visual context or "scenery" of a work area shown as including a workstation 4*c*, for example between projects, tasks and personal respites in the course of a work day or work week, etc. Both the territorial appearance (e.g. space allocation or division or orientation of workers) and the contextual appearance (e.g. the nature and purpose of the information, whether functional or decorative) of the workstation may be altered using the information display system, depending upon the information and content and association of each container with other containers and with articles of furniture within the workstation. According to any preferred embodiment, the information display system facilitates both "physical"/territorial reconfiguration and "visual"/contextual reconfiguration within the work environment or the workstation in several ways, including the following: by physical movement of the containers (not only to divide the work space into work areas of varying sizes but also to reveal or conceal information presented on the interior surfaces or exterior surfaces of the containers); by opening and closing the containers to reveal or conceal information presented on the interior surfaces or exterior surfaces of the containers; by changing the display boards associated with the containers; or by revising or modifying the information presented on the display boards. According to any preferred embodiment, the information display system will include display panels that are capable of arrangement, as well as that are sized and proportioned, to evoke a spatial sensation of envelopment and immersiveness for individual workers or groups of workers viewing the information presented. As evident in FIGS. 3A through 3D, it is not necessary to move panel walls and other articles of furniture that are generally considered "fixed" once installed in the work environment (or are not otherwise readily repositioned).

Figure 3A:
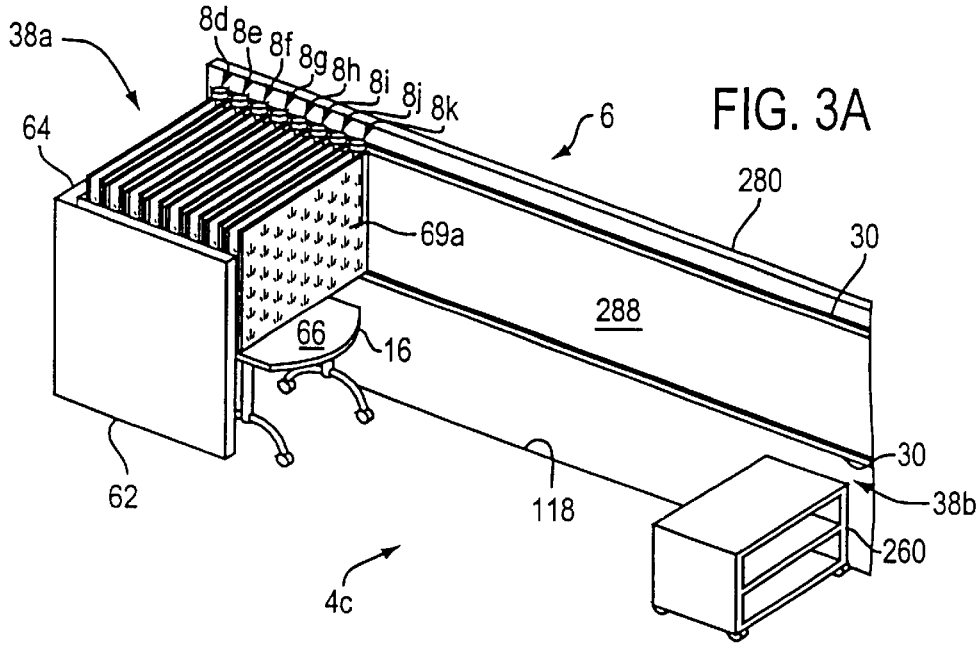
FIG. 3A is a perspective view of a workstation according to an exemplary embodiment of the present invention.
Figure 3B:
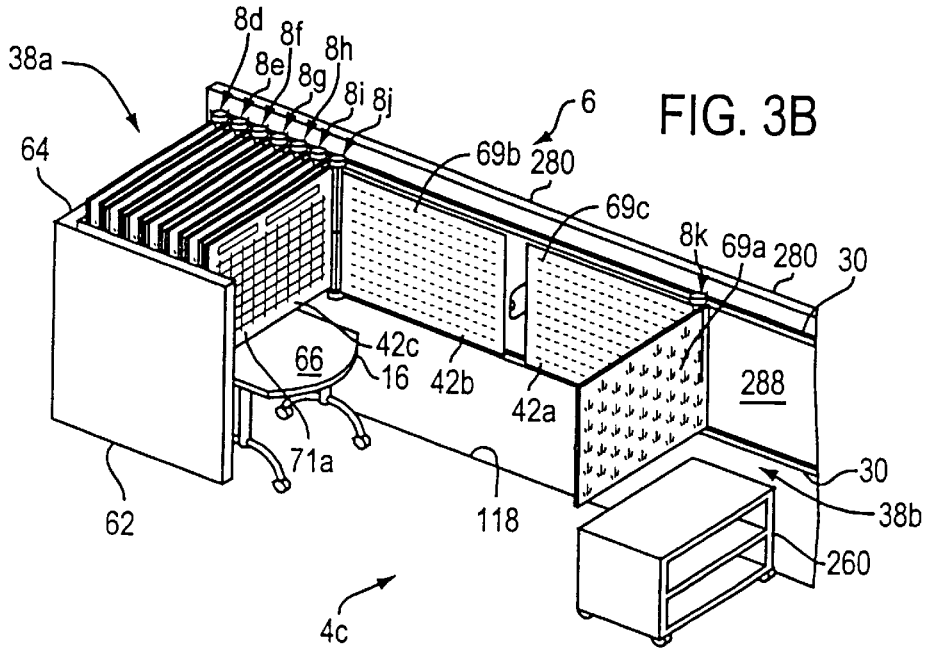
FIG. 3B is a perspective view of a work station according to an exemplary embodiment of the present invention.
Figure 3C:
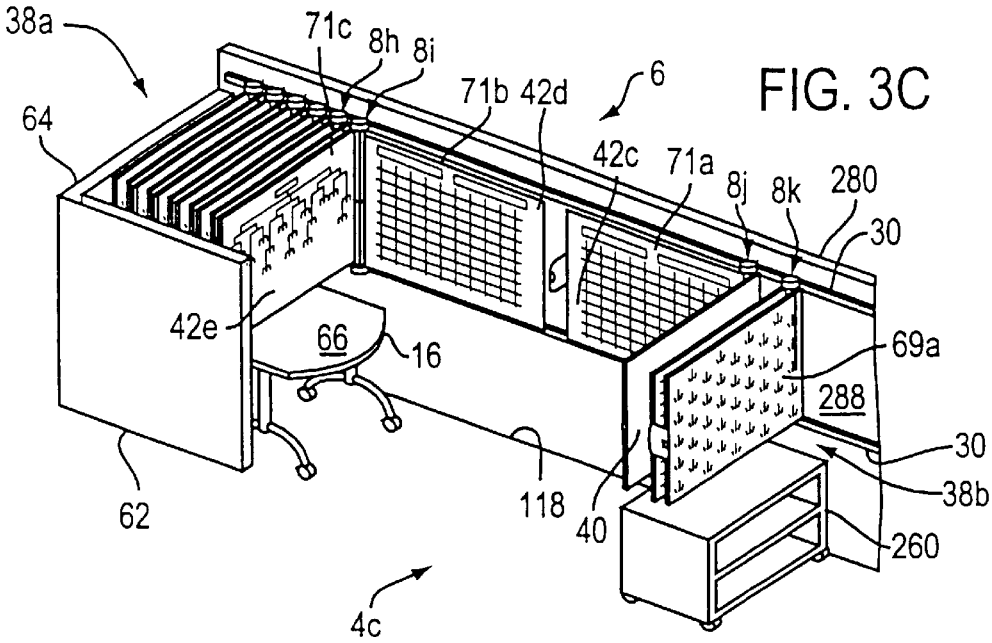
FIG. 3C is a perspective view of a work station according to an exemplary embodiment of the present invention.
Figure 3D:
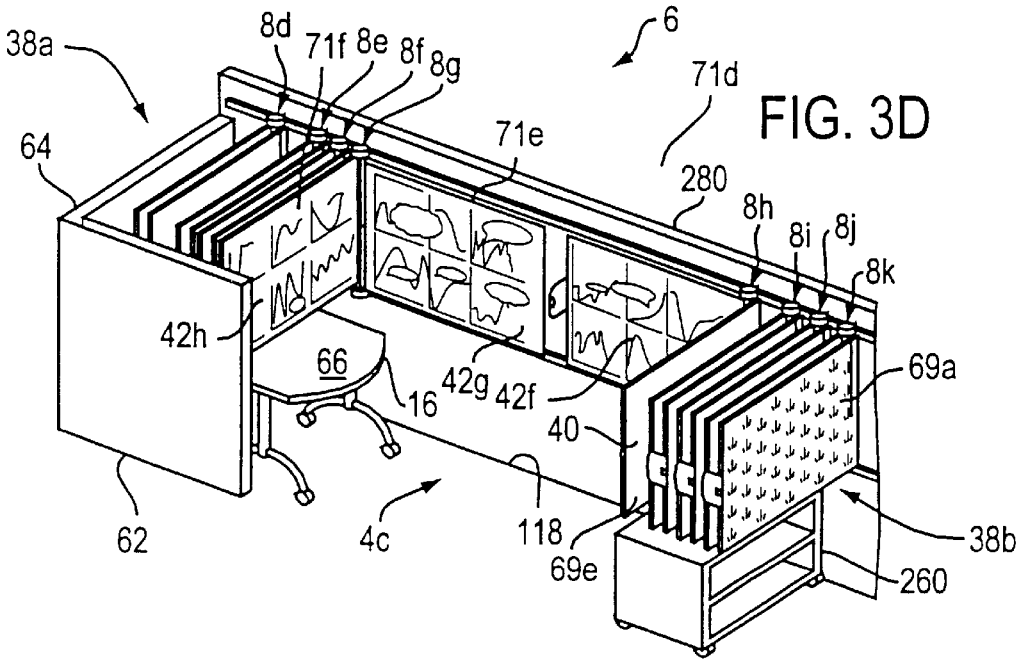
FIG. 3D is a perspective view of a work station according to an exemplary embodiment of the present invention.

As shown in FIGS. 3A through 3D, the "scenery" presented within workstation 4*c* by information display system 6 including eight containers is readily reconfigurable. In FIG. 3A, all eight containers are stowed within docking area 38*a* so that only one exterior surface 40 of one container 8*k* is visible; exterior surface 40 bears a decorative image 69*a*. In FIG. 3B, one container 8*k* has been moved from docking area 38*a* to a docking area 38*b* (an uncovered but identifiable space above a mobile storage unit 21; two containers 8*j* and 8*k* are open so that four interior surfaces 42*a*, 42*b* and 42*c* are visible within workstation 4*c* (although only three interior surfaces are visible in FIG. 3B), along with one exterior surface 40; one functional image 71*a* and three decorative images 69*a*, 69*b* and 69*c* are shown. In FIG. 3C, two containers 8*k* and 8*j* have been moved from docking area 38*a* to docking area 38*b*; two containers 8*j* and 8*i* are open so that four interior surfaces 42*c*, 42*d* and 42*e* are visible within workstation 4*c* (although only three interior surfaces are visible in FIG. 3C), along with one exterior surface 40; three functional images 71*a*, 71*b*, and 71*c* and one decorative image 69*d* are shown. In FIG. 3D, four containers 8*k*, 8*j*, 8*h*, and 8*i* have been moved from docking area 38*a* to docking area 38*b*; two containers 8*h* and 8*g* are open so that four interior surfaces 42*f*, 42*g* and 42*h* are visible within workstation 4*c* (although only three interior surfaces are visible in FIG. 3D), along with one exterior surface 40; three functional images 71*d*, 71*e*, and 71*f* and one decorative image 69*e* are shown.

It should be noted that the information, images and arrangements shown in FIGS. 3A through 3D are only exemplary (and essentially schematic). According to any preferred embodiment, the interior surfaces and exterior surfaces of the display panels associated with the containers may be provided with any of a wide variety of information and images, functional and/or decorative, in whole or in part, intended to provide one or more workers with an atmosphere that facilitates project work, instruction, rest and rejuvenation, etc. The workstation may itself include a greater or lesser number of containers and/or display panels, capable of movement and association in any of a wide variety of arrangements.

Referring to FIGS. 5 through 15B, exemplary embodiments of work environments and workstations including the information display system are shown. As shown in the FIGURES, both the territorial appearance (i.e. arrangement) and contextual appearance of the work environment and associated workstations can be readily and easily be configured and reconfigured by arrangement of basic elements of the information display system, the utility threshold and other mobile articles of furniture. Space division, or "territorial" reconfiguration of work spaces and work areas, will not require rearrangement of any "fixed" elements, such as panel walls and other articles of furniture that are generally considered to be "fixed" once installed in the work environment insofar as substantial effort (e.g. disassembly, lifting, etc.) or tools are required for movement. Additionally, territorial reconfiguration will not require individual display panels to be detached from the information display system and be independently rearranged. Visual modification, or "contextual" reconfiguration of work spaces and work areas of varying sizes can likewise be effected without rearrangement of any "fixed" elements within the work environment or needing to independently handle detached display panels. According to any preferred embodiment, following initial installation of the "fixed" articles of furniture and information display system and associated elements within the work environment, the individual worker or workers may selectively configure or reconfigure the work space into one or more work areas and workstations, or may selectively arrange the containers to reveal or conceal information presented on the associated display panels, as needed to support their activity or activities. As a result, and as shown in FIGS. 5 through 15B, the work environment is capable of flexible and dynamic configuration and reconfiguration to support a wide variety of workers engaged in a wide variety of tasks and activities that may require creation, use and storage of even a large volume of information.

FIGS. 5 through 10 show a work environment 2*c* in the form of an individual or small group work space. Work environment 2*c* includes a base panel wall 280 and two end panel walls 290 and 292, with shelving unit 14 at each lateral end (and each considered to be "fixed" structures), defining two generally symmetrical work spaces 3*a* and 3*b* (one work space on each side of base panel wall 280), which, for purposes of example, can be considered to provide a fixed amount of floor space (e.g. 6 feet by 16 feet in dimension). Work space 3*a* includes an information display system 6*a* including a plurality of containers 8*d*, 8*e*, 8*f*, 8*g*, 8*h*, 8*i*, 8*j*, and 8*k*. Work space 3*a* also provides docking areas 38*a* and 38*b* for the containers defined by end panel walls 290 and 292 and associated shelving units 14. Work space 3*a* further includes mobile table 16 and one or more chairs 18. Using FIGS. 5 through 10, work space 3*a* of work environment 2*c* will illustrate features provided by information display system 6*a* according to an exemplary embodiment of the present invention, including the configuration of work areas and workstations for use by one or more workers, and arrangements of containers for revealing and concealing information presented on display panels (i.e. interior surfaces and exterior surfaces) associated with the containers.

Figure 5:
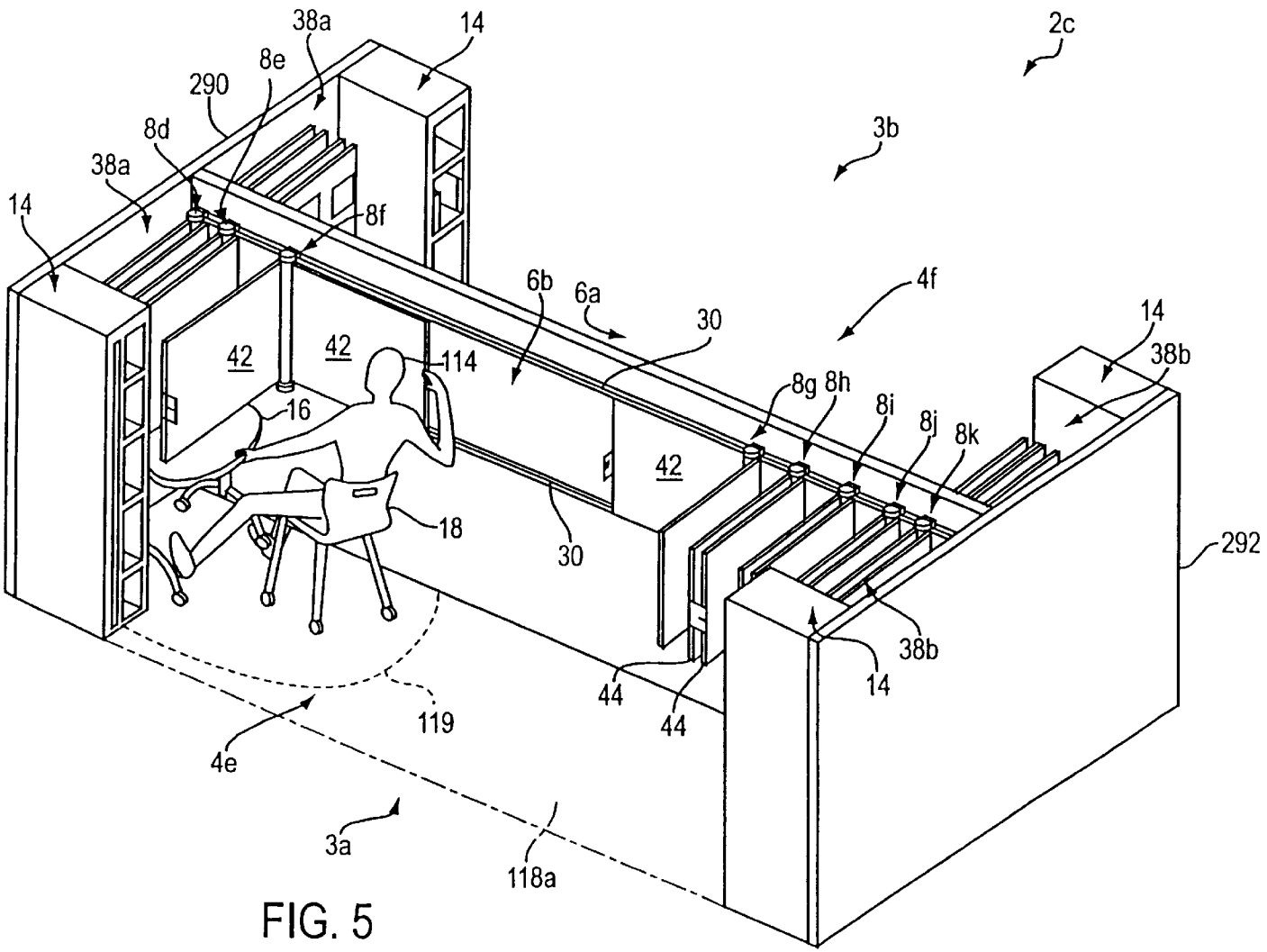
FIG. 5 is a perspective view of a work environment according to an exemplary embodiment of the present invention providing a workstation configured for use by an individual worker.
Figure 6:
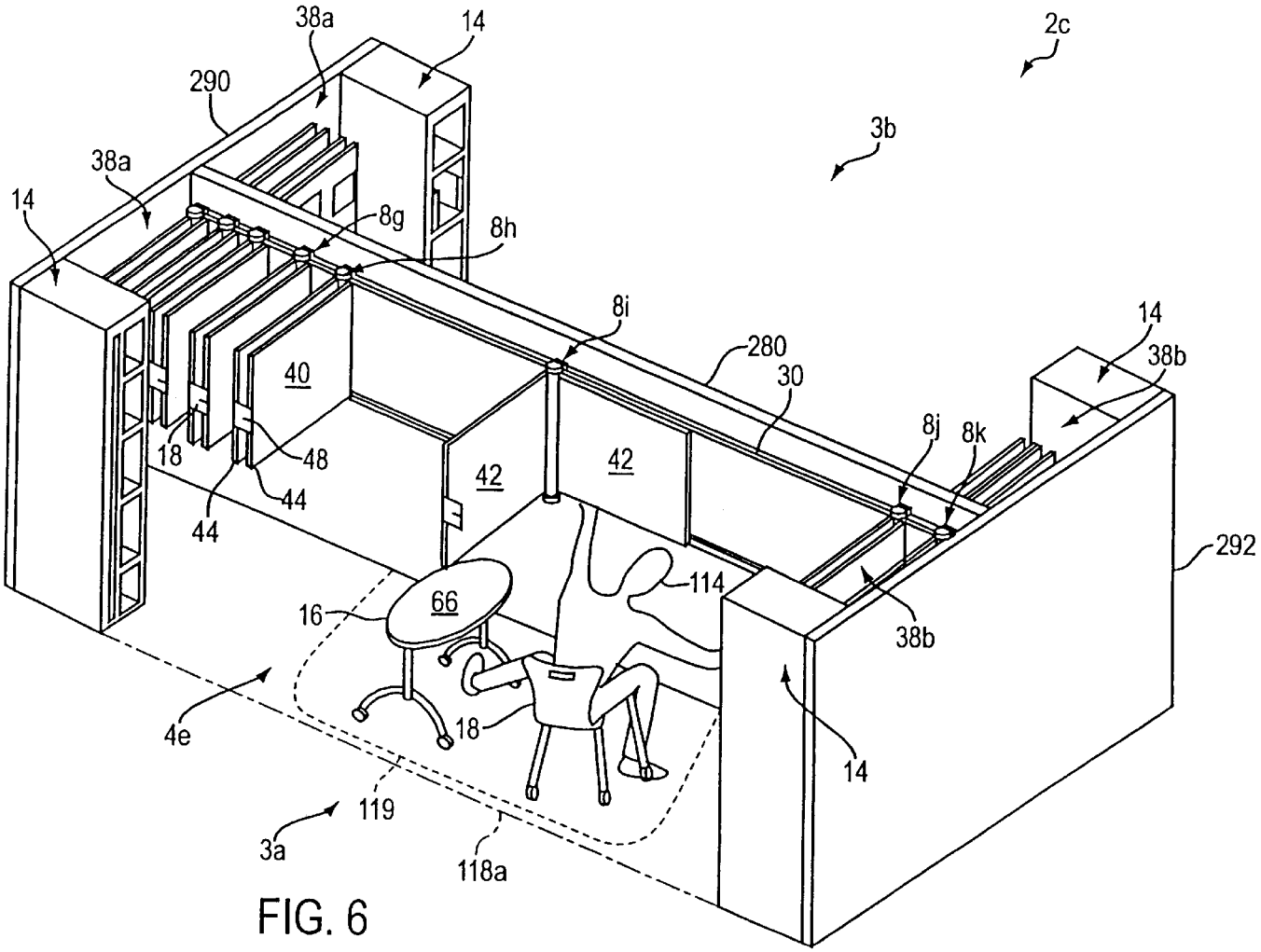
FIG. 6 is a perspective view of the work environment of FIG. 5 wherein the workstation has been configured for use by the individual worker.

Referring to FIG. 5, work space 3*a* is configured to provide a work area with a single workstation 4*e* in use by a single worker 114, seated on chair 18 at table 16 near docking area 38*a*. Worker 114 has opened containers 8*f* and 8*g* while other containers are closed; two containers are stowed in each docking area 38*a* and 38*b*. Worker 114 has available use of a floor space section 118*a* (shown in phantom lines) corresponding to the entire amount of fixed floor space provided in work space 3*a*; however a working portion 119 (shown in phantom lines) of the work space in actual use by worker 114 is a fraction of the floor space section 118*a*. As shown in FIG. 6, worker 114 has reconfigured workstation 4*e* but still has use of floor space section 118*a*. Worker 114 is working at open containers 8*i* and 8*j* and has moved with table 16 and chair 18 to the center of work space, closer to docking area 38*b*. Five containers 8*d*, 8*e*, 8*f*, 8*g*, and 8*h* are closed and have been moved near docking area 38*a* (with three containers "docked"); two containers 8*j* and 8*k* are closed and have been "docked" in docking area 38*b*. Working portion 119 of the work area in actual use by worker 114 is slightly larger than in FIG. 5 (and has been shifted to the opposite end of workstation 4*e*).

Figure 7A:
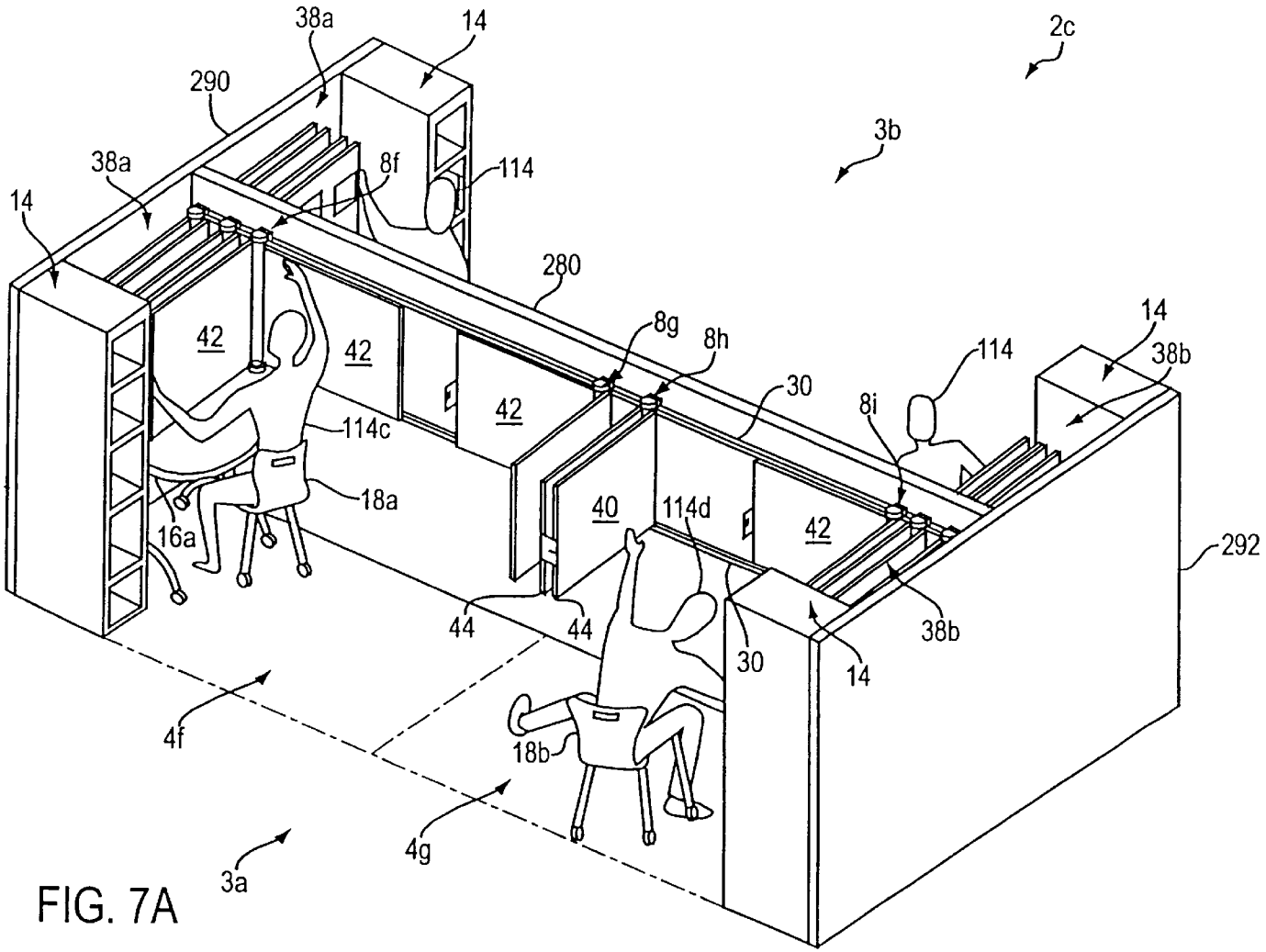
FIG. 7A is a perspective view of the work environment of FIG. 5 providing workstations configured for use by two workers working independently.
Figure 7B:
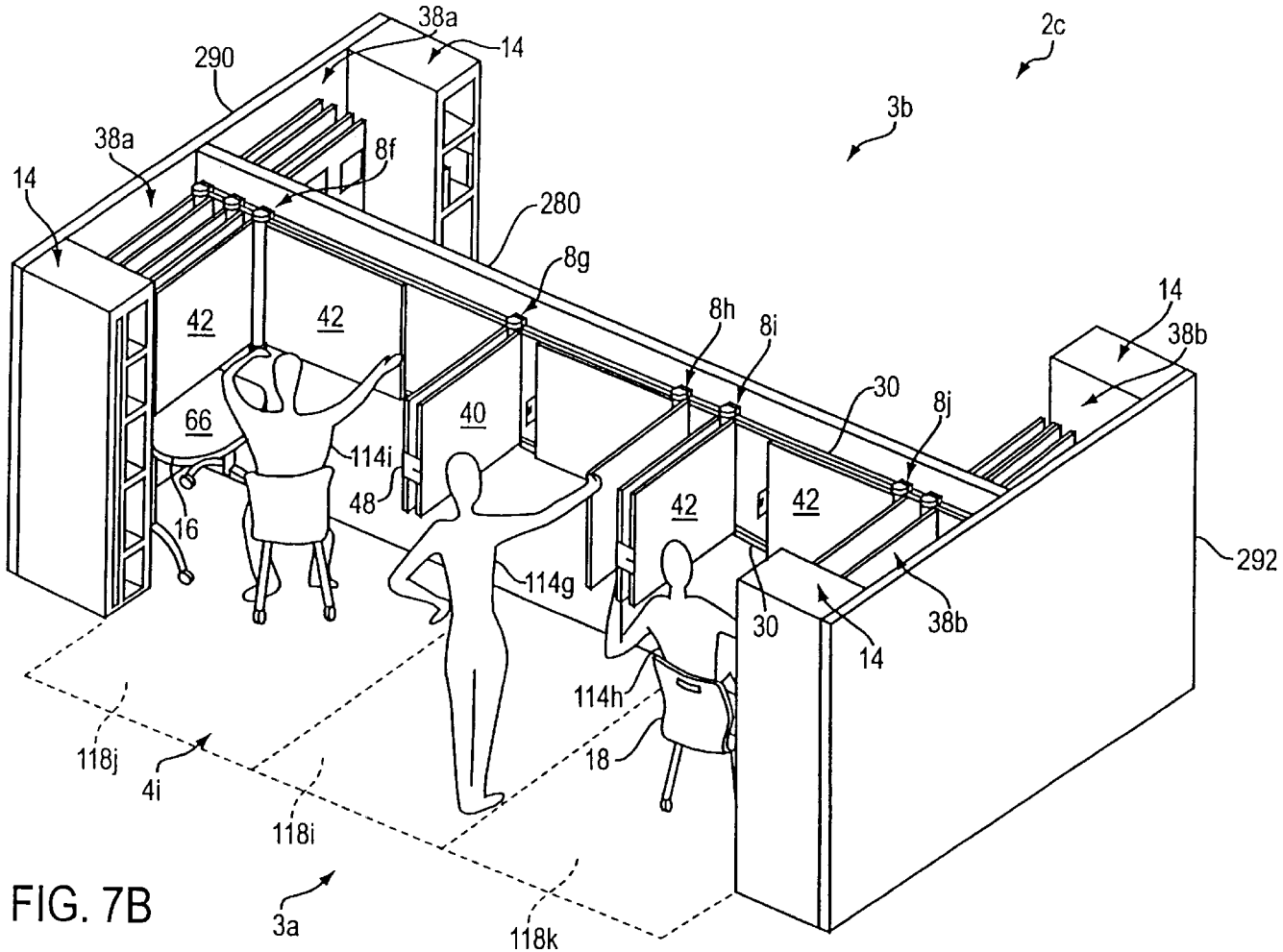
FIG. 7B is a perspective view of the work environment of FIG. 5 providing workstations configured for use by three workers working independently.

Referring to FIG. 7A, work space 3*a* is configured to provide two work areas and two workstations 4*f* and 4*g* for two workers 114*c* and 114*d* shown sharing the fixed floor space but working independently. Open container 8*g* and closed container 8*h* form a "boundary" between workstations 4*f* and 4*g*. Worker 114*c* seated in chair 18*a* at table 16*a* and working at open container 8*f* has use of one floor space section 118*b* (shown in phantom lines); worker 114*d* seated in chair 18*b* and in the process of moving container 8*h* has use of another floor space section 118*c* (shown in phantom lines). Each worker 114*c* and 114*d* has three containers within docking areas 38*a* and 38*b*, respectively. Referring to FIG. 7B, work space 3*a* is configured for independent use by three workers 114*g*, 114*h* and 114*i* in three work areas. Worker 114*g* (standing) occupies floor space section 118*i* (shown in phantom lines) at the center of work space 3*a* and is working at open container 8*h* and closed container 8*g*. Workers 114*h* and 114*i* are seated and are working at display boards near docking areas 38*b* and 38*a*, respectively, in floor space sections 118*k* and 118*j* (shown in phantom lines), respectively.

Figure 8:
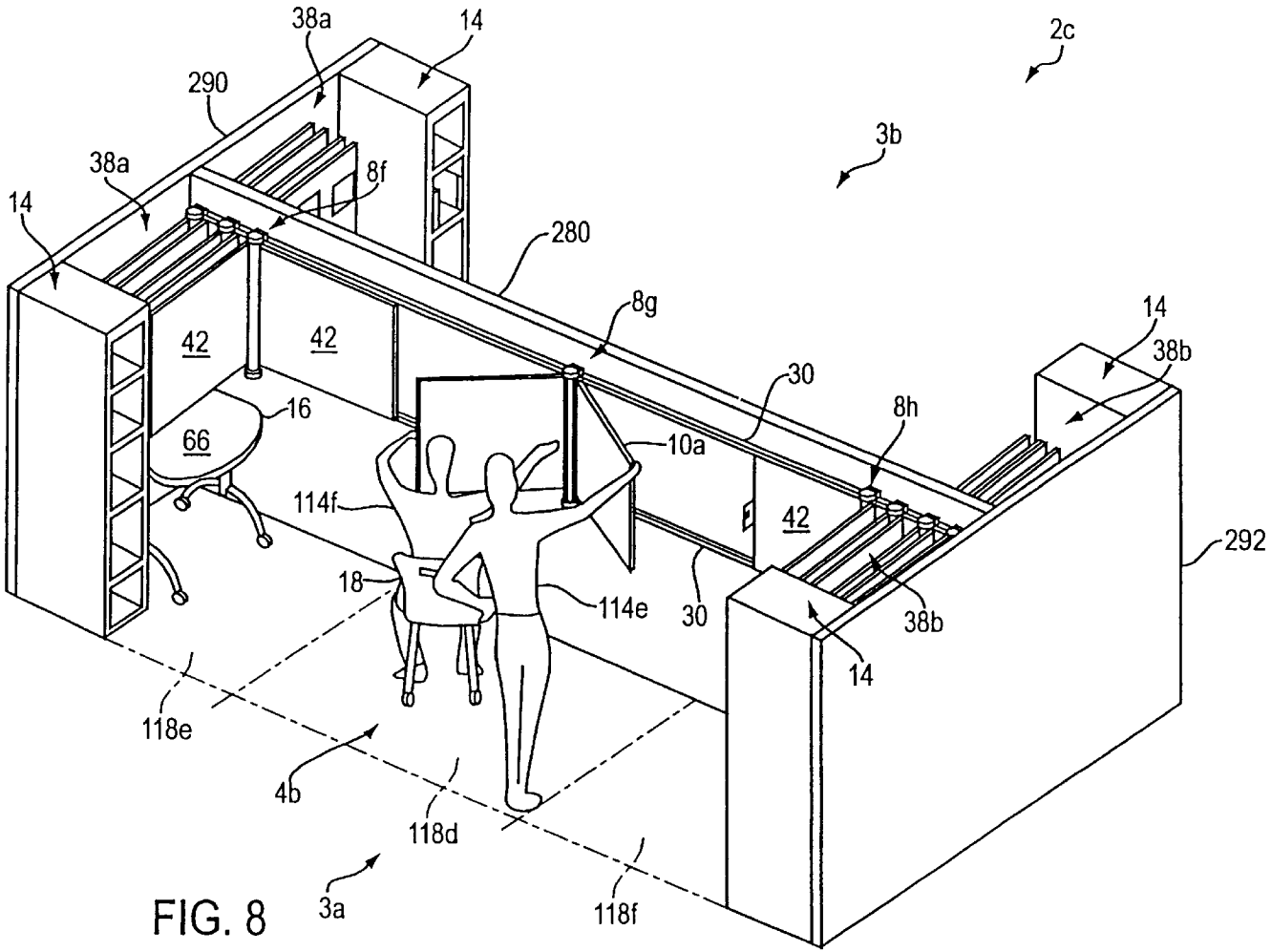
FIG. 8 is a perspective view of the work environment of FIG. 5 providing a work station that has been configured for use by a group of two workers working collaboratively.
Figure 9:
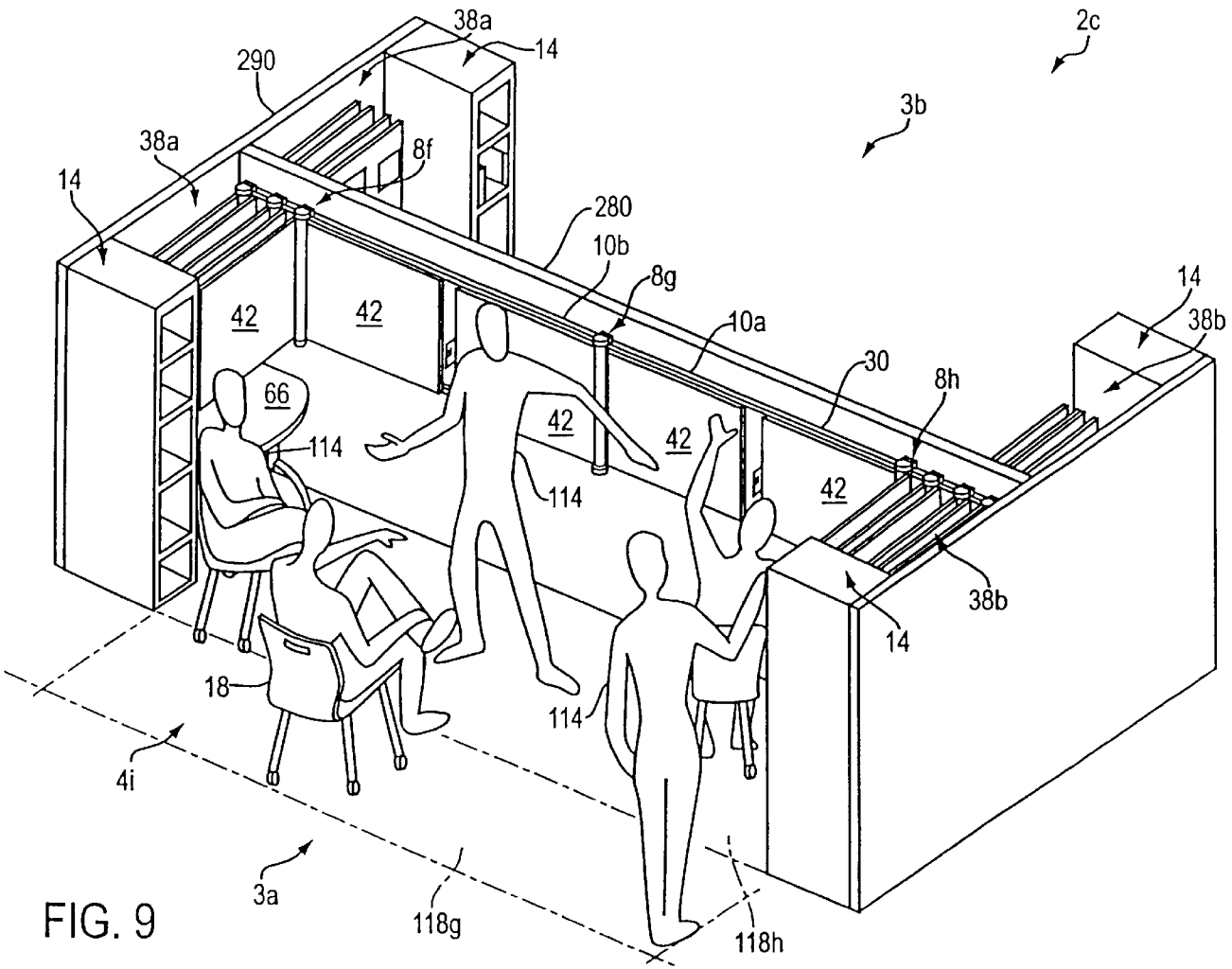
FIG. 9 is a perspective view of the work environment of FIG. 5 wherein the work station is configured for use by a group of five workers working collaboratively.

Referring to FIG. 8, work space 3*a* has been configured to provide a workstation 4*h* used by a small group of two workers 114*e* (standing) and 114*f* (seated) working collaboratively in a dyad at an open container 8*g* (partially opened at a 45 degree angle) and sharing information presented on display boards 10*a* and 10*b* (i.e. interior surfaces). Open container 8*g* defines a central floor space section 118*d* (shown in phantom lines). At either side of open container 8*g* are defined floor space sections 118*e* and 118*f* not in use by workers 114*e* and 114*f*, but within which are located other containers. Referring to FIG. 9, work space 3*a* is configured to provide a single workstation 4*i* in use by a large group of workers 114 (e.g. a project team conducting a meeting). As shown, a floor space section 118*g* (shown in phantom lines) used by a group of workers 114 has extended outside of the fixed floor space provided within work space 3*a*. Attention of workers 114 is directed to a fully open container 8*g* presenting information of shared interest on display boards 10*a* and 10*b* (i.e. interior surfaces) at the center of work space 3*a*; open containers 8*f* and 8*h* are also in use directly adjacent to fully open container 8*g*; remaining containers are stowed in docking areas 38*a* and 38*b*.

Figure 10:
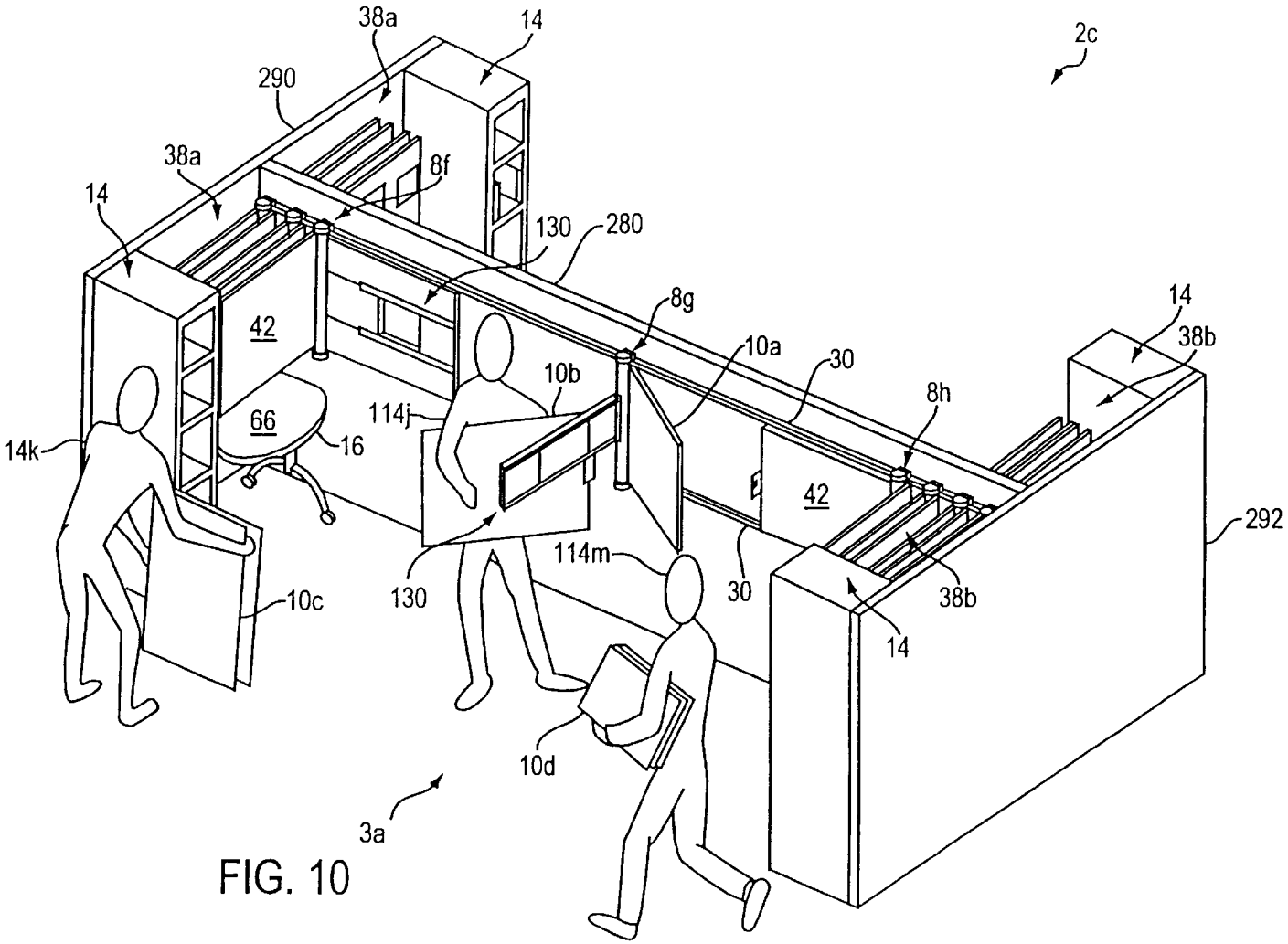
FIG. 10 is a perspective view of the work environment of FIG. 5 wherein the workstation is being reconfigured by the rearrangement of display boards.

Referring to FIG. 10, work space 3*a* is shown in a transition or reconfiguration state with a display board 10*b* being removed from container 8*g* by a worker 114*j*. Another worker 114*k* is removing display boards 10*c* for alternative use or storage. Another worker 114*m* is bringing replacement display boards 10*d* (of a smaller size) for installation on containers 8*g* and 8*f*. As shown in FIGS. 5 through 10 collectively, and according to any preferred embodiment, the information display system 6*a* allows for several "methods" of selective transformation of physical space and visual effect within a work space: division of physical space and/or alteration of visual effect by movement of containers (e.g. in association with other containers and/or articles of furniture); division of physical space and/or alteration of visual effect by opening or closing containers to reveal and conceal information; alteration of visual effect by removal and replacement, for example interchange, of display boards associated with a container; and alteration of visual effect by revising the content of information (e.g. rewriting, erasing, posting) on display boards associated with a container.

Figure 11A:
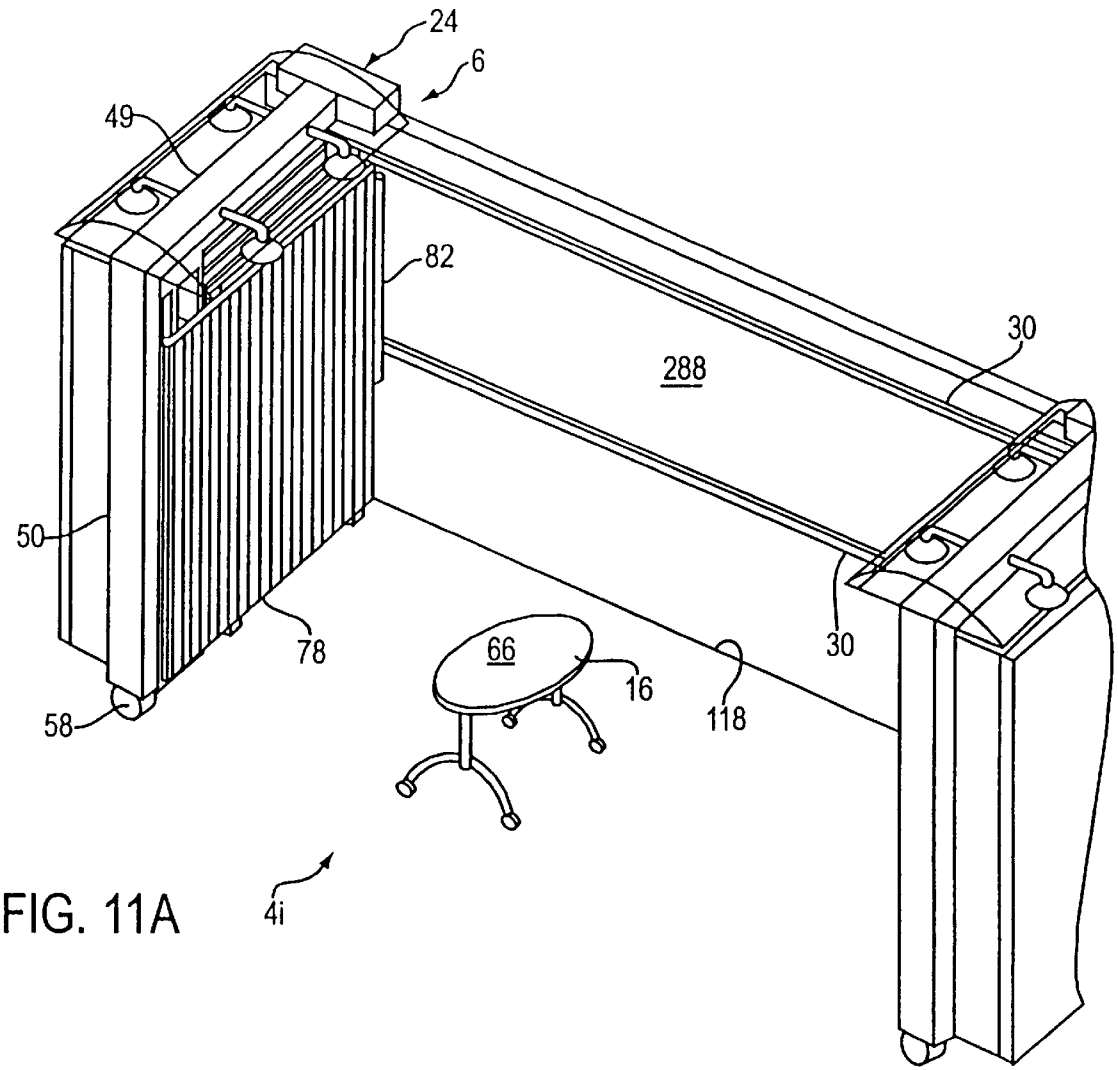
FIG. 11A is a fragmentary perspective view of a workstation according to an exemplary embodiment in a secure condition.
Figure 11B:
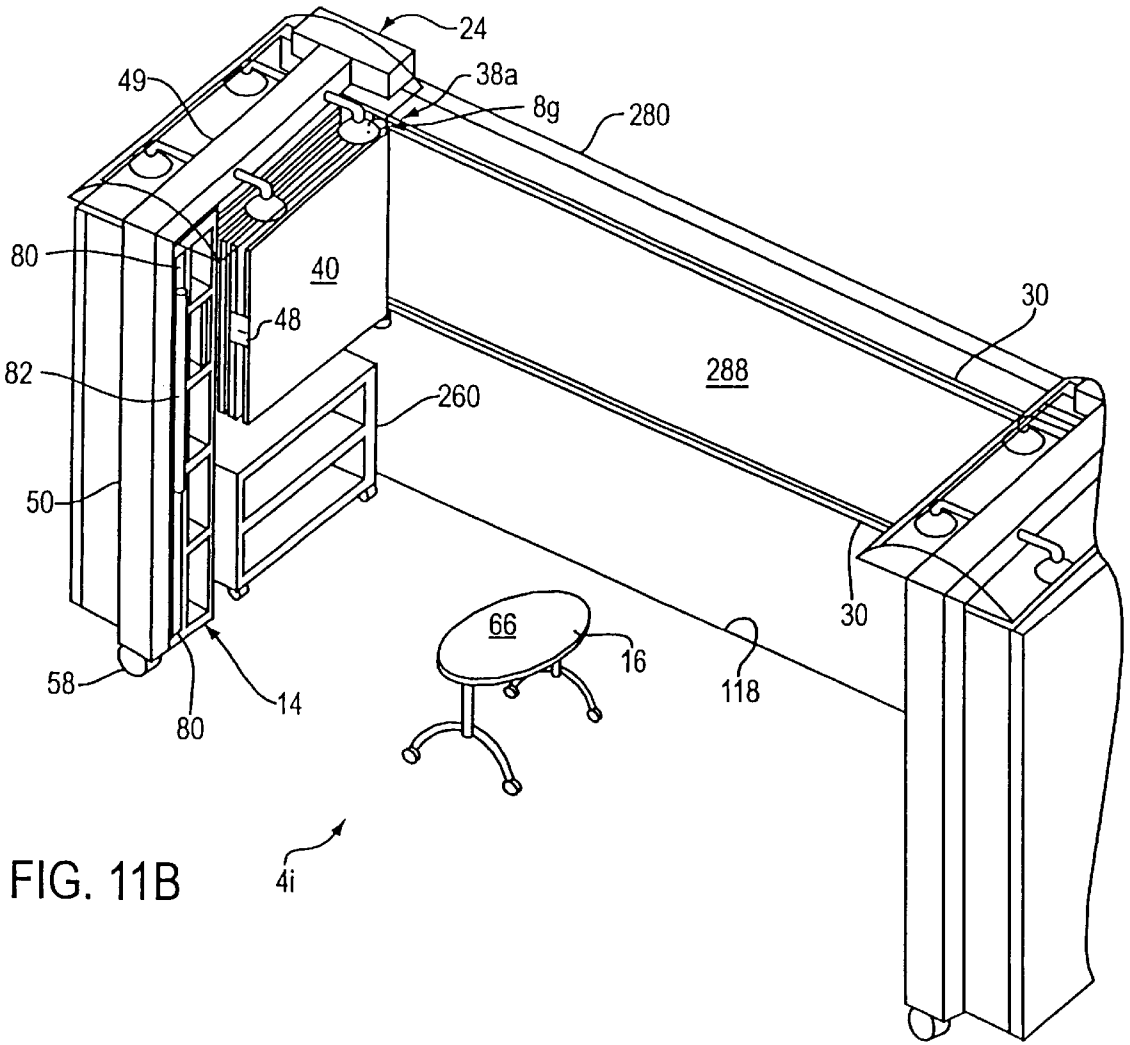
FIG. 11B is a fragmentary perspective view of the workstation of FIG. 11A in an open condition.
Figure 11C:
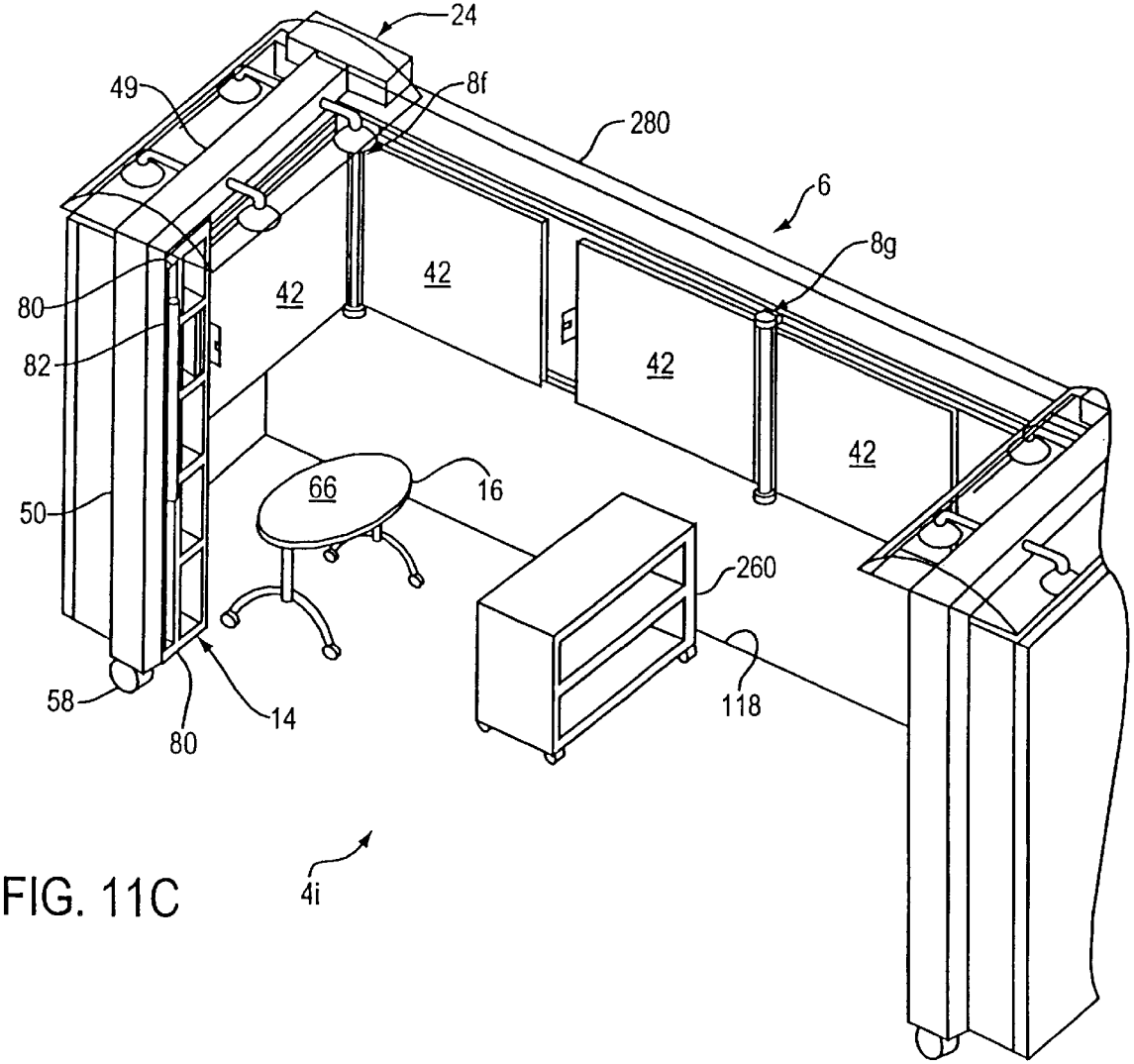
FIG. 11C is a fragmentary perspective view of the work station of FIG. 11A in an open condition.
Figure 11D:
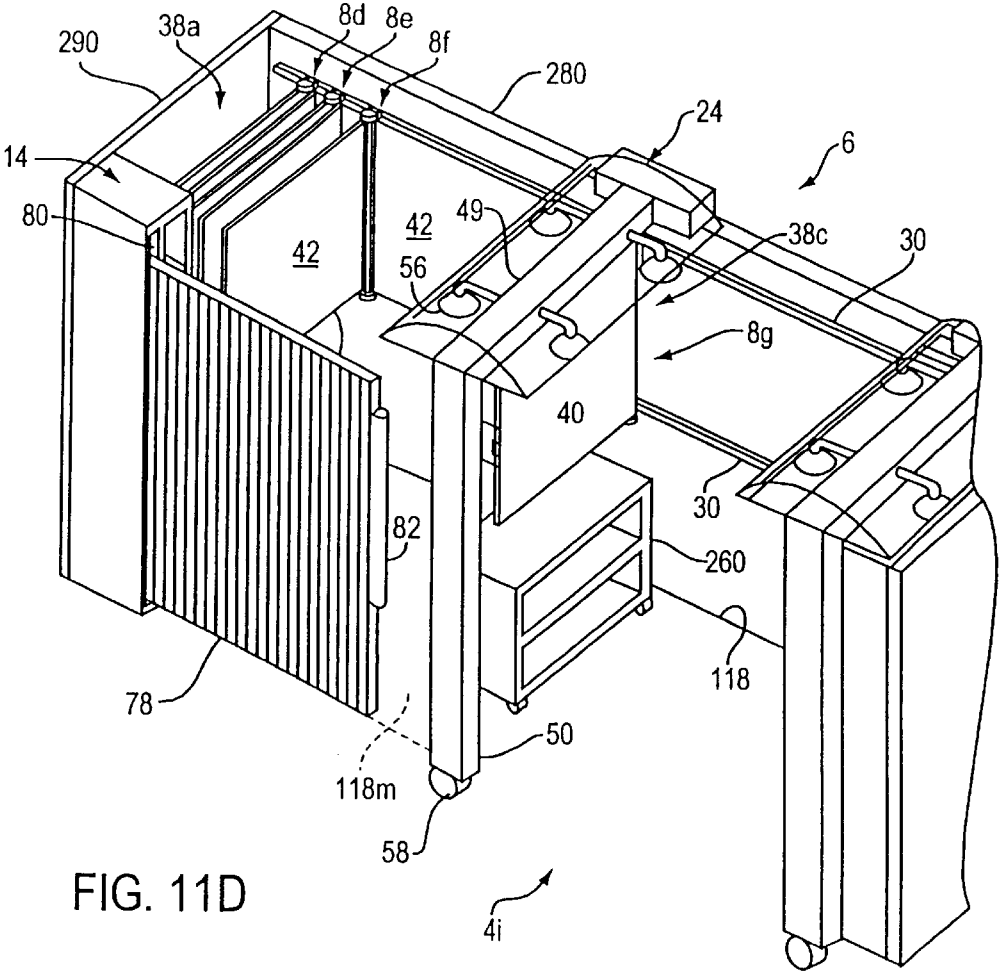
FIG. 11D is a fragmentary perspective view of the workstation of FIG. 11A in a substantially private condition.

FIGS. 11A through 11D show in a work environment workstation 4*i* of a type similar to that shown in FIGS. 5 and 6 configured for a single worker (not shown) according to an exemplary embodiment of the present invention. Workstation 4*i* includes base panel wall 280, shelving unit 14 providing docking area 38*a* for containers 8*d*, 8*e*, 8*f*, 8*g*, 8*h*, 8*i*, 8*j*, and 8*k* of information display system 6, and mobile table 16. Workstation 4*i* also includes utility threshold 24 coupled to the top of panel wall 280 on track 30 for sliding movement. As shown in FIGS. 11A and 11D, workstation 4*i* also includes a retractable partition shown as a privacy screen 78 (e.g. of a type similar to a tambour door according to the exemplary embodiment, but of any type of screen material according to various alternative embodiments). Privacy screen 78 is installed within a vertical recess 80 in shelving unit 14 and can selectively be withdrawn from recess 80 (as shown in FIGS. 11A and 11D) or retracted into recess 80 (as shown in FIGS. 11B and 11C) by a handle 82 (which may include a locking element such as a hook or clasp to retain privacy screen 78 in engagement with a coacting locking element associated with the panel wall or utility threshold or other structure). As shown in FIG. 11A, with containers 8*d*, 8*e*, 8*f*, 8*g*, 8*h*, 8*i*, 8*j*, and 8*k* stowed in docking area 38*a* and utility threshold 24 stowed over docking area 38*a*, privacy screen 78 can be withdrawn (e.g. drawn across the entry to docking area) to conceal and secure the containers and any articles of furniture within docking area 38*a*. Workstation 4*i* is therefore in a secured condition (for example, secured compactly within a 3 feet by 7 feet dimensional footprint). In FIG. 11B, privacy screen 78 (not visible) has been retracted into vertical recess 80 so that the contents of docking area 38*a*, containers 8*d*, 8*e*, 8*f*, 8*g*, 8*h*, 8*i*, 8*j*, and 8*k* and a mobile storage unit 260, are visible. In FIG. 11C, workstation is "open" with fully open container 8*k* and open container 8*j* visible and mobile table 16 and mobile storage unit 260 also visible and available for use. In FIG. 11D, utility threshold 24 is deployed (moved along its track) to provide a docking area 38*c* for a closed container 8*g* above mobile storage unit 260. Privacy screen 78 is withdrawn toward vertical post 50 of utility threshold 24 to define a floor space section 118*m* (shown in phantom lines) within which a worker (not shown) can have at least a limited amount of privacy. According to any preferred embodiment, as shown, the retractable partition can be of any material or construction and is configured to provide for security (e.g. in an unoccupied or closed workstation) and privacy (in an occupied workstation).

FIGS. 12 through 15B show a work environment 2*d* in the form of a work space shown as project team space 3*c* configurable to support workers engaged in both individual and group activities by providing work areas suited for the activities. Work environment 2*d* includes a set of base panel walls 280 each including information display system 6. Each information display system 6 includes a plurality of containers 8*d*, 8*e*, 8*f*, 8*g*, 8*h*, 8*i*, 8*j*, and 8*k* and 8*m*, 8*n*, 8*p*. 8*q*, 8*r*, 8*s*, 8*t*, and 8*u* (adapted for movement along rails 30) and two pairs of utility thresholds 24*a* and 24*b* and 24*c* and 24*d* (adapted for movement along rails 31). Work environment 2*d* includes shelving units 14, as well a panel wall section 88 ("L"-shaped "panel wrap") and a panel wall section 90 ("T"-shaped "panel wrap"), each configured to provide docking areas 38*a* and 38*b* for the containers and the utility thresholds. Also included in work environment 2*d* are mobile tables 16, mobile storage units 260, and mobile file carts 20.

Figure 12:
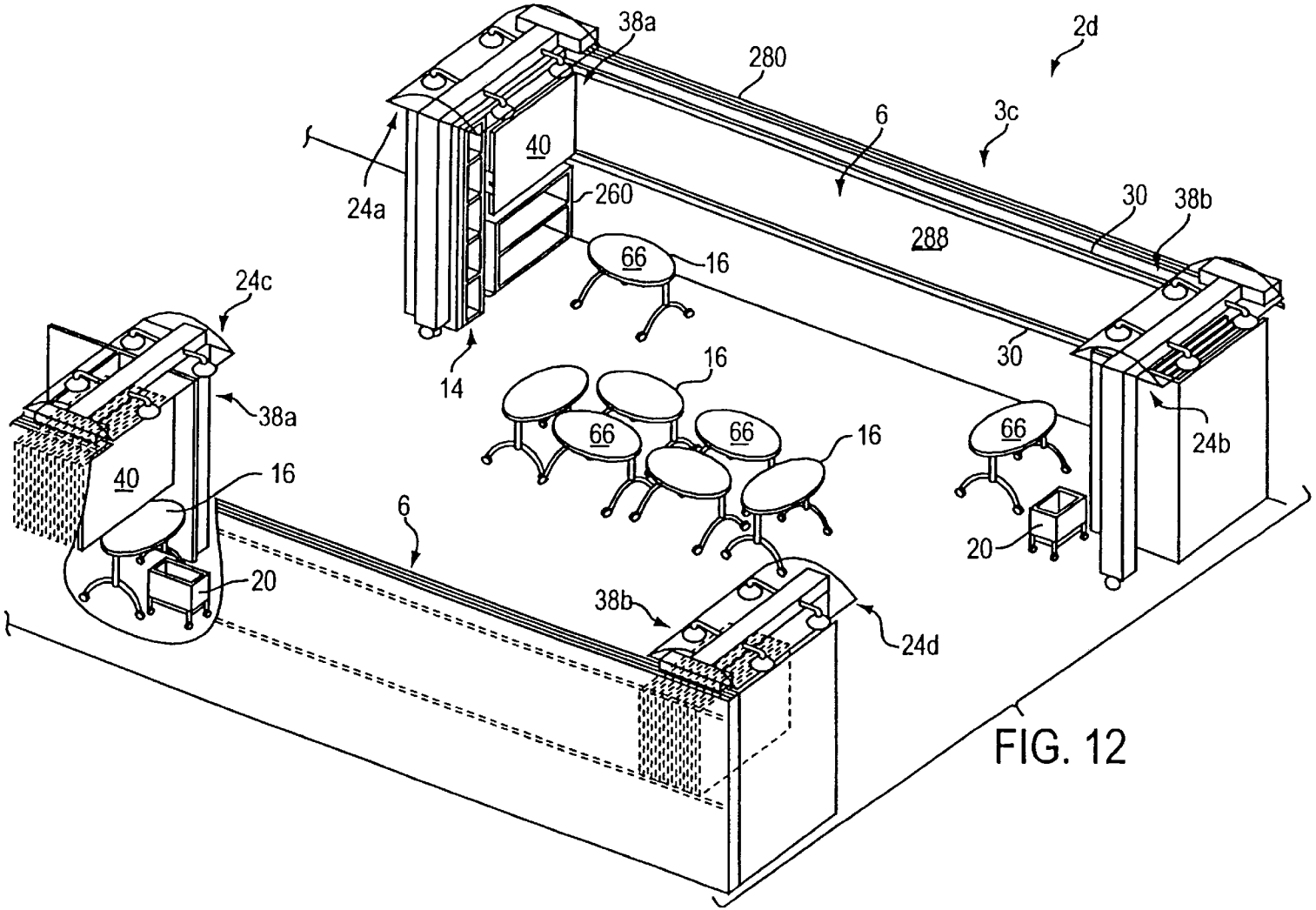
FIG. 12 is a perspective view of a work environment in a stowed and inactive condition.
Figure 13:
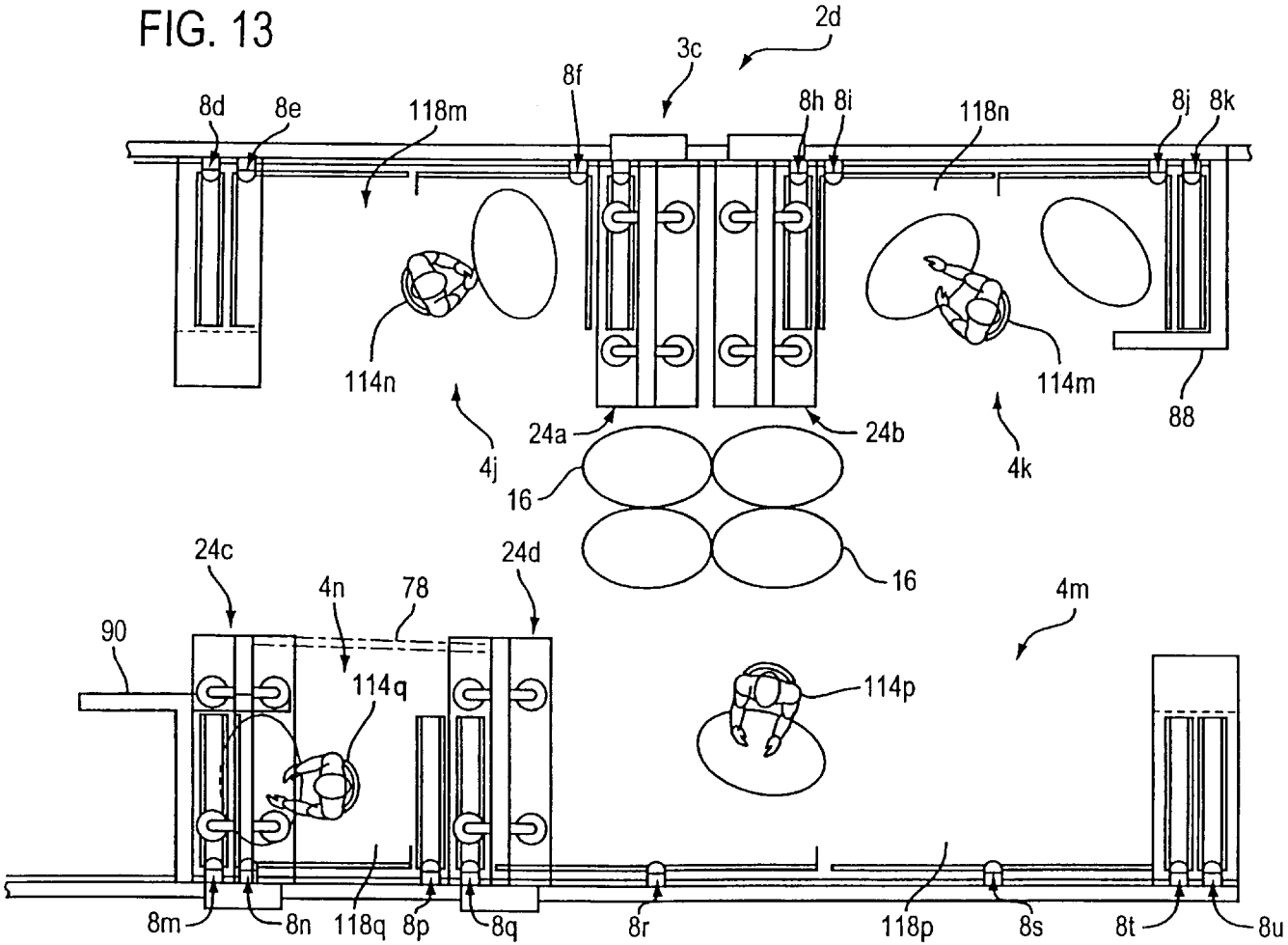
FIG. 13 is a top plan view of the work environment of FIG. 12 in a first active condition.
Figure 14:
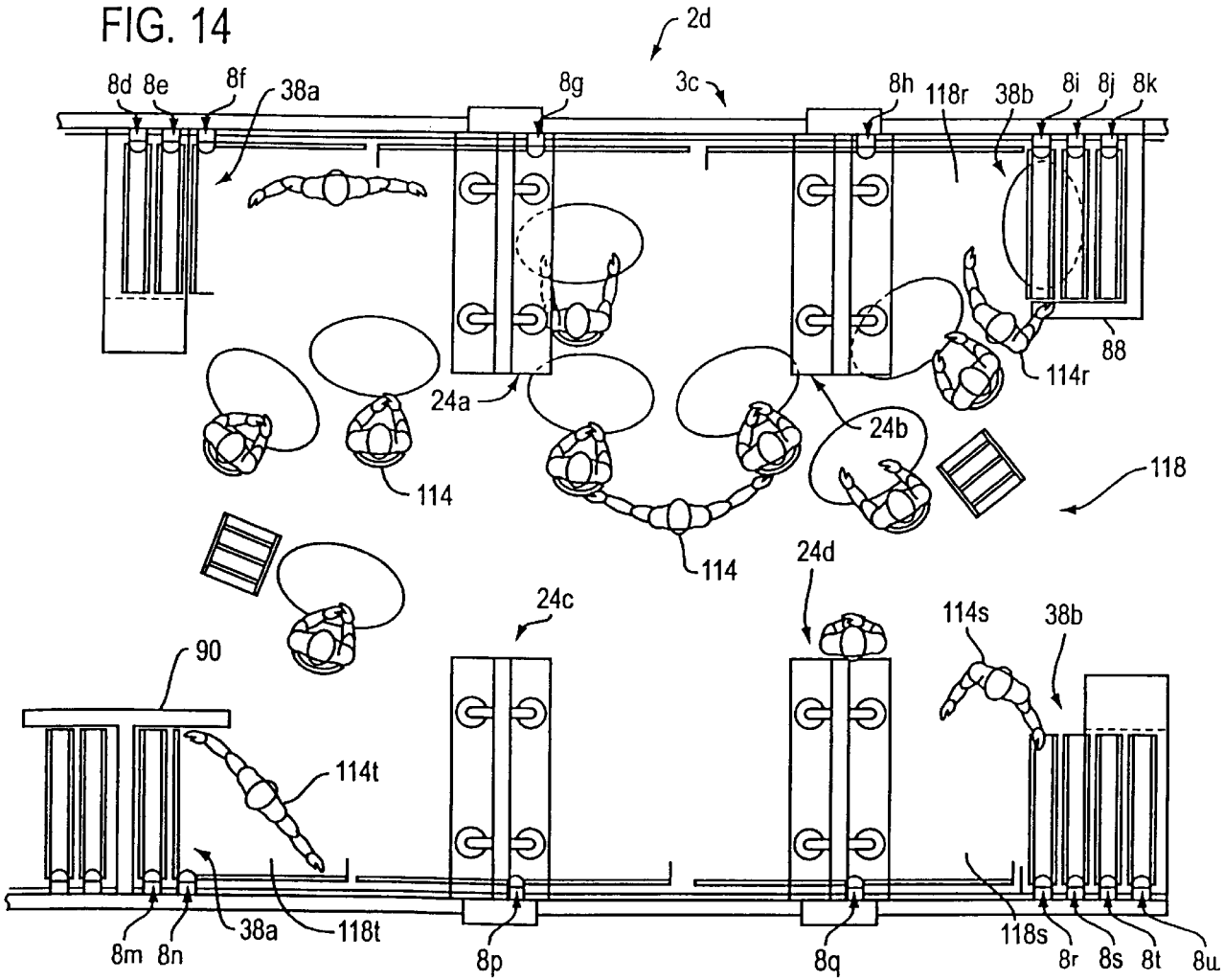
FIG. 14 is a top plan view of the work environment of FIG. 12 in a second active condition.

In FIG. 12, work environment 2*d* is shown in an inactive condition, for example, as may typically be the case late in the evening or very early in the morning, when no workers are present. All of the containers and each of the utility thresholds are secured and stowed in their respective docking areas. In FIGS. 13 through 15B, work environment 2*d* is shown in various exemplary active conditions. In FIG. 13, four workers 114*n*, 114*m*, 114*p* and 114*q* have arrived in work environment 2*d* and are at work independently, for example, as may typically be the case in the morning in preparation for a large meeting. Work space 3*c* has been divided into floor space sections 118*m*, 118*n*, 118*p* and 118*q* for independent use by each worker 114*n*, 114*m*, 114*p* and 114*q*, respectively. Worker 114*n* is at work in what has been configured as an open and relatively large workstation 4*j*; workers 114*m* and 114*p* are at work in what have been configured as open and intermediately sized workstations 4*k* and 4*m*, respectively; worker 114*q* is at work in a relatively small, but private workstation 4*n* (using privacy screen 78 (shown in phantom lines)). Each worker has deployed containers and utility thresholds for purposes of using information and establishing the division of fixed floor space within work environment 2*d*. In FIG. 14, a large group of workers 114 has arrived in work environment 2*d*, for example, as may typically be the case during a project team (e.g. large group) meeting. Containers 8*f* through 8*h* and 8*n* through 8*q* are deployed and opened to provide for maximum exposure of information presented on associated display boards (e.g. in the sense of a "theatre display"). A large team meeting space occupying a large central floor space section 118 has been created by the arrangement of the containers and utility thresholds, and most workers are present in the team meeting space. Three workers 114*r*, 114*s*, and 114*t* are each working independently in three separate floor space sections 118*r*, 118*s*, and 118*t*, respectively, near docking stations 38*a* and 38*b* (for example, as may be the case if retrieving or preparing a display board for later presentation in the team meeting space).

Figure 15A:
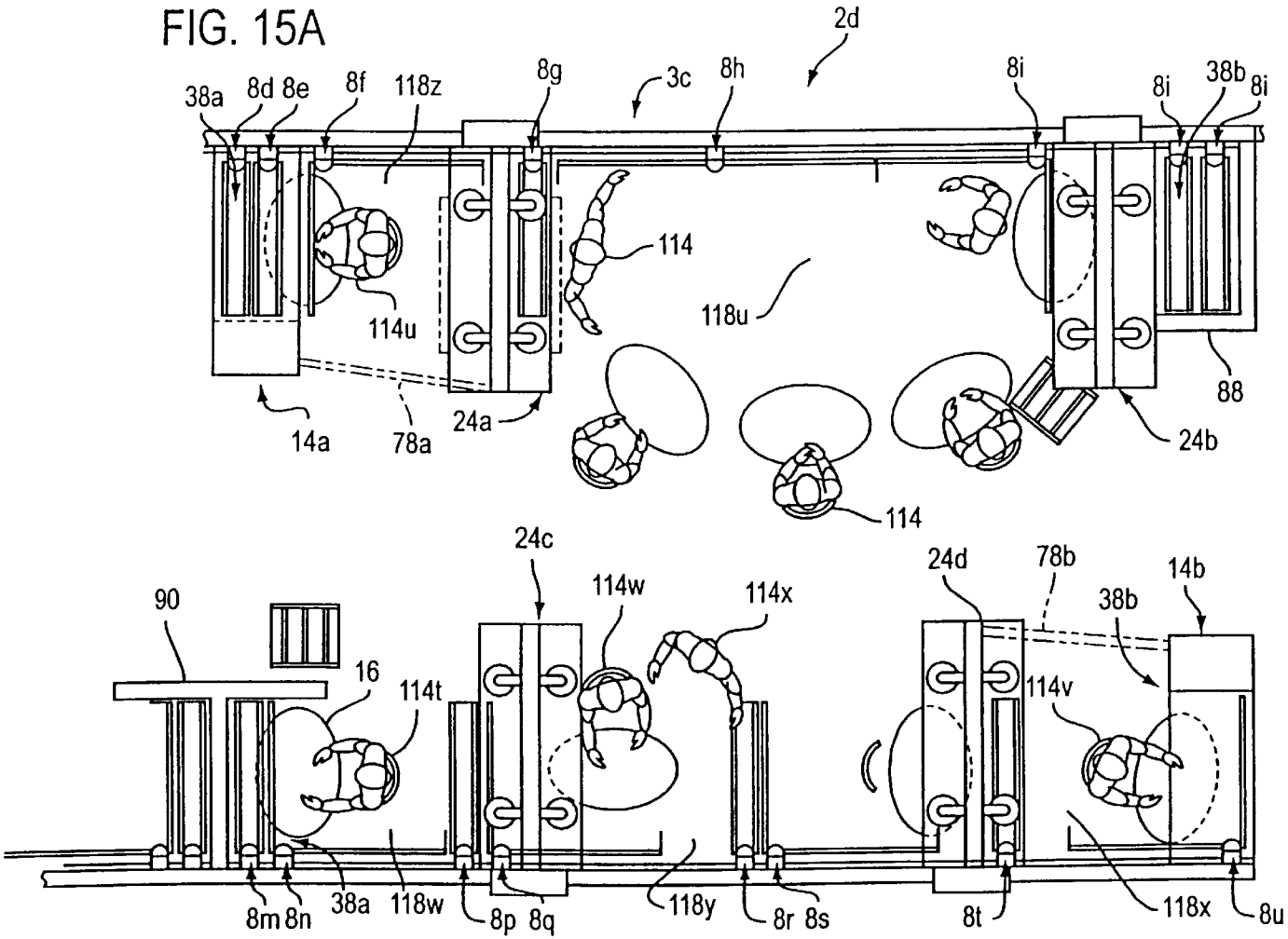
FIG. 15A is a top plan view of the work environment of FIG. 12 in a third active condition.
Figure 15B:
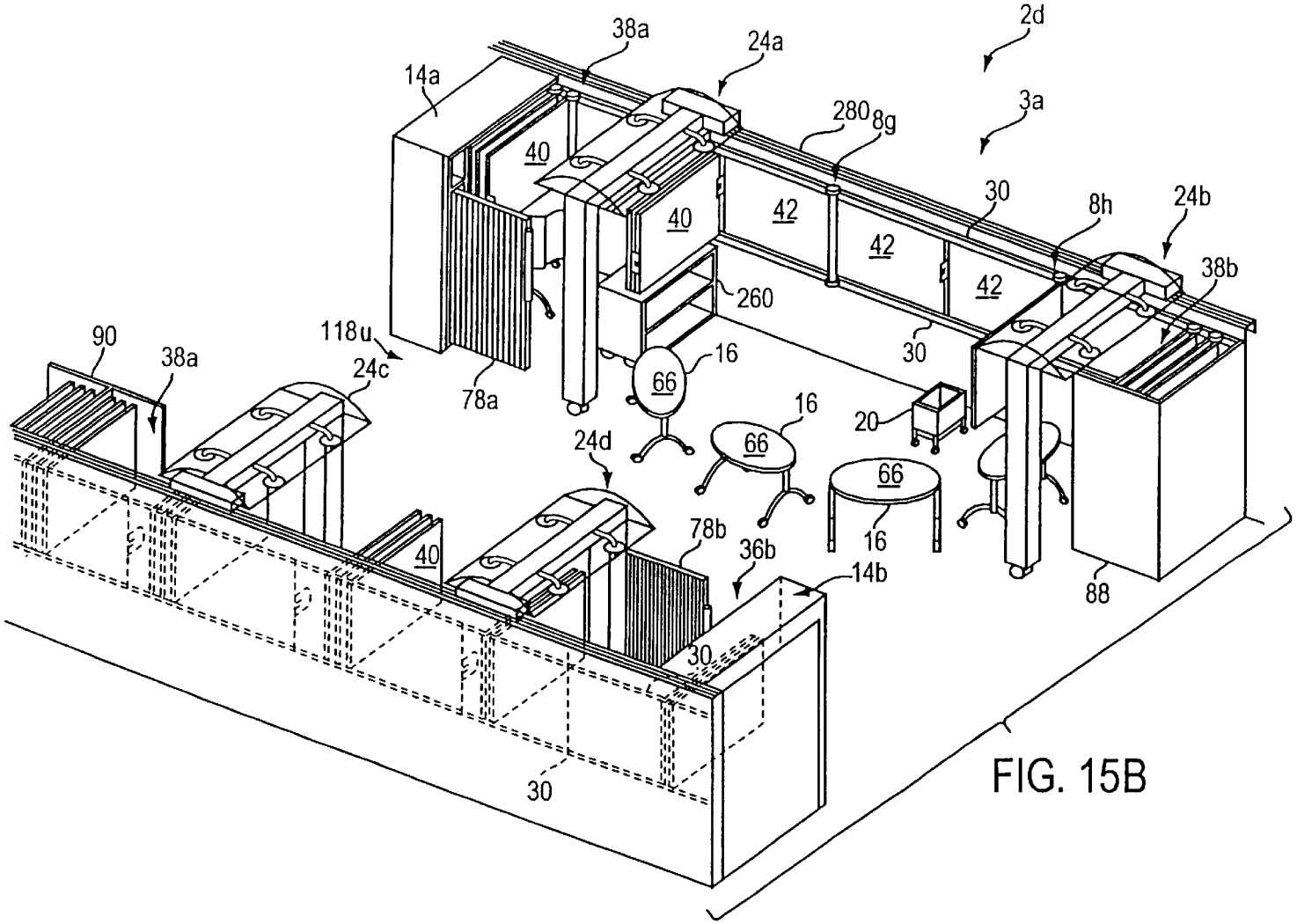
FIG. 15B is a perspective view of the work environment of FIG. 15A (without workers).

In FIG. 15A, a smaller group of workers are present in work environment 2*d*, for example, as may typically be the case for a group conference following a project team meeting. A group conference space occupying a large floor space section 118*u* (see also FIG. 15B) has been provided by (in comparison with FIG. 14) moving utility thresholds 24*a* and 24*b* laterally and by deployment of containers 8*h* and 8*i* to provide for maximum exposure of information presented on associated display boards (e.g. in the sense of a "theatre display"). Two workers 114*u* and 114*v* are shown working independently and privately in separate floor space sections 118*z* and 118*x* defined by utility thresholds 24*a* and 24*d*, shelving units 14*a* and 14*b* (functioning as docking areas 38*a* and 38*b*), and closed containers 8*g* and 8*t*, respectively. Floor space sections 118*z* and 118*x* are made private through the use of a privacy screen 78*a* and 78*b* (shown in phantom lines in FIG. 15A), respectively. A floor space section 118*w* is in use by an individual worker 114*t* seated at mobile table 16 within docking area 38*a*. A floor space section 118*y* is in shared use by two workers 114*w* and 114*x* working collaboratively. As shown in FIGS. 12 through 15B, according to any preferred embodiment, the work environment is readily configured and reconfigured to provide work spaces and workstations for individual workers, small groups and large groups of workers involved in a wide variety of types of project work.

Figure 16A:
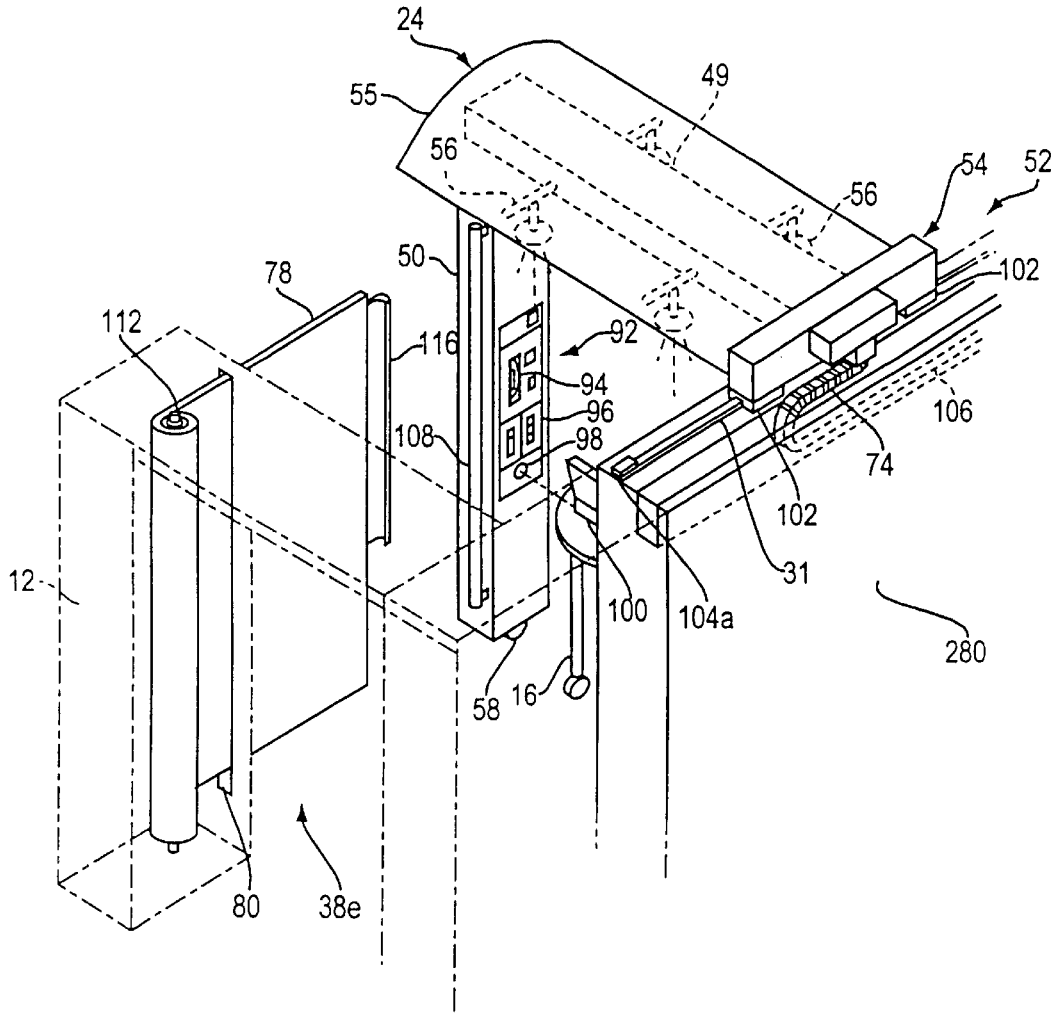
FIG. 16A is a perspective view of a workstation including a utility threshold and docking area according to a preferred embodiment.
Figure 16B:
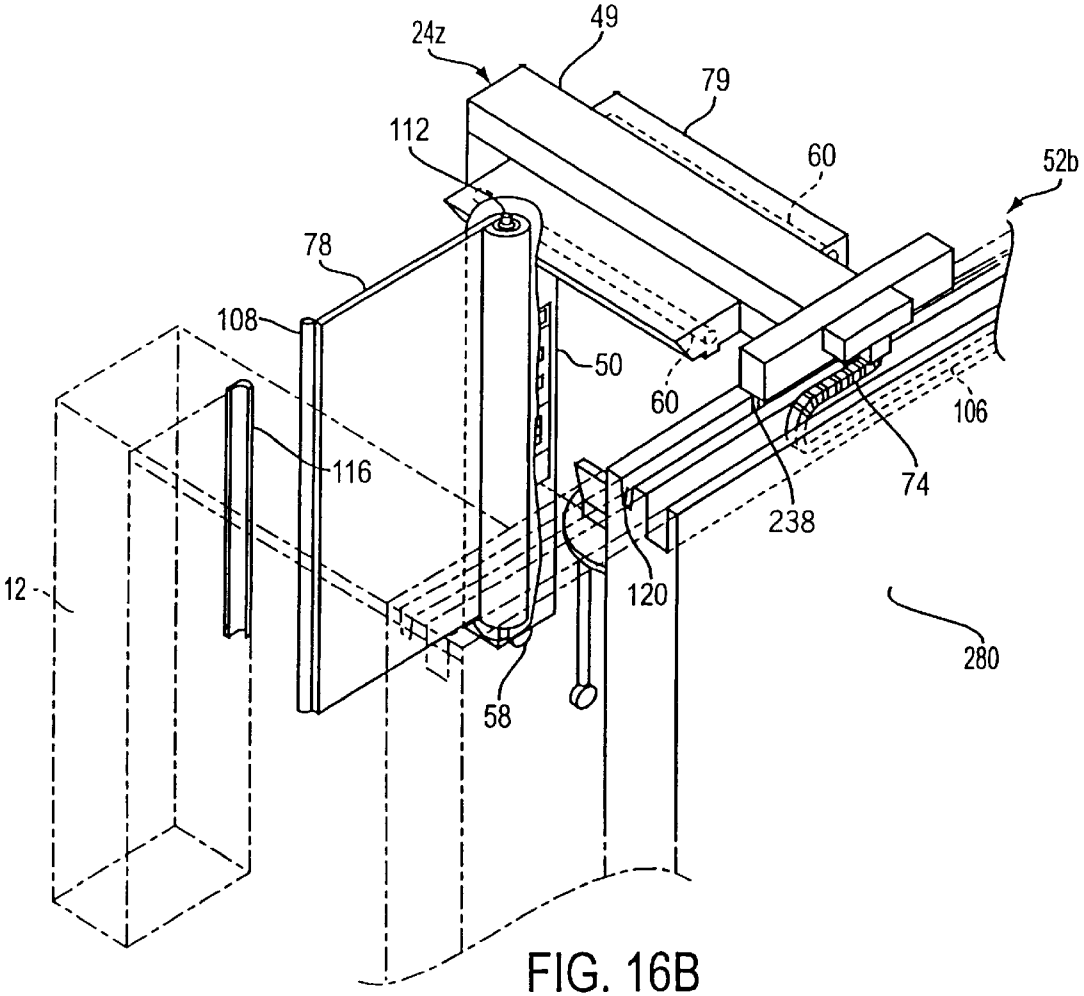
FIG. 16B is a perspective view of a workstation including a utility threshold and docking area according to an alternative embodiment.

Referring to FIGS. 16A and 16B, exemplary embodiments of utility thresholds 24 and 24*z*, respectively, associated with panel wall 280 are shown. In FIG. 16A, utility threshold 24 has horizontal beam 49 and vertical post 50. Beam 49 includes lighting fixtures 56 and canopy 55; post 50 includes a utility delivery zone 92 shown as including a telephone 94 and outlets 96 for delivery of voice, power and data signals (e.g. outlets or connections of any conventional type). Utility delivery zone 92 also includes an infrared port 98 shown in communication with a portable computer 100 resting on mobile table 16. Utility threshold 24 includes mounting assembly 52 including glide blocks 102 that interface with rail 31 on top of panel wall 280. (Rail 31 also includes a "stop" shown as block 104*a* to keep utility threshold 24 from sliding off of rail 31.) A utility infeed shown as flexible conduit 74 is also provided in mounting assembly 52 for communication with utility delivery zone 92 of post 50. Flexible conduit 74 travels along the top of panel wall 280 in a trough or recess 106 (shown in phantom lines) as utility threshold 24 translates (i.e. slides along rail 31). Flexible conduit 74 is coupled to and contains voice, power, data cabling (shown schematically) through panel wall 280. (According to a particularly preferred embodiment, the flexible conduit is of a type available under the name CONDUFLEX available from KabelSchepp Cable Carrier Systems.) Post 50 of utility threshold 24 also includes caster 58 at its base and a handle 108 along its side wall.

Also shown in FIG. 16A is a docking area 38*e* in the form of a cabinet 12 (shown in phantom lines) containing a retractable partition shown as roll-up privacy screen 78 (that can be retracted under spring tension). Privacy screen 78 is provided on roller 112 and is of a rigidified fabric material and extends through vertical recess 80 in cabinet 12; privacy screen 78 includes a clasp 116 that engages handle 108 of utility threshold 24 to hold privacy screen 78 in a withdrawn position so as to define a private space within the associated workstation. When clasp 116 is disengaged from handle 108, spring tension will retract privacy screen 78 through vertical recess 80 and onto the roller 112 within cabinet 12.

Mounting assembly 52*b* of utility threshold 242 includes a set of wheels 238 that travel within a track shown as a groove 120 in the top of panel wall 280 to allow translating (i.e. rolling) motion of utility threshold 24*z* with respect to panel wall 280. In utility threshold 24*z*, a retractable partition shown as privacy screen 78 is supplied on roller 112 within post 50 of utility threshold 24*z*; clasp 116 on cabinet 12 (shown in phantom lines) engages handle 108 of utility threshold 24*z* to hold privacy screen 78 in a withdrawn position (i.e. against spring tension) so as to define a space within the associated workstation. As also shown according to the alternative embodiment of FIG. 16B, beam 49 of utility threshold 242 includes two fluorescent lighting fixtures 60 under a canopy 79.

According to a particularly preferred embodiment, the frame members of the utility threshold (e.g. horizontal beam and vertical post) have a construction similar to the space frame systems disclosed in U.S. Pat. No. 5,511,348 titled "FURNITURE SYSTEM", incorporated by reference herein, and in U.S. Pat. No. 5,899,025 titled "FURNITURE SYSTEM", incorporated by reference herein, and employed in the CONJUNCTION™ Space Frame available from Steelcase Inc. of Grand Rapids, Mich. According to alternative embodiments, the utility threshold and its associated elements (e.g. frame members, mounting assembly, utility delivery zone, lighting fixtures, canopy, privacy screen, etc.) may have any of a wide variety of constructions.

Figure 17:
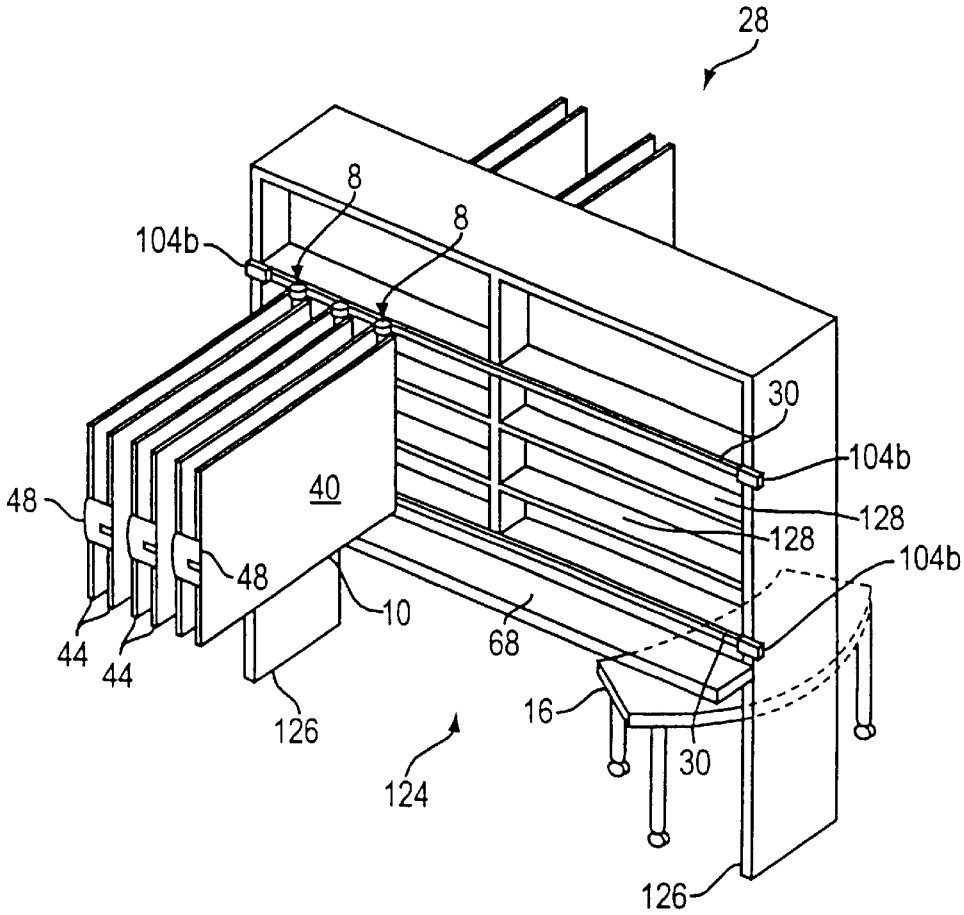
FIG. 17 is a perspective view of an information display system according to an alternative embodiment.

According to alternative embodiments, the mounting structure for the information display system may be any of a wide variety of structures. For example, referring to FIG. 17, a mounting structure shown as shelving unit 28 is provided for information display system 6. Containers 8 of information display system 6 are coupled to a set of rails 30 mounted on shelving unit 28 (on the front and back) by mounting assembly 32 (e.g. of a type shown in FIG. 1). Stops shown as blocks 104*b* are provided at the ends of each rail 30 to stop the travel of containers 8 (i.e. to prevent derailment of containers). Shelving unit 28 also includes an opening 124 in its base between legs 126 configured to allow the pass-through of mobile table 16 (or other like mobile article of furniture) at a level below containers 8. Shelving unit 28 allows access to shelves 128 as well as the display (e.g. reveal and conceal) of information presented on display boards 10 of containers 8. Shelving unit 28 also provides a worksurface 68 (in the form of a shelf 128) just below the bottom of containers 8. According to other alternative embodiments, the mounting structure may be provided by a space frame system of vertical posts and horizontal beams to which the track system can be attached.

Figure 18A:
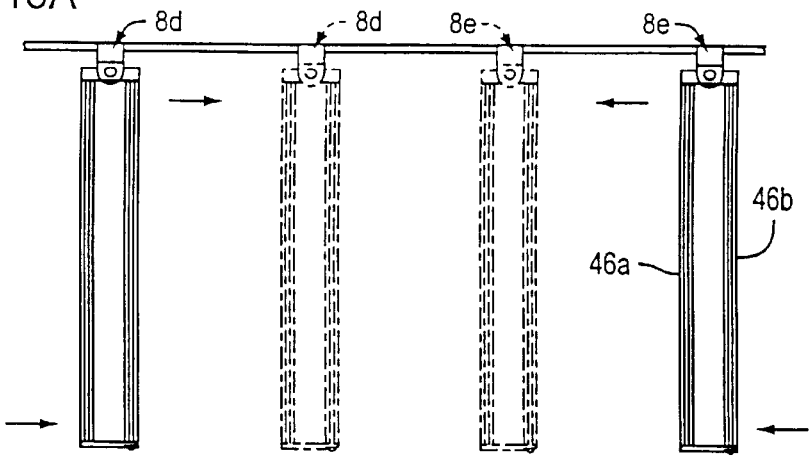
FIG. 18A is a schematic diagrams of containers associated with an information display system according to an exemplary embodiment indicating the stop action arrangements for the display boards associated with the containers.
Figure 18B:
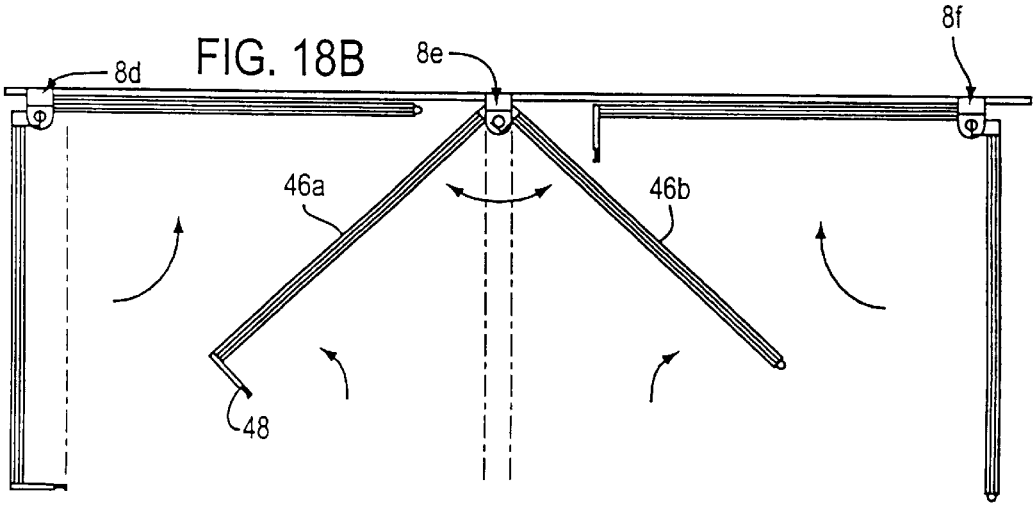
FIG. 18B is a schematic diagram of containers associated with an information display system according to an exemplary embodiment indicating the stop action arrangements for the display boards associated with the containers.
Figure 18C:
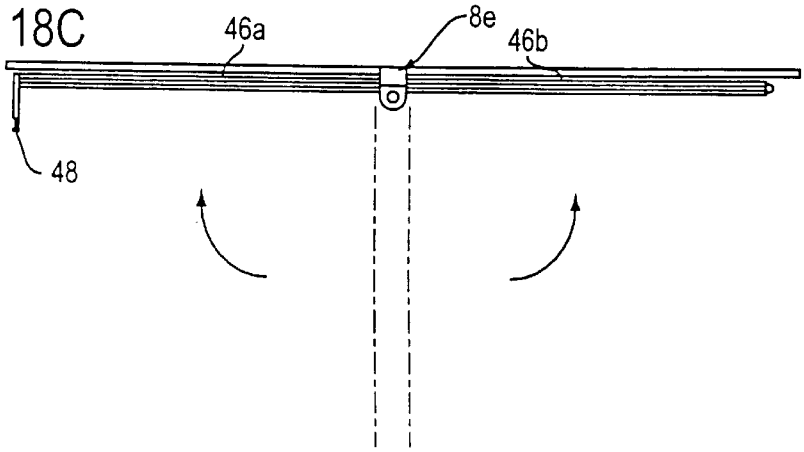
FIG. 18C is a schematic diagram of containers associated with an information display system according to an exemplary embodiment indicating the stop action arrangements for the display boards associated with the containers.

As has been shown in other FIGURES, according to any preferred embodiment, the display panels associated with the containers of the information display system will be pivotally coupled so that one display panel may be pivoted with respect to the other display panel (within a predetermined path of travel, e.g. 90 degrees). FIGS. 18A through 18C are schematic diagrams intended to illustrate the movement of containers and associated display panels of information display system according to an exemplary embodiment. As shown in FIG. 18A, when a container 8*d* is closed (with both display panels parallel, in a closed condition), a force applied transverse to container 8*d* will tend to translate or slide container 8*d* at mounting assembly 32 along track system or rail 30 (but will not open container 8*d*). As shown in FIG. 18B, to open a container 8*e* (after it is unlocked), a separating force is applied relative to each display panel 46*a* and 46*b*. According to a particularly preferred embodiment, the container includes a "stop action" mechanism (e.g. a detent arrangement) providing a tactile indication when a display panel has been pivoted to 45 degrees from the closed condition and upon further application of the separating force providing a positive stop when a display panel has been pivoted to 90 degrees from the closed condition. As shown in FIG. 18C, container 8*e* is in a fully open condition insofar as each display panel 46*a* and 46*b* has been pivoted to 90 degrees from the closed position. When the container is in a fully open condition, a force applied transverse to the container at an appropriate position (i.e. at or near the mounting assembly) will tend to translate or slide container along the track or rail. To return the container to the closed condition, a closing force must be applied in the opposite direction of the separating force.

FIGS. 19 through 28 show the construction of a container and arrangement of display panels of the information display system according to a preferred and other exemplary embodiments of the present invention. It is important to note, however, while preferred and exemplary embodiments are shown, according to alternative embodiments, the information display system may include any of a variety of types of information-containing structures (represented schematically by the containers shown in the FIGURES) having of a wide variety of constructions and any of a wide variety of associated mechanisms beyond those shown and described, all of which are intended to fall within the scope of the present invention. Similarly, it is also important to note that the display panels (which have been represented schematically in the FIGURES) may be configured to include display boards or related structures or elements in any of a wide variety of formats beyond those shown and described, all of which also are intended to fall within the scope of the present invention. According to alternative embodiments, any of a wide variety of display board carriers or mounting interfaces can be used within the container.

Figure 19:
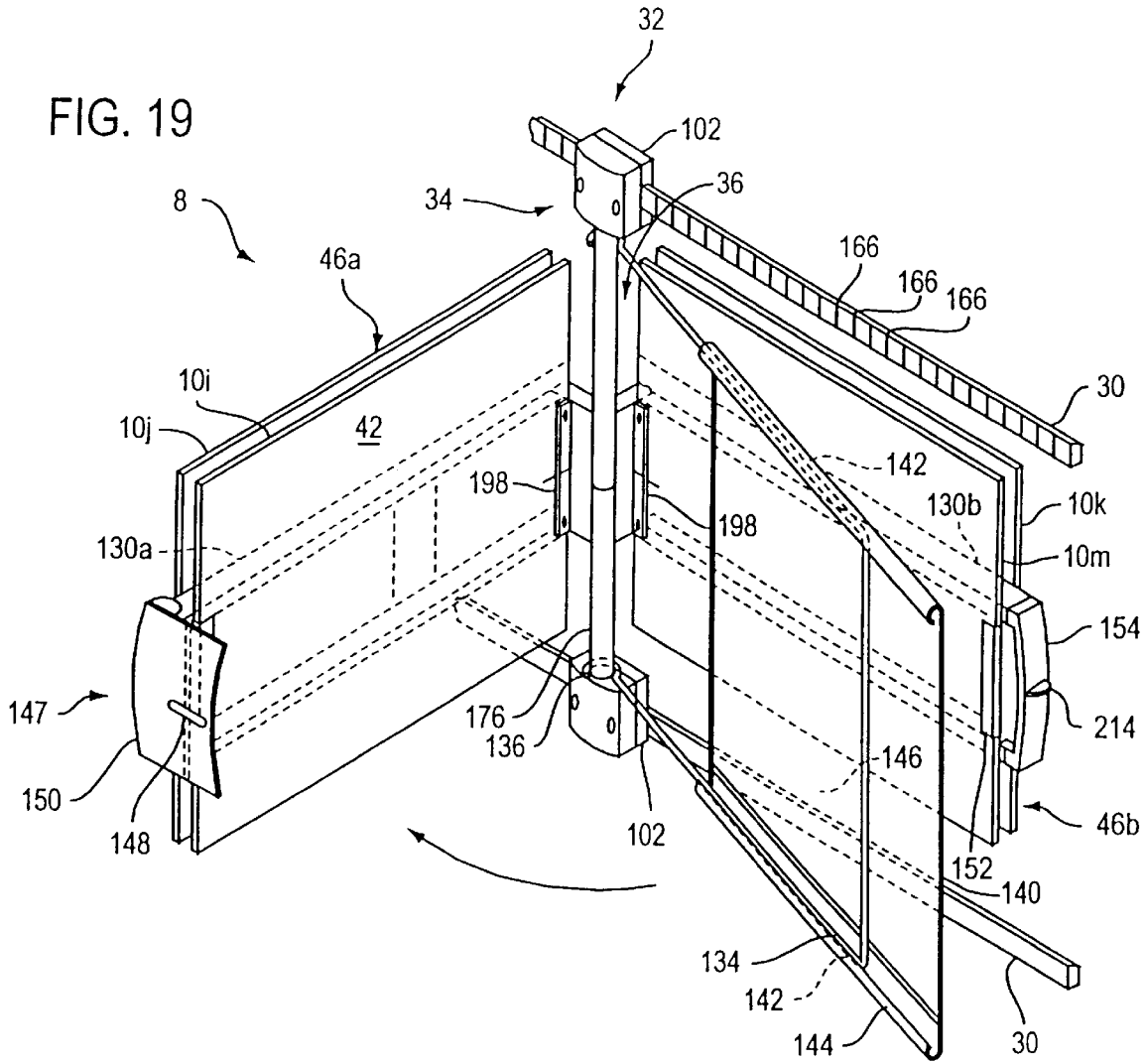
FIG. 19 is perspective view of a container of an information display system according to an exemplary embodiment of the present invention.

According to a particularly preferred embodiment shown in FIG. 19, each container has two display board carriers shown as lateral arm assemblies 130*a* and 130*b* (shown in phantom lines in FIG. 19) that provide a structure of the container for each associated lateral display panel. As shown in FIG. 19, display boards 10*i* and 10*j*, and 10*k* and 10*m*, can be installed on each side of each lateral arm assembly 130*a* and 130*b*, respectively, so that a total of four display boards can be installed within the container. The container provides one interior surface 42 and one exterior surface 40 (not visible in FIG. 19) on each side of each lateral arm assemblies 130*a* and 130*b*.

Referring to FIG. 19, a wire frame holder 134 may also be installed within the container by hooks 136 that fit around outer tube 176 of pivot mechanism 36 of mounting assembly 32 of the container (a set of coacting wire frame locking members may be included to secure the wire frame holder to outer tube 176 according to alternative embodiments). The container also includes a supplemental display panel shown as a translucent film panel 140 having a frame with a set of upper and lower grooves 144 (shown in phantom lines) that slide onto the upper and lower frame members 142 of wire frame holder 134. Panel 140 provides a phantom overlay 146 (e.g. as may show indicia for use in association with information presented on interior surfaces of the container). As is apparent from FIG. 19, according to alternative embodiments, other accessories such as compartments, pouches, tablets, etc. may be installed within a container onto the wire frame holder.

In the exemplary embodiment of FIG. 19, the container includes a locking mechanism 147 to secure the contents of the container when it is in the closed condition. As shown, locking mechanism 147 includes a slot 148 on a pivotally mounted front cap 150 of display panel 46*a* of the container that engages a tab 214 projecting from a front piece 154 of display panel 46*b* of the container. Engagement of the locking elements secures the contents of the container; disengagement allows the container to be opened. According to any preferred and alternative embodiment, any of a wide variety of coacting locking elements or other locking mechanisms known to those of ordinary skill who review this disclosure may be employed.

As shown in FIGS. 20A through 20E, according to a preferred embodiment, the mounting assembly includes both a translating or slide mechanism 34 and pivot mechanism 36. Slide mechanism 34 includes a set of glide blocks 102 (e.g. upper and lower) that engage a corresponding set of rails 30 attached to a mounting structure such as a wall. (According to a particularly preferred embodiment, the slide mechanism of mounting assembly and rail includes a linear guide system commercially available under the name AccuGlide from the Linear Motion Systems Division of Thomson Industries, Inc.) As shown, rail 30 may be provided with ball detents 164 that give tactile or audible feedback and a slight holding force when in contact with glide block 102; rail 30 may also be given visual indicia 166 that indicate distances of travel or position of the container along rail 30. According to alternative embodiments, translating motion of containers with respect to mounting structures may be effected with any of a variety of other mechanisms, sliding or rolling, such as rotating wheels traveling in a groove, etc. It should be noted that the mounting assemblies for both the containers of the information display system and for other mobile elements such as utility thresholds may share parts or basic design elements.

Figure 20A:
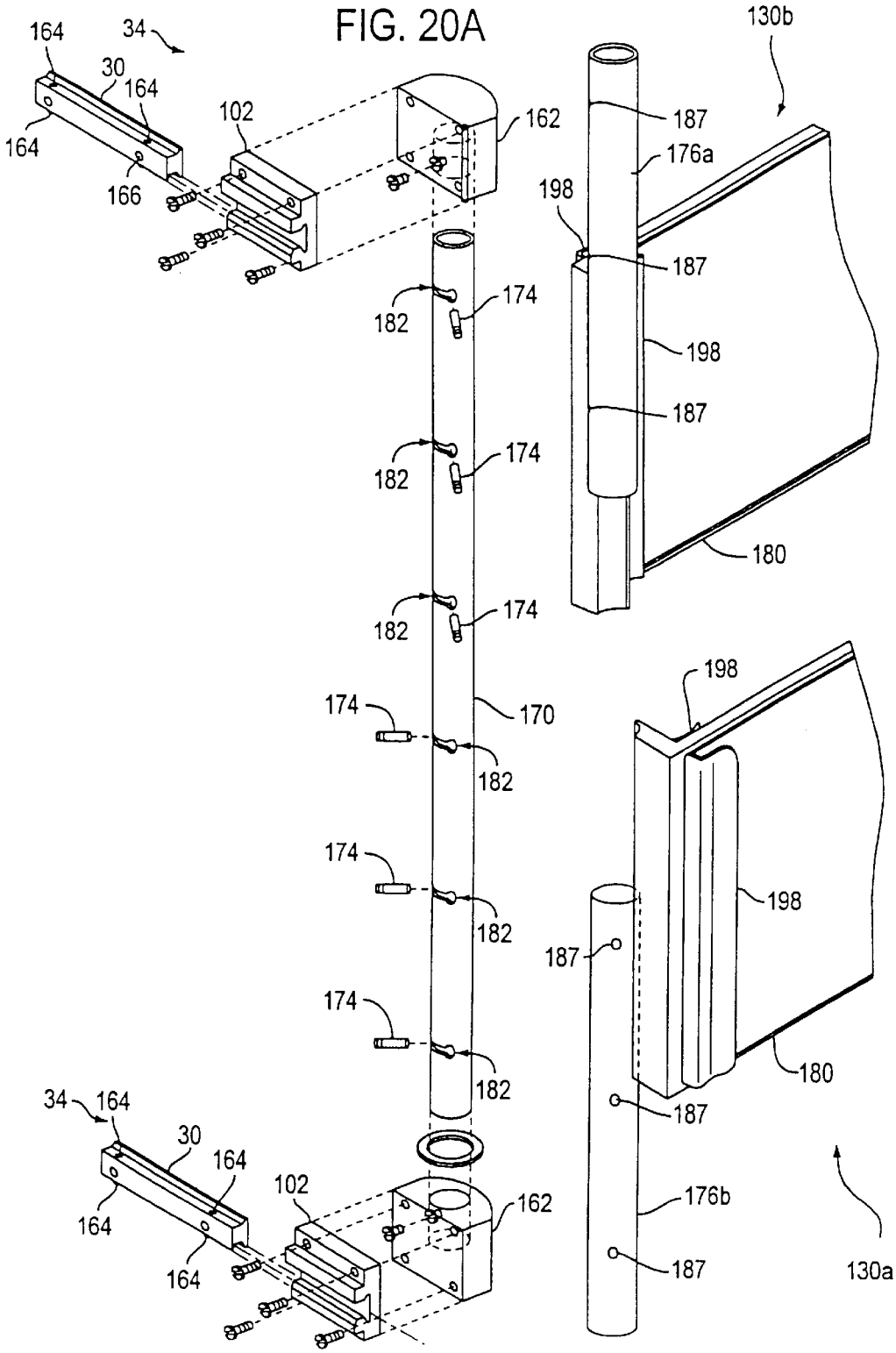
FIG. 20A is a fragmentary exploded perspective view of the mounting assembly of the container of the information display system of FIG. 19.

Referring to FIGS. 20A through 20E, each lateral arm assembly 130*a* and 130*b* of the container is coupled to pivot mechanism 36 of the mounting assembly so that one lateral arm assembly 130*a* can be pivoted with respect to the other lateral arm assembly 130*b*. To each glide block 102 of the mounting assembly is mounted a fixed base hub 162 (e.g. by fasteners shown as screws). As shown in FIG. 20A, pivot mechanism 36 includes a fixed inner frame tube 170 installed at each end within base hub 162 (by fasteners shown as screws 174*a*) and a pair of outer tubes 176*a* and 176*b*, each associated with a base frame member 180 of a lateral arm assembly. Each of outer tubes 176*a* and 176*b* is mounted (in an offset fashion shown in FIGS. 21A and 21B) to base frame 180 of each lateral arm assembly 130*a* and 130*b* and fitted over fixed inner tube 170; each of outer tubes 176*a* and 176*b* is also independently rotatable with respect to fixed inner tube 170 within a designated range of motion. Outer tubes 176*a* and 176*b* have serrations 298 (e.g. small compliant indexing teeth) that gently engage at the interface when installed onto fixed inner tube 170 to provide a slight degree of holding force between each lateral arm assembly 130*a* and 130*b* in ordinary operation (but that can be overcome when one display panel is to be selectively pivoted with respect to the other display panel).

Figure 20B:
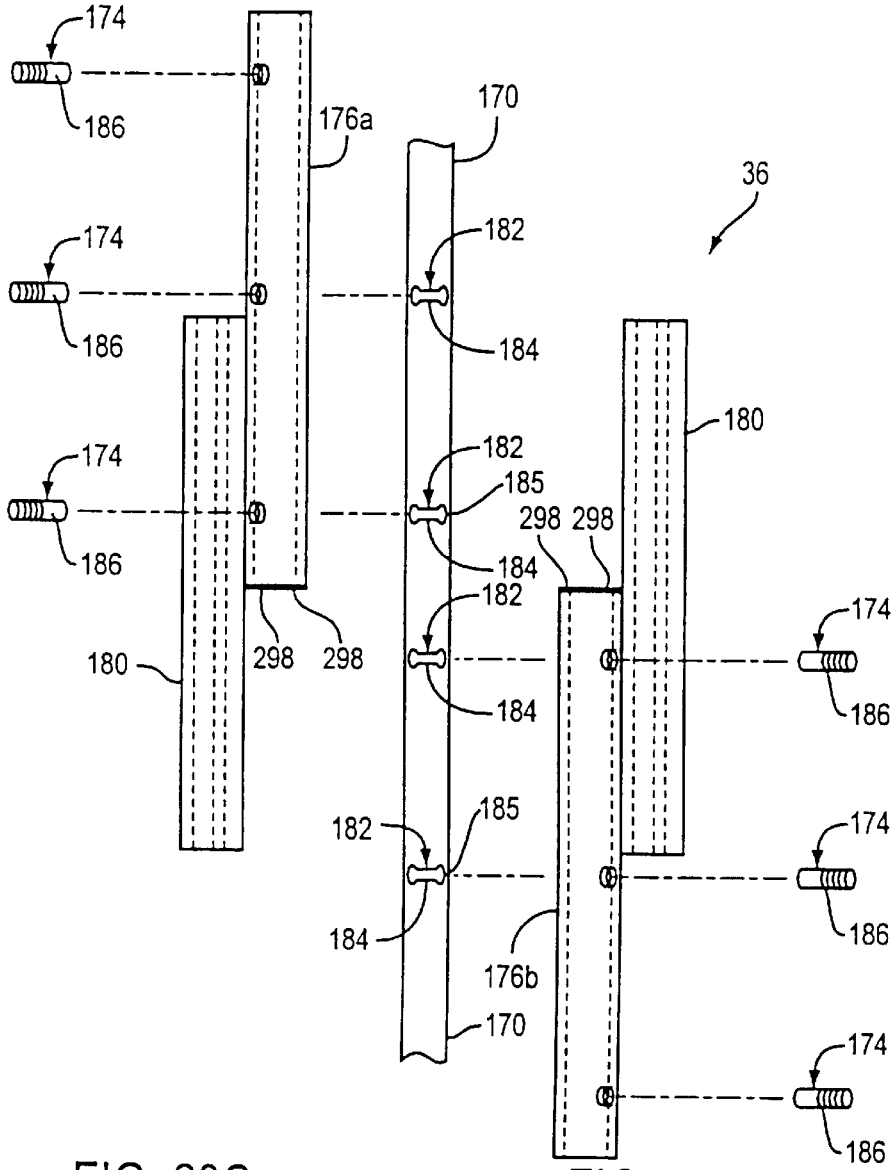
FIG. 20B is a rear fragmentary elevation view of the mounting assembly.
Figure 20C:
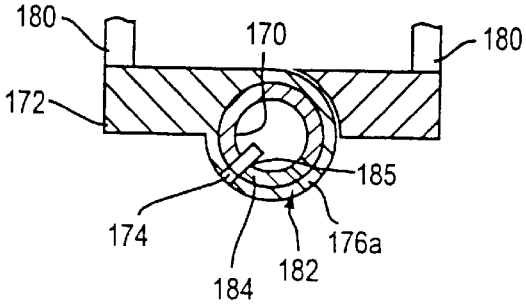
FIG. 20C is a sectional plan view of the mounting assembly.
Figure 20D:
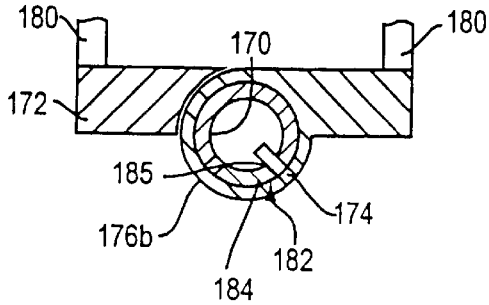
FIG. 20D is a sectional plan view of the mounting assembly.
Figure 20E:
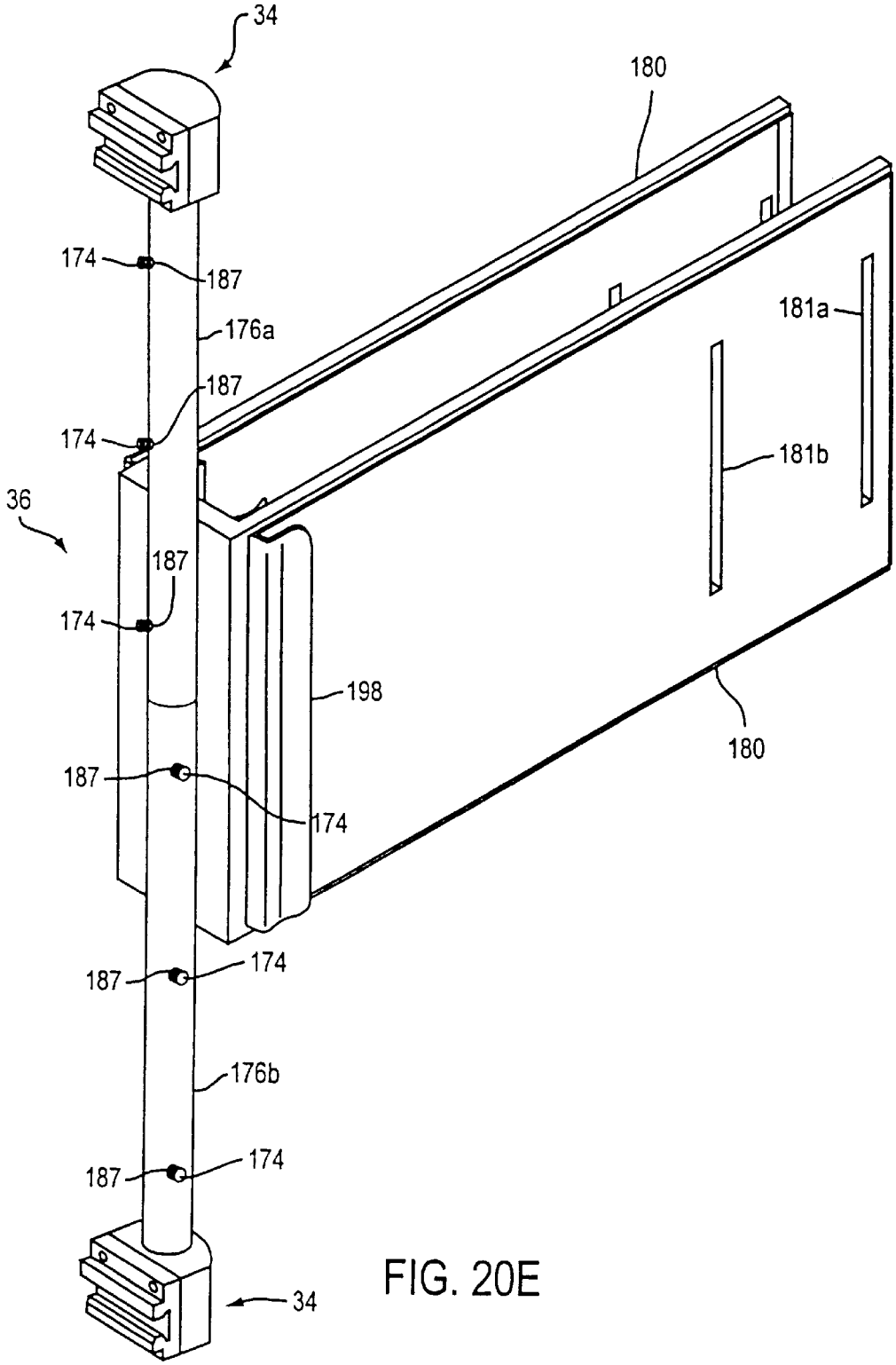
FIG. 20E is a perspective view of the mounting assembly.

Fixed inner tube has a set of slots 182 having a profile shown as detent profile 184 and into which unthreaded ends 186 of guide pins 174 threadably fixed (in holes 187) to outer tubes 176*a* and 176*b* are installed into fixed inner tube 170. Detent profile 184 of slots 182 is shaped (as shown) to provide coaction with guide pins 174 and to define the path of travel of each lateral arm assembly of the container. Referring to FIGS. 20A, 20B and 20E, for example, detent profile 184 has rounded ends 185 connected by a flat center. In FIGS. 20C and 20D, showing the coaction of the upper outer tube 176*a* and lower outer tube 176*b* with the inner tube 170, the path of travel for each lateral arm assembly ends with a physical stop when each lateral arm assembly has been pivoted to a certain designated positions (e.g. the closed condition and 90 degrees from the closed condition); the detent profile may also be given a shape to provide a tactile "stop" or "pause" (e.g. a slight holding force) and audible feedback when the corresponding lateral arm assembly has been pivoted to other certain designated positions (for example, 45 degrees from the closed condition). According to any preferred embodiment, the central portion of the detent profile includes a compliant material and is slightly smaller in width than the diameter of the unthreaded end of the guide pins, while the rounded ends are substantially the same diameter as the unthreaded end of the guide pins.

Figure 21A:
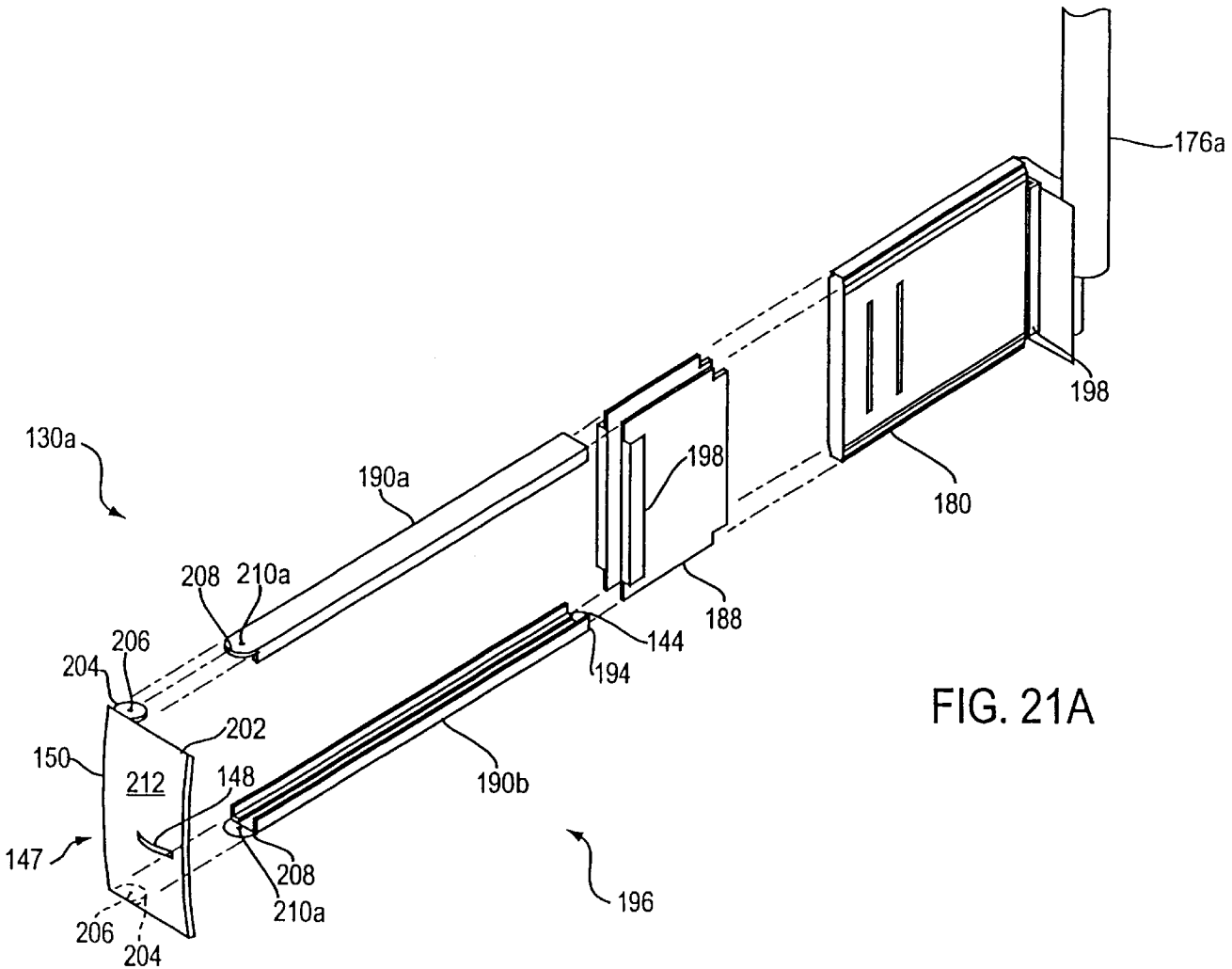
FIG. 21A is a fragmentary exploded perspective view of the container of the information display system of FIG. 19.
Figure 21B:
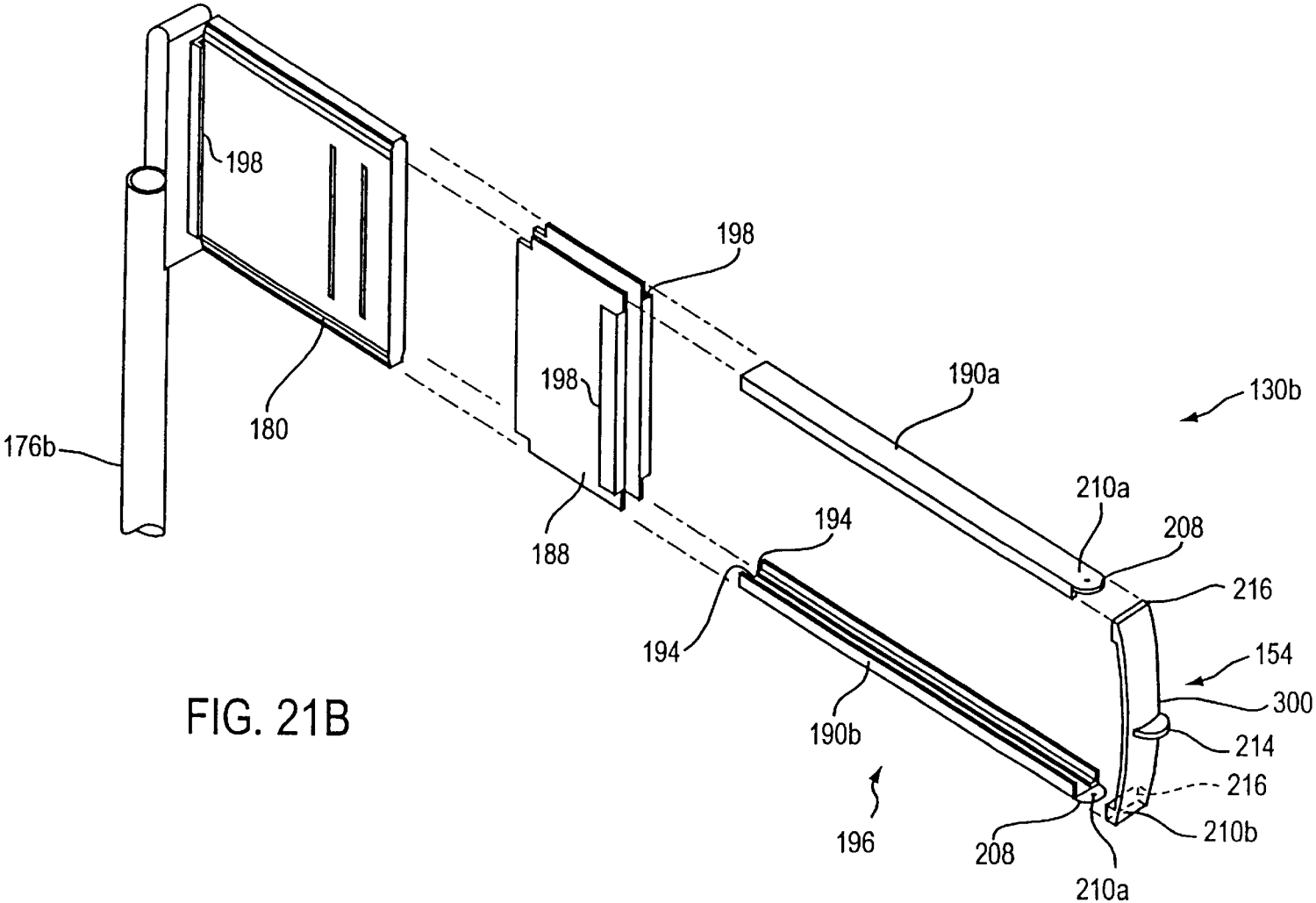
FIG. 21B is a fragmentary exploded perspective view the container of the information display system of FIG. 19.
Figure 21C:
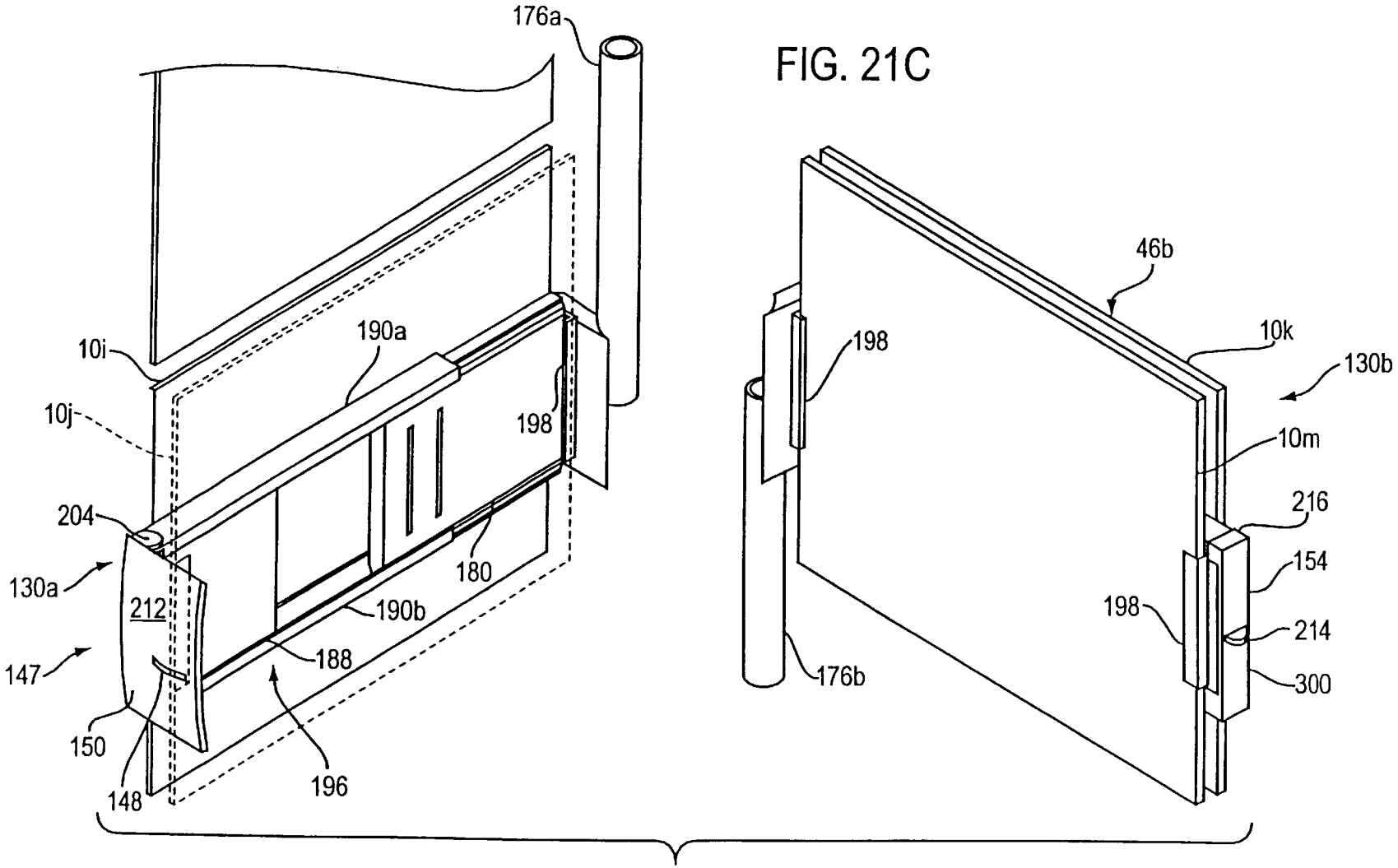
FIG. 21C is a fragmentary exploded perspective view of the container of the information display system of FIG. 19.
Figure 22:
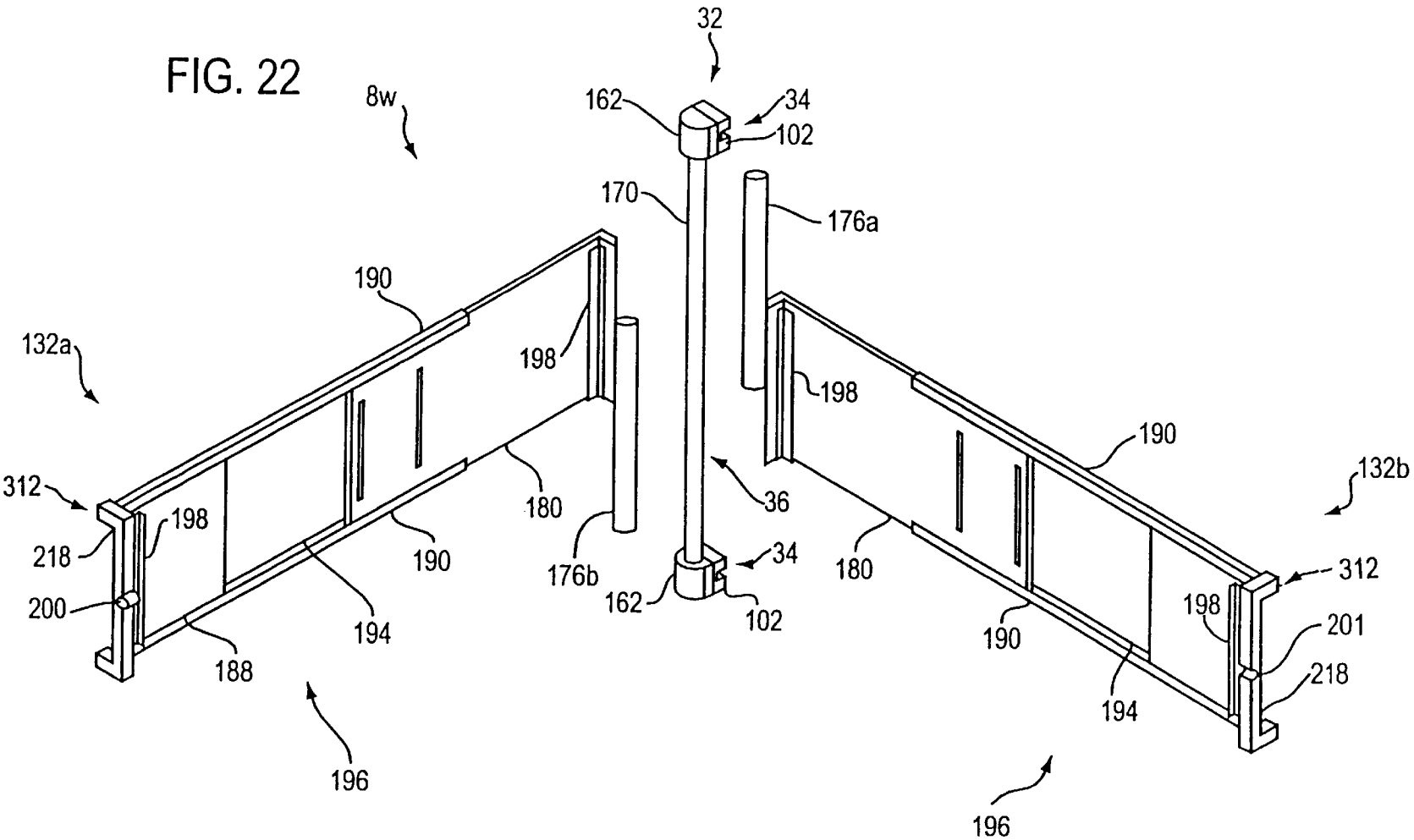
FIG. 22 is a fragmentary exploded perspective view of a container associated with an information display system according to a preferred embodiment of the present invention.
Figure 23A:
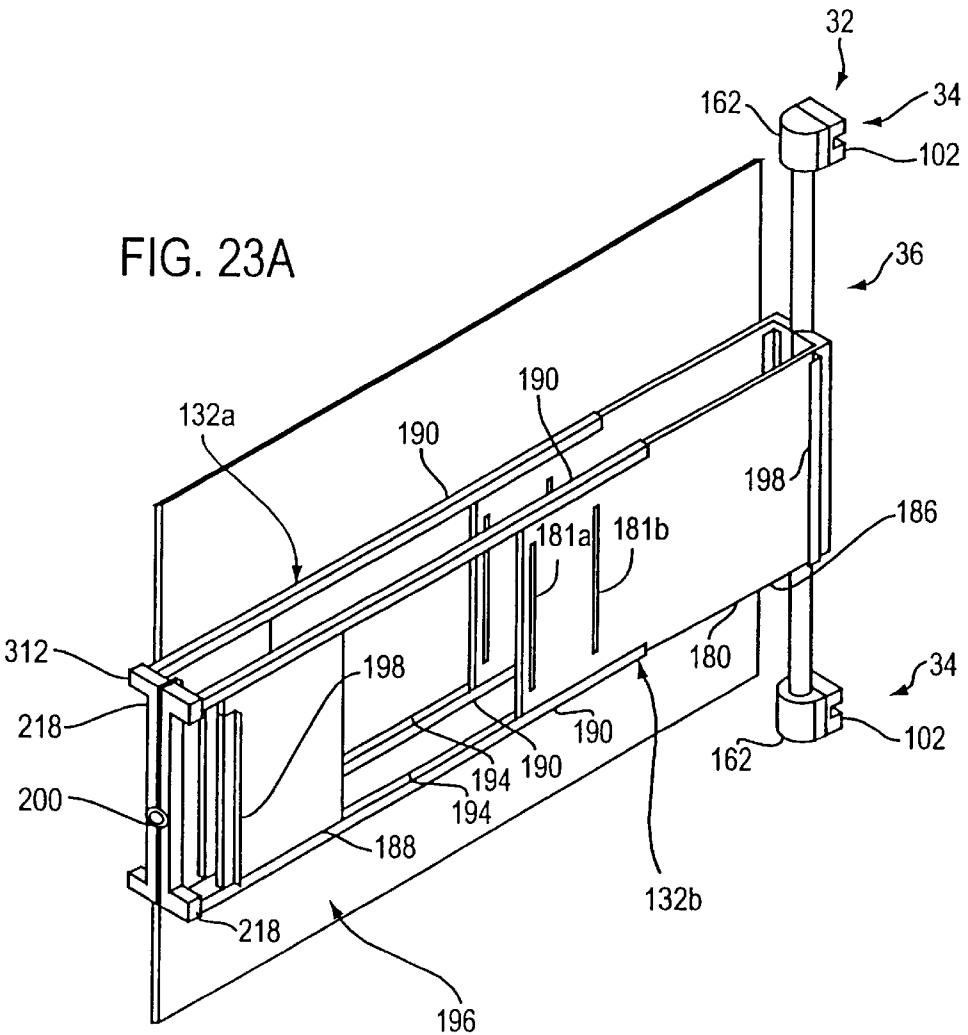
FIG. 23A is a fragmentary exploded perspective view of a container associated with an information display system according to a preferred embodiment of the present invention.
Figure 23B:
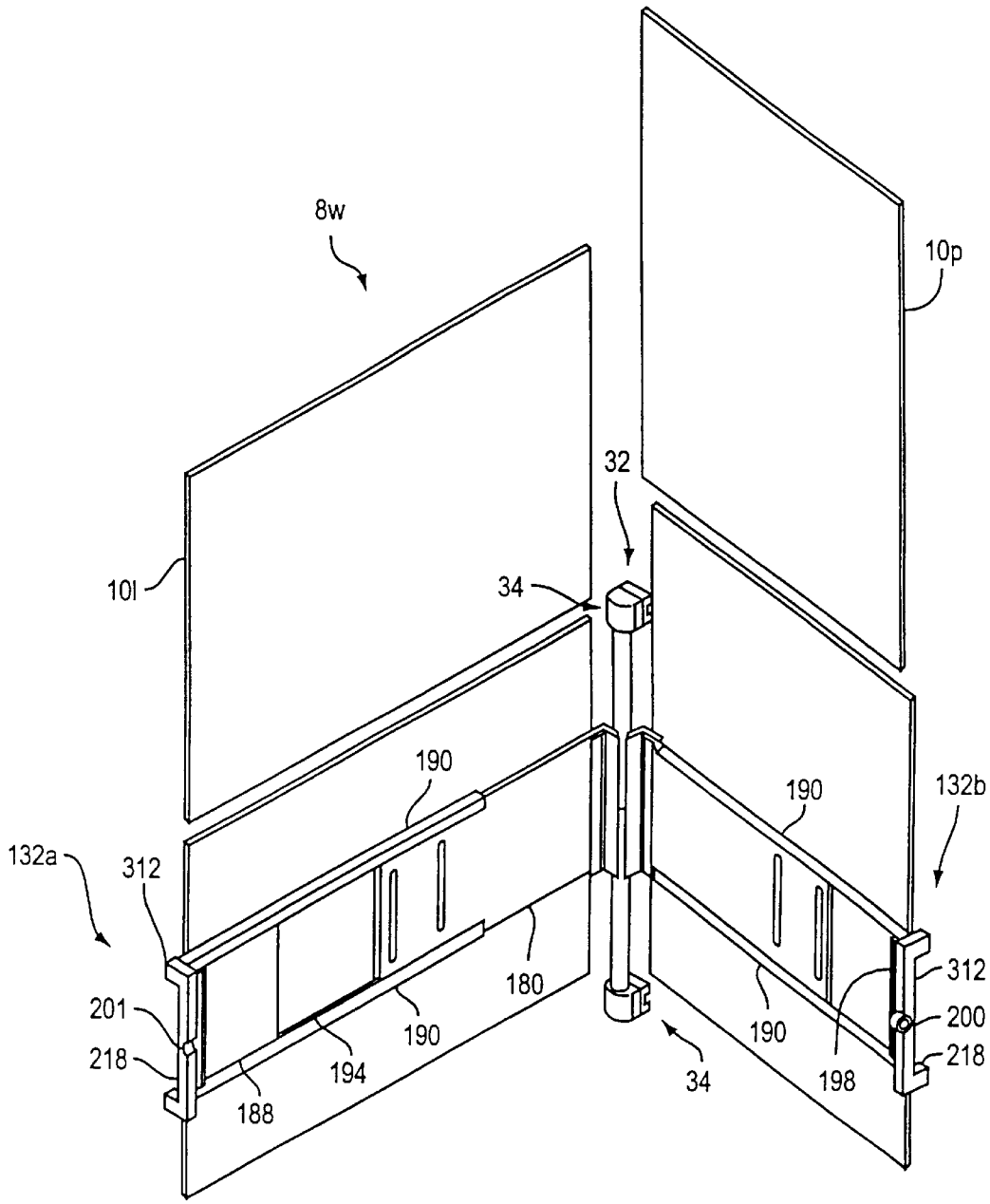
FIG. 23B is a fragmentary exploded perspective view of a container associated with an information display system according to a preferred embodiment of the present invention.

Referring to FIGS. 21A through 21C, a lateral arm assemblies 130*a* and 130*b* of the container are shown according to an exemplary embodiment. Each of lateral arm assemblies 130*a* and 130*b* has a similar construction, including base frame 180 coupled to an outer tube 176*a* and 176*b*, an end frame 188, and upper and lower outer frame members 190*a* and l90*b*. End frame 188 is mounted at the distal ends of (and between) upper and lower outer frame members 190*a* and 190*b*. As shown, upper and lower outer frame members 190*a* and 190*b* have a channel shape with retaining slots 194 within which end frame 188 is secured to form an end frame assembly 196 (shown in FIG. 21C). End frame assembly 196 is then slid onto base frame 180 (which provides upper and lower tracks that securely and adjustably retain upper and lower frame members en 190*a* and 190*b* of end frame assembly 196 in a relatively tight frictional/interference-type fit). End frame 188 and base frame 180 each include spring clips 198 (e.g. containing spring elements or compliant material providing a spring effect). As shown in FIG. 21C, display board 10*i*, 10*j*, 10*k*, and 10*m* (shown in phantom lines) are securely but releasably held within container by spring clips 198, which engage include a compliant portion intended to firmly "grip" the edges of each display board when end frame assembly 196 is slid tightly and fully onto base frame 180. By virtue of the adjustable (e.g. slidable adjustment) of the lateral arm assembly, display boards of varying sizes can be installed within the container. (As shown in FIG. 23B, display boards can be installed either in landscape or portrait mode.) Moreover, the height or position of display boards within (e.g. carried by) the container can be adjusted in the vertical direction. As shown in FIG. 19, the spring clips may include a visual indicator marking (e.g. in the form of a notch or line) that may correspond with an indexing marking or line on the display board to facilitate an intended placement of the display board within the container.

As shown in FIG. 21A, front cap 150 of lateral arm assembly 130*a* has upper and lower tabs 204 each having a pivot pin 206 to install onto upper and lower tabs 208 at the ends of upper and lower outer frame members 190*a* and 190*b* of one end frame assembly 196, each having a corresponding aperture 210*a* into which a pivot pin (not shown) is snap fit for pivotal movement. Front cap 150 includes a face 212 onto which a label or other designation can be applied. As shown in FIG. 21B, front piece 154 provides a handle 300; front piece 154 includes upper and lower tabs 216 each having an aperture 210*b* installed onto ends 208 of upper and lower tabs 210*a* at the ends of upper and lower outer frame members 190*a* and 190*b* of the other end frame assembly 196. Aperture 210*b* of front piece 154 may be snap fit or press fit onto tabs 210*a*.

Figure 24B:
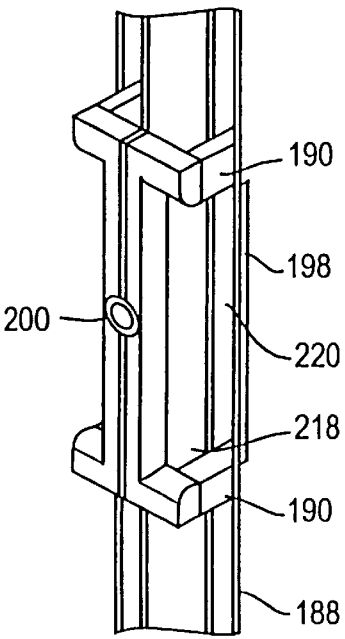
FIG. 24B is a fragmentary perspective view of the container of FIGS. 22 and 24A.
Figure 24A:
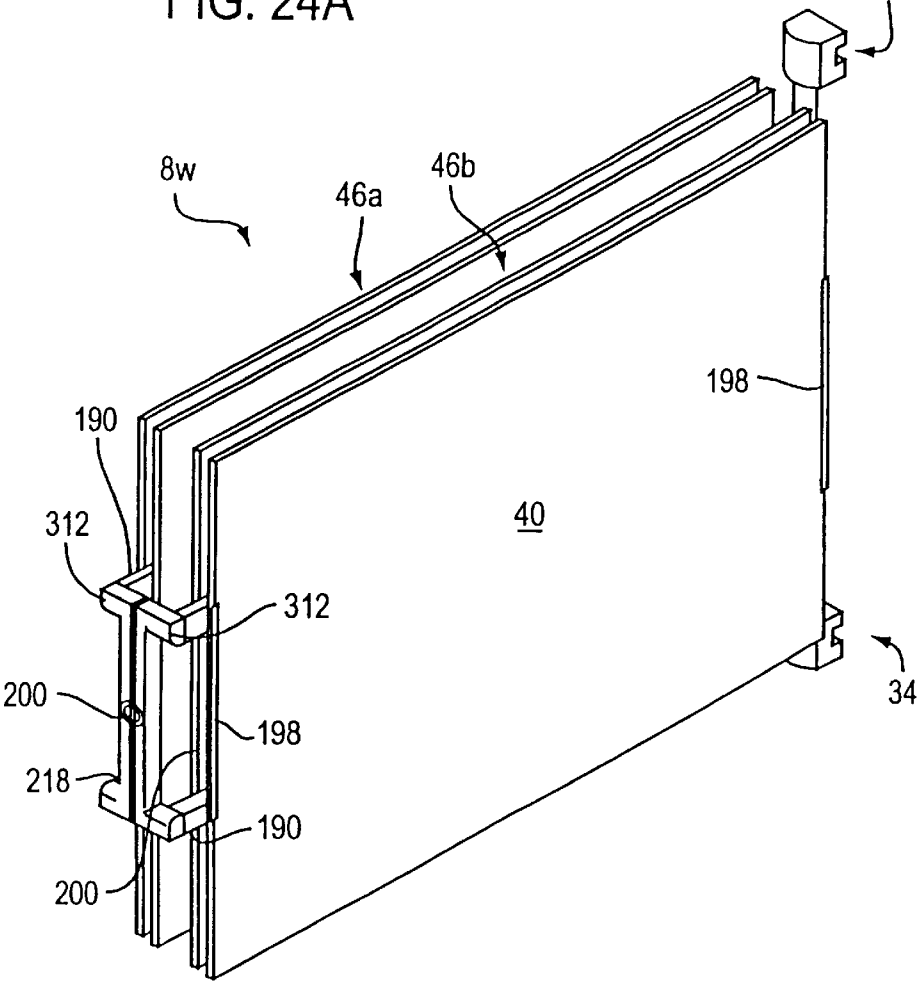
FIG. 24A is a perspective view of the container of the information display system of FIG. 22 showing the installation of display boards.

Referring to FIGS. 22 through 24A, an alternative embodiment of a container is shown, similar in basic respects to the container shown in FIGS. 21A through 21C. Container 8*w* includes a pair of lateral arm assemblies 132*a* and 132*b* each including base frame 180 (as in FIGS. 21A through 21C) and end frame assembly 196. End frame assembly 196 includes a vertical front handle 312 (having a "[" shape). Each has a curved recess 201; into one of the front handles of a container, a locking element can be installed, for example a cylinder lock 200 (e.g. tumbler actuated by a key) providing a conventional locking action wherein one front handle is secured to the other front handle. Referring to FIGS. 24A through 24B, the container includes a receptacle shown as a "mail slot" receptacle 220 accessible from the front of the container at front handle 312. Receptacle 220 is formed within end frame between upper and lower outer frame members 190 (and is of a size that is capable of containing a sufficient volume of "mail", i.e. paper sheets, envelopes, magazines and other publications, etc.). One receptacle 220 can be provided in association with each lateral arm assembly 132*a* or 132*b* of the container.

Figure 25:
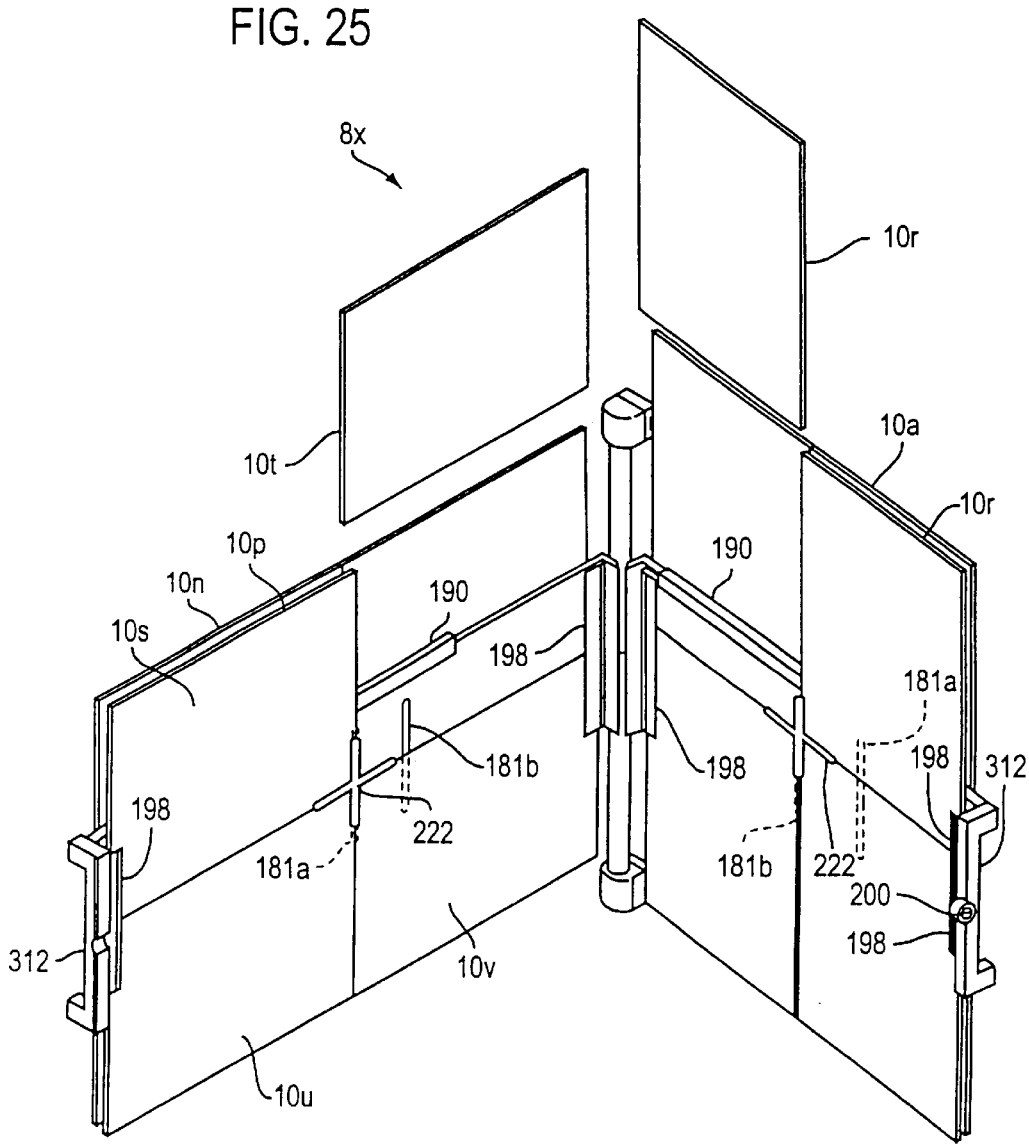
FIG. 25 is a fragmentary exploded perspective view of an information display system according to an alternative embodiment.

Referring to FIG. 25, according to an alternative embodiment, a container of the information display system can include carriers or lateral arm assemblies 132*a* and 132*b* configured to employ a display board arrangement including four display boards 10*n*, 10*p*, 10*q*, and 10*r* (of a smaller size, e.g. one-quarter the size of the regular display boards), for example in either portrait mode or landscape mode. The lateral arm assemblies each include a centrally located spring clip 222 (having a "+" shape) that is capable of engaging and securing "holding" each of four smaller display boards in combination with spring clips 198 of base frame 180 and end frame 196. Clip 222 may be installed (e.g. by a press or "snap" fit) within either of slots 181*a* or 181*b* of base frame 180 as needed, depending upon the size and orientation of the display boards (see FIG. 25).

Figure 26:
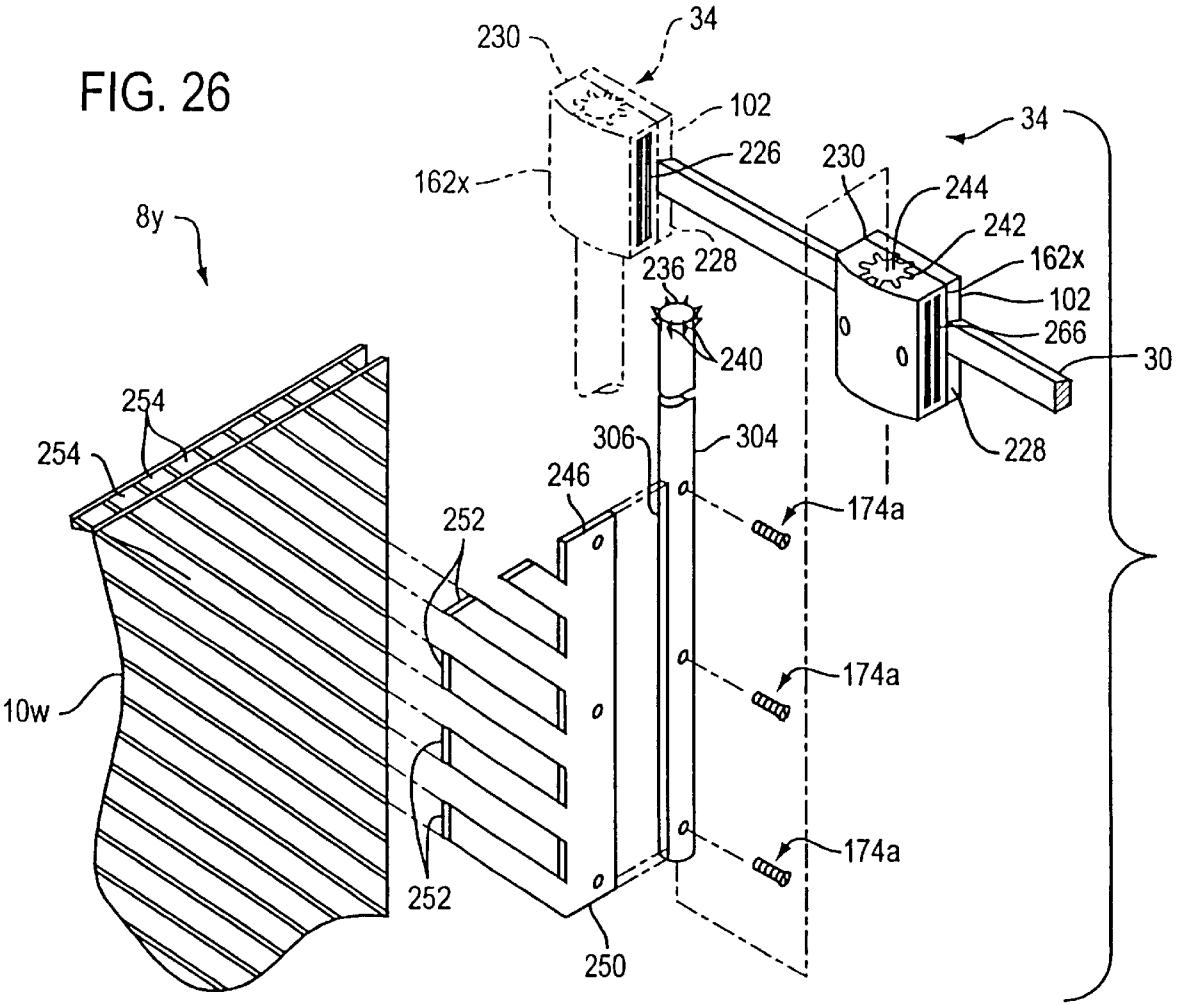
FIG. 26 is a fragmentary exploded perspective view of a container of an information display system according to an alternative embodiment.

FIGS. 26 through 27 show a container 8*y* according to an alternative embodiment of the information display system. Container 8*y* is configured to hold a single display board 10*w* and is coupled to a single rail 30 by a mounting assembly including slide mechanism 34 (of a type similar to as shown in FIG. 20 having guide block 102 and a base hub 162*x*) and pivot mechanism 36. Base hub 162*x* of the mounting assembly includes a set of magnets 226 on one lateral surface 228 and a corresponding metal strip (not visible) on the other lateral surface 230, so that one or more adjacent containers can be joined or "ganged" together (see, e.g., FIG. 2A). Pivot mechanism 36 includes a frame tube 304 which fits within a central vertical hole 244 in base hub 162*x*. Frame tube 304 has a cap 236 with a star-shaped upper profile formed by a series of triangular index tabs 240 or projections that engage a corresponding pattern of index slots 242 around the perimeter of hole 244 in base hub 162*x* when frame tube 170 is installed into hole 244. Frame tube 170 also includes an elongate axial slot 306 into which a lateral arm assembly shown as a frame plate 246 can be installed and secured by a series of threaded fasteners 174*a*. Frame plate 246 includes a base 250 from which project a series of diagonal fingers 252.

Figure 27A:
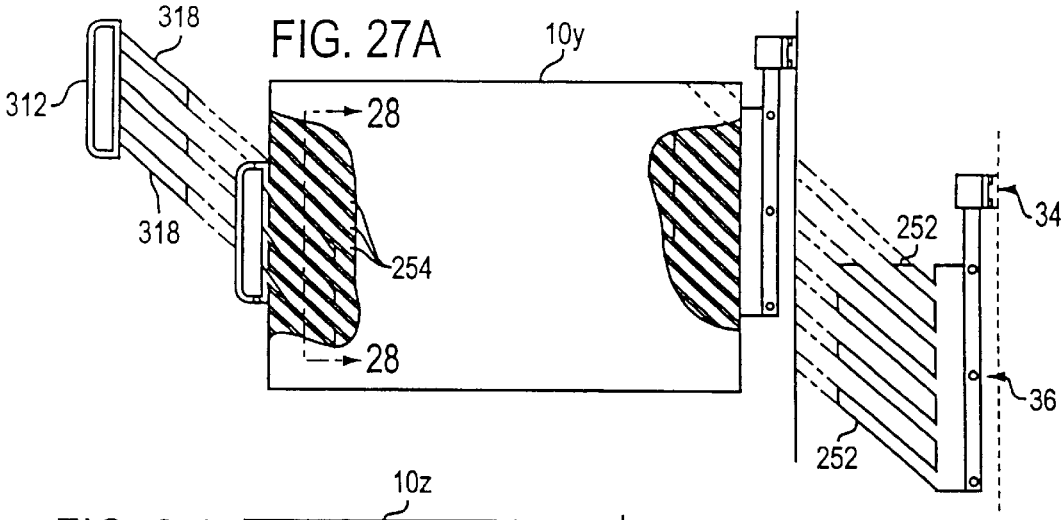
FIG. 27A is a schematic side elevation view of the container of FIG. 26.
Figure 27B:
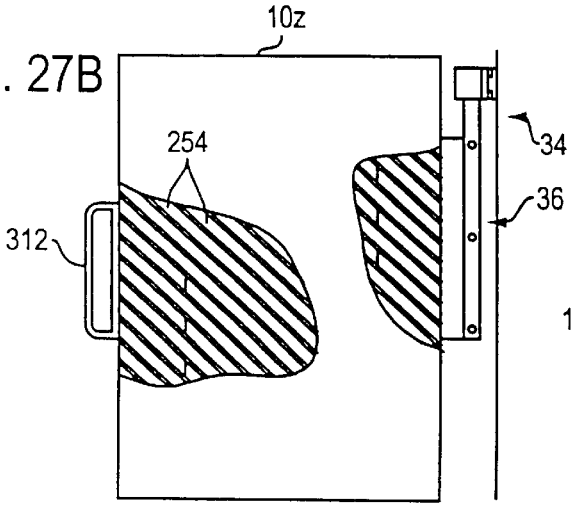
FIG. 27B is a schematic side elevation view of the container of FIG. 26.
Figure 28:
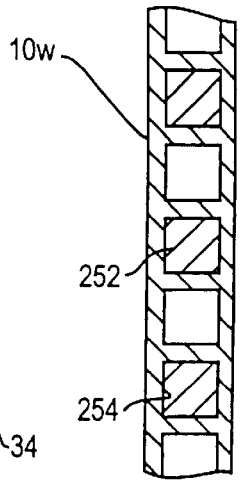
FIG. 28 is a fragmentary sectional view of a display board associated with the container of the information display system of FIGS. 27A through 27C.
Figure 27C:
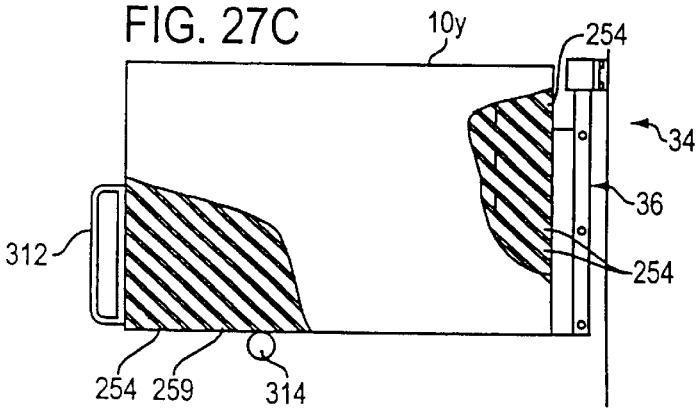
FIG. 27C is a schematic side elevation view of the container of FIG. 26.

Display board 10*w* has two flat exterior surfaces with a central core providing a series of diagonal passages 254 (see FIG. 28) that open onto all the edges of the display boards (however, for aesthetic or other reasons, the passages do not need to open onto all edges of the boards). According to a particularly preferred embodiment, the display board will be a rigid polycarbonate structured sheet of a type commercially available from under the name "CO-EX" from CO-EX Corp. of Rocky Hill, Conn. or of another similar construction available from other suppliers. As shown in FIGS. 27A through 27C, diagonal fingers 252 of frame plate 246 fit within corresponding diagonal passages 254 to secure display board 10*w* in container 8*y*. As shown in FIGS. 27A through 27C, the display board can be installed in landscape mode, portrait mode, or at any of a wide variety of orientations and discrete height levels (provided by the passages). According to alternative embodiments, the display board may be provided with a greater or lesser number of passages in any of a variety of sizes, patterns and orientations.

Pivotal adjustment of display board 10*w* within container 8*y* is effected by lifting frame tube 170 within hole 244 of base hub 162 to disengage index tabs 240 from index slots 242, then rotating frame tube 170 to another adjustment position where index tabs 240 can engage index slots 244 and lowering frame tube 170 back into hole 234; eight discrete adjustment positions spaced at 45 degree intervals are provided according to the exemplary embodiment (but according to alternative embodiments, other adjustment positions may be provided).

Figure 27D:
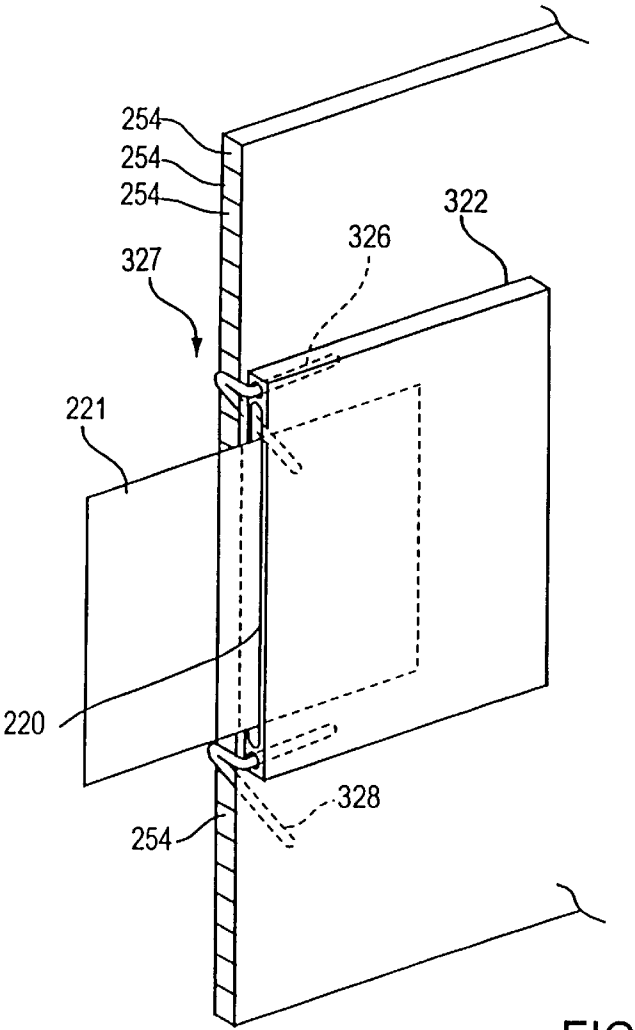
FIG. 27D is a fragmentary perspective view of the container of FIGS. 27A through 27C showing an arrangement for installing a mail slot.
Figure 27E:
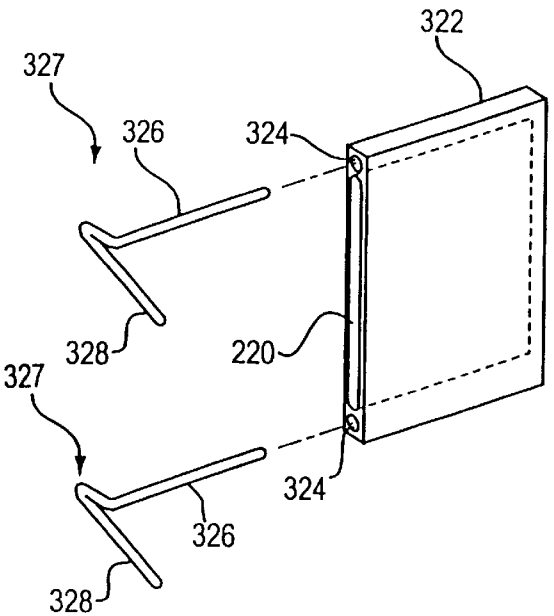
FIG. 27E is a fragmentary perspective view of the container of FIGS. 27A through 27C showing an arrangement for installing a mail slot.

Referring to FIGS. 27A through 27E, accessories such as vertical handle 312, a ball handle 314 or a receptacle box 322 (each of which are installed onto display board by fingers or projections 318 are inserted within diagonal passages 254) may be provided for a display board as shown in FIG. 26. FIGS. 27D and 27E show receptacle box 322 which is adapted for attachment to display board 10*w*. Receptacle box 322 includes a large central slot shown as a 'mail' slot 220 and upper and lower apertures 324, though which horizontal arms 326 of a holding member 327 are inserted; to mount receptacle box 322 to display board 10*w*, diagonal arms 328 of holding member 327 are inserted into passages 254 of display board 10*w*. An object 221 (e.g. a piece of paper) can be inserted into slot 220 and held in receptacle box 322.

Figure 29:
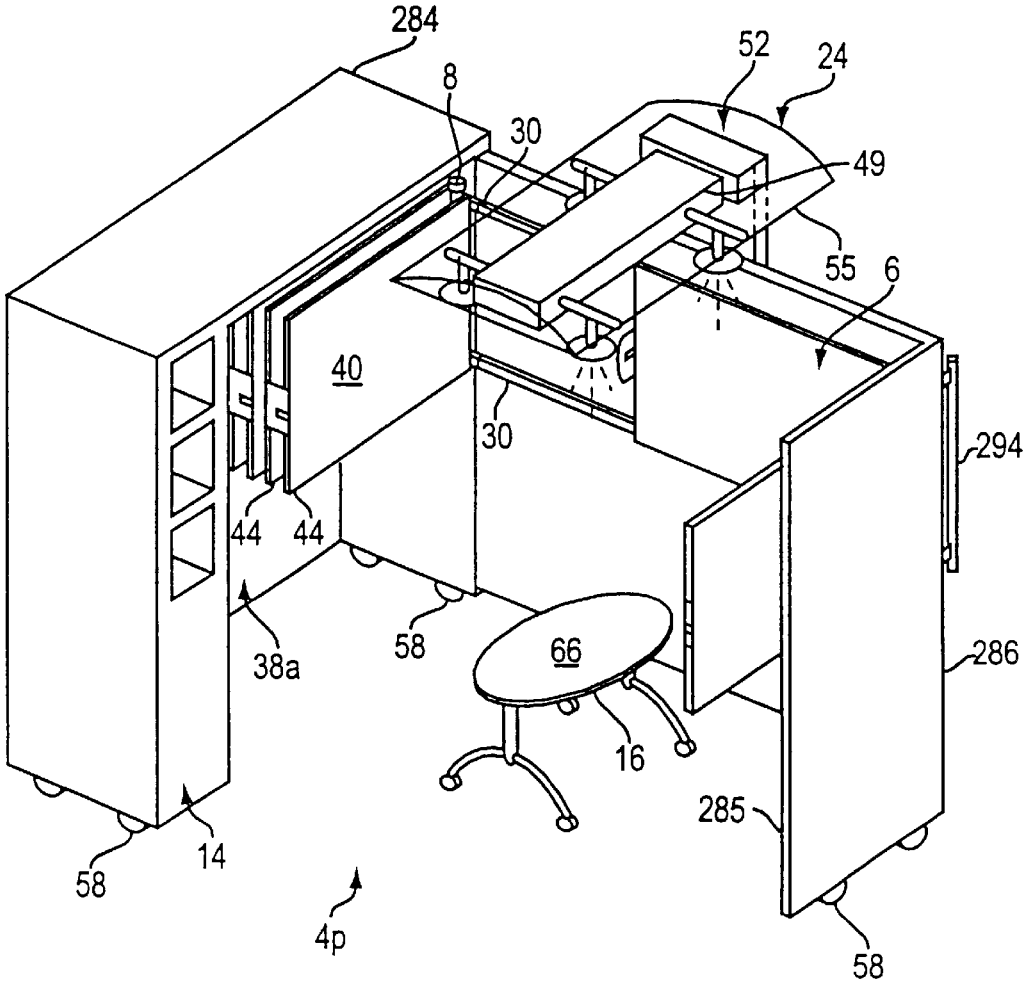
FIG. 29 is a perspective view of a workstation according to an alternative embodiment of the present invention.
Figure 30:
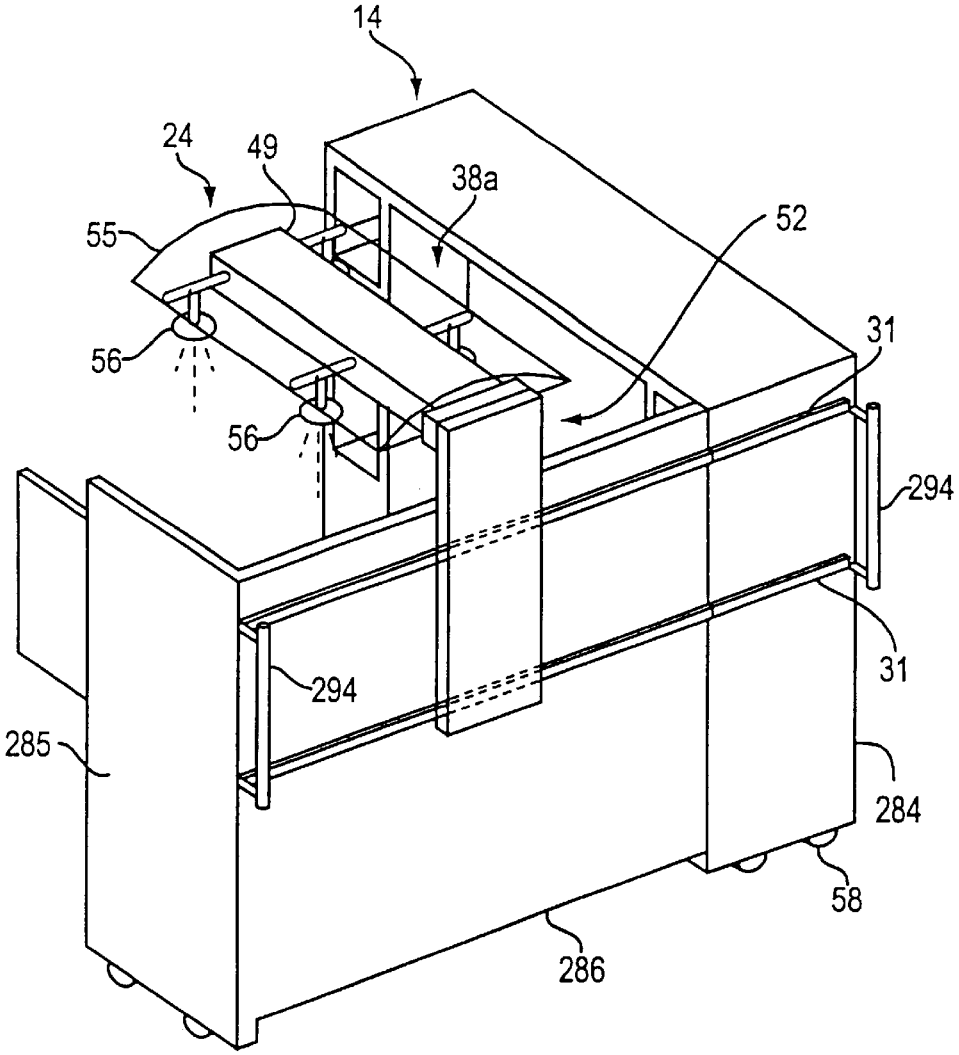
FIG. 30 is a perspective view of a workstation according to an alternative embodiment of the present invention.
Figure 33:
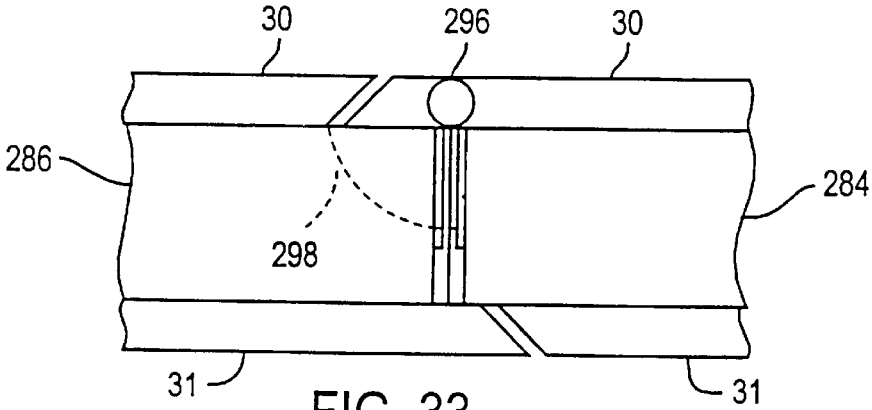
FIG. 33 is a fragmentary plan view of a hinge and rail arrangement for the workstation of FIGS. 29 through 32.
Figure 31:
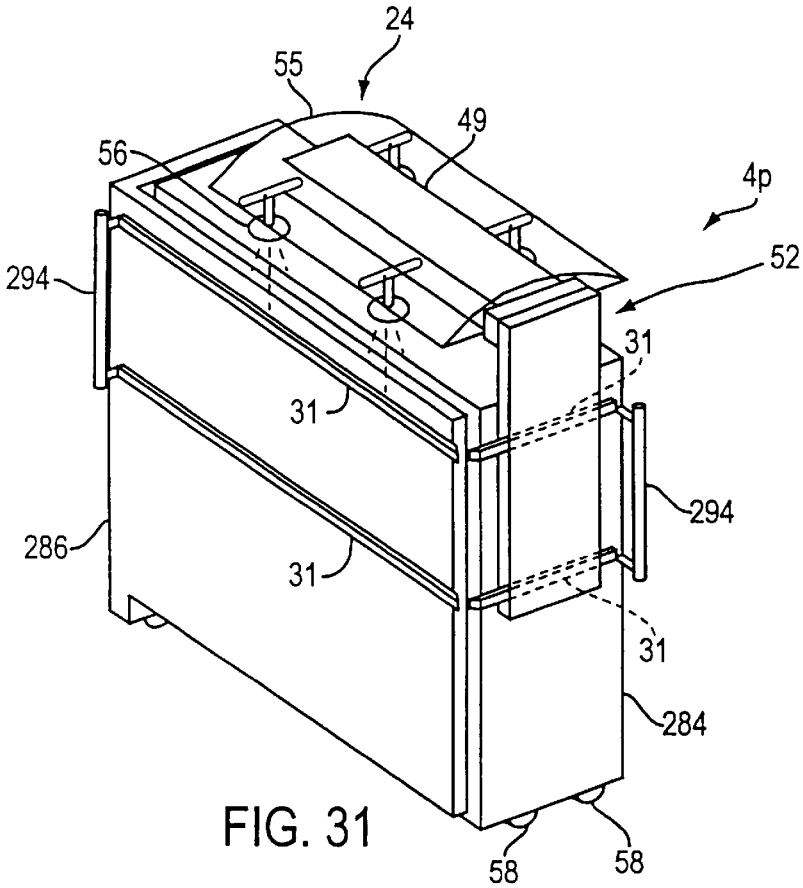
FIG. 31 is a perspective view of a workstation according to an alternative embodiment of the present invention.
Figure 32:
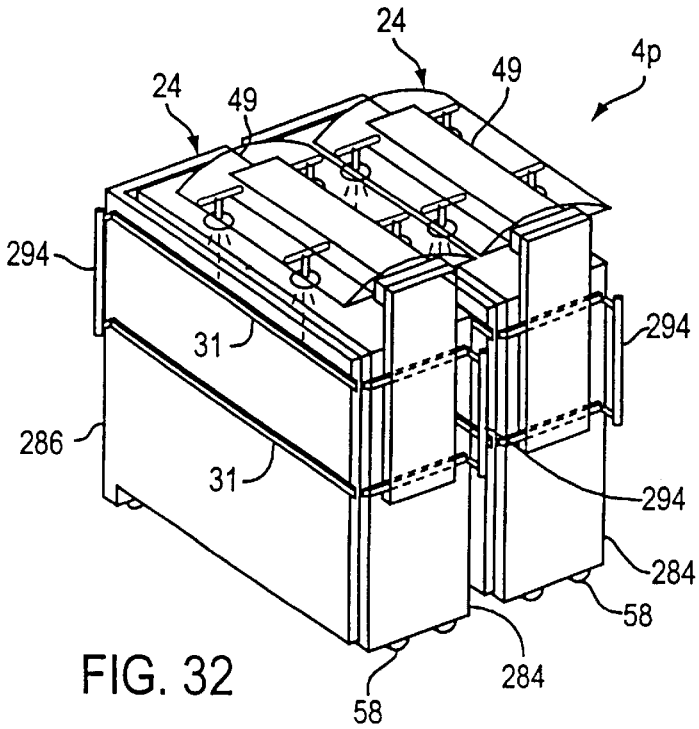
FIG. 32 is a perspective view of a workstation according to an alternative embodiment of the present invention.

FIGS. 29 through 32 show a mobile workstation 4*p* containing information display system 6 and utility threshold 24 according to an exemplary embodiment of the present invention. Mobile workstation 4*p* includes shelving unit 14 (on a set of casters 58) providing docking area 38*a* for containers 8 of information display system 6. Containers 8 are coupled to a set of internal rails 30 mounted on an end wall 284 of shelving unit 14 and a base wall 286 for translating movement within mobile workstation 4*p*. As shown, base wall 286 (on a set of casters 58) is pivotally coupled to shelving unit 14 by hinges (as shown in FIG. 33). Utility threshold 24 is coupled by mounting assembly 52 shown as a vertical mounting plate 53 including a glide block to a track system shown as a set of external rails 31 mounted on vertical surfaces of both end wall 284 of shelving unit 14 and base wall 286 for translating movement within a defined path of travel. End wall 284 (on a set of casters 58) is pivotally coupled to base wall 286 as shown in FIGS. 29 and 32. As shown in FIG. 30, a set of handles 294 provide "stops" at the ends of external rails 31. Utility threshold 24 includes horizontal beam 49 extending into workstation 4*p* from vertical mounting plate 53; beam 49 provides a mounting structure for canopy 55 and lighting fixtures 56. Shelving unit 14 also serves as docking area 38*a* for utility threshold 24. Mobile table 16 can be included within workstation 4*p*.

The hinge and rail detail for mobile workstation 4*p* according to a particularly preferred embodiment is shown schematically in FIG. 33. Rails 30 for the containers are mounted on the inside of base wall 286 and end wall 284; external rails 31 for utility threshold 24 are mounted on the outside of base wall 286 and end wall 284. Hinges 296 are included within internal rails 30; one portion of internal rail 30 (affixed to base wall 286) extends across the interface of base wall 286 and end wall 284. A clearance aperture 299 allows the portion of rail 30 to have clearance into end wall 284 when pivoted with respect to base wall 286. Diagonally tapered ends of external rails 31, which separate when the mobile workstation is stowed, are arranged to keep utility threshold 24*z* from sliding out of the docked position. (According to alternative embodiments, other hinge and rail mechanisms may be employed to provide the desired hinge action while facilitating the full use of rails for the containers and utility threshold.)

Referring to FIGS. 31 and 32, mobile workstation 4*p* can be stowed (closed and compressed) for transport or storage by stowing containers 8 and utility threshold 24 within docking area 38*a* (which is given sufficient internal capacity) and then folding end wall 284 onto shelving unit 14 at hinges 296 so that base wall 286 and side wall 285 envelop shelving unit 14 (a locking or latching mechanism can be provided to secure the mobile workstation in the stowed condition and/or the open condition). When stowed for transport or storage, mobile workstation 4*p* can be pulled or pushed using handles 294. FIG. 32 shows that while each mobile workstation is a "stand-alone" unit, groups of mobile workstations may conveniently be associated for purposes of storage.

According to any preferred embodiment, the information display system provides an organizational framework intended to promote and advance the efficient use, display and storage of information and layers of information on display panels (e.g., "information persistence," regardless of the format by which the information is placed on associated display boards) in the work environment. According to any preferred embodiment of the information display system, each display panel will include at least one display board adapted to contain or present information. As will become apparent to those of ordinary skill who review this disclosure, the display boards may be provided in any of a wide variety or formats, or may be adapted to display information in any of a wide variety of formats and/or media; a wide variety of configurations are possible for the information display system, employing variations of size, shape, orientation, arrangement, mounting interfaces and structures, etc., as well as variations in the deployment of display boards. According to any preferred embodiment, the information display system will facilitate the dynamic configurability and reconfigurability of work spaces, workstations and work environments, in territorial appearance and contextual appearance (e.g. as scenery or "sets" can be reconfigured in a theatre play).

According to alternative embodiments, the information display system can be implemented through a wide variety of mounting arrangements that allow for translating movement of the containers and associated display boards with respect to a wide variety of mounting structures, for example, floors, architectural walls, panel walls, systems furniture, space frames, other articles of furniture, etc. The variety of mounting structures that may be used with the information display system illustrates the flexibility and adaptability of the information display system to a wide variety of work environments. Moreover, although in the exemplary embodiments the mounting assembly and track system for the containers of the information display system are preferably arranged for linear movement along the mounting structure, according to alternative embodiments, the track system of the information display system may be configured for wholly or partially curved movement (e.g. as necessary to conform to a curved wall or other mounting structure alone or in combination to facilitate the movement of containers from one orientation or plane to another within a work environment.)

It is important to note that the use of the terms "display panel" or "display board" are not meant as terms of limitation, insofar as any "panel" or "board" or like structure having a decorative or functional use or application is intended to be within the scope of the term. For example, the use of the term "display board" is intended as a convenient reference for any such "board" or structure, which may also be viewed synonymously with the term "work board" or other like terms. According to any preferred embodiment, the display panel or display board is configured in a generally symmetrical basic form so that the designation of a "front surface" and "back surface" is essentially arbitrary and dependent upon the orientation within the information display system. Exemplary display boards may be formed of any of a variety or materials or have any of a variety of sizes and shapes, constructions (with any of a variety of properties, such as weight, strength, rigidity, acoustic properties, flammability, etc. suitable for the intended application) and mounting interfaces. As will be apparent to those who review this disclosure, the outer surfaces of the display boards may be provided with a wide variety of surface treatments (e.g. tackable or repositionable adhesive, clear film overlay or "photo album", clear film "pocket", writable clear film, cork or tack board, peg board, magnetic board, marker board, dry erase or "white" board, paper or paper tablet, projection screen, graphics display, cloth, etc.) in a wide variety of combinations (i.e. with one surface differing in whole or in part from the other surface) that may be suited or adapted to a wide variety of functional and decorative purposes according to the preferred and other alternative exemplary embodiments of the present invention. According to any preferred embodiment, the display boards and associated structures and systems are configured for ease and flexibility of use (e.g. recording, mapping, transformation, capture, etc.), display (e.g. sharing and communicating), and storage—information persistence—as well as of mounting and removal from associated mounting structures (such as the containers).

It is also important to note that the use of the term "information" is meant to cover any use of any type of media or any type of representation that can be associated with a display board (or work board).

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed is:

1. In a fixed floor space work environment adapted to support a group of workers sharing information contained on a plurality of display panels the improvement comprising: the plurality of display panels being cantilevered from and mounted for pivotal and translating movement along at least one rail between a first territorial arrangement and at least one second territorial arrangement, the first territorial arrangement providing substantially all available floor space in a single work area for use by a plurality of workers, and the second territorial arrangement configured to divide the floor space into a plurality of separate work areas spatially defined at least in part by the display panels for use by a single worker.

2. The work environment of claim 1 wherein the at least one rail is mounted on a mounting structure.

3. The work environment of claim 2 wherein the at least one rail is permanently mounted on the mounting structure.

4. The work environment of claim 2 wherein the mounting structure is a partial height wall.

5. The work environment of claim 1 further comprising a docking area for at least a portion of the plurality of display panels.

6. The work environment of claim 5 wherein the docking area is an article of furniture.

7. The work environment of claim 5 wherein the docking area is a storage unit.

8. The work environment of claim 5 wherein the docking area is a panel wrap.

9. The work environment of claim 2 wherein the first territorial arrangement provides a first contextual appearance and the second territorial arrangement provides a second contextual appearance.

10. The work environment of claim 2 wherein the second territorial arrangement is configured to at least partially surround a worker.

11. The work environment of claim 1 further comprising a retractable partition adapted to provide a division of the floor space.

12. The work environment of claim 1 further comprising a utility threshold to provide utilities for use by at least a portion of the workers.

13. The work environment of claim 12 wherein the at least one rail comprises a first rail and a second rail and the utility threshold is mounted on the second rail.

14. The work environment of claim 4 further comprising at least one container having at least one display panel.

15. The work environment of claim 14 wherein the container includes at least one display panel including at least one display board.

16. The work environment of claim 4 wherein the plurality of display panels are adapted for pivotal movement with respect to the at least one rail.

17. The work environment of claim 14 wherein at least one display panel includes at least one display board.

18. The work environment of claim 14 wherein at least two display panels are configured to provide a fully open display condition.

19. The work environment of claim 14 wherein at least one work area presents an appearance at least partially defined by the arrangement of at least one display panel.

20. The work environment of claim 14 wherein the appearance of at least one work area is aesthetically defined by the information presented by at least one display panel.

21. The work environment of claim 14 wherein the appearance of at least one work area is physically defined by at least one display panel.

22. The work environment of claim 14 wherein the plurality of separate work areas includes a first work area physically separated from a second work area by a container.

23. The work environment of claim 14 wherein the display panels are associated with an information containing structure and at least one work area presents an appearance at least partially defined by the arrangement of at least one display panel and by information revealed on at least one display panel.

24. A work space allowing the formation of a plurality of work areas to support a plurality of workers therein comprising:

a plurality of substantially fixed mounting structures;

a plurality of articles of furniture, at least one of the articles of furniture being mobile with respect to the substantially fixed mounting structures;

an information display system including a plurality of display panels mounted on a track system for both pivotal movement with respect to at least one of the plurality of mounting structures and for translating movement along the track system;

wherein work areas including a first work area having a different floor space area than a second work area can selectively be formed within the work space by movement of the display panels and of the articles of furniture with respect to the fixed mounting structures, the display panels have a size and proportion sufficient to at least partially spatially define a portion of the first work area and the second work area.

25. The work space of claim 24 wherein the first work area is defined both by an arrangement of the plurality of display panels and by the information presented by at least a portion of the plurality of display panels.

26. The work space of claim 24 wherein a work area to support a team is formed.

27. The work space of claim 24 wherein a plurality of work areas each configured to support a plurality of individual workers is formed.

28. The work space of claim 24 wherein a plurality of team work areas and a plurality of individual work areas are formed.

29. The work space of claim 24 wherein at least one of the plurality of mounting structures includes a panel wall.

30. The work space of claim 24 wherein at least one of the plurality or mounting structures is an architectural wall.

31. The work space of claim 24 wherein at least one of the plurality of mounting structures is an article of furniture.

32. The work space of claim 24 wherein each of the plurality of display panels is associated with an information containing structure and at least one work area presents an appearance at least partially defined by the arrangement of at least one display panel and by information revealed on at least one display panel.

33. The work space of claim 32 wherein the information containing structure comprises at least one of a plurality of containers.

34. The work space of claim 33 wherein the appearance of at least one work area is aesthetically defined by the information presented by the container.

35. The work space of claim 33 wherein the appearance of at least one work area is physically defined by the container.

36. The work space of claim 24 wherein at least one of the mounting structures is a panel wall and at least one of the mounting structures is an architectural wall.

37. The work space of claim 24 wherein the track system includes at least one substantially linear rail.

38. The work space of claim 24 wherein at least one article of furniture includes a shelving unit providing a docking area having a space for stowing at least one container.

39. The work space of claim 33 wherein at least one article of furniture includes an article of furniture providing a docking area having a space for stowing at least one container.

40. The work space of claim 31 wherein the article of furniture is a panel wall.

41. The work space of claim 24 wherein at least a portion of the display panels cooperate to provide a fully open condition.

42. The work space of claim 24 wherein at least one article of furniture includes a utility threshold.

43. The work space of claim 24 wherein at least one display panel includes a plurality of display boards.

44. The work space of claim 43 wherein at least one display panel includes a first display panel and a second display panel and wherein the first display panel and the second display panel are coupled for independent pivotal movement with respect to the mounting structure.

45. The work space of claim 44 wherein at least one work area presents an appearance at least partially defined by the arrangement of at least one display panel.

46. The work space of claim 45 wherein the appearance of at least one work area is aesthetically defined by the information presented by at least one display panel.

47. The work space of claim 46 wherein the appearance of at least one work area is physically defined by at least one display panel.

48. The work space of claim 24 wherein at least one article of furniture includes a retractable screen adapted to provide at least partial concealment.

49. The work space of claim 33 wherein the container includes at least one display panel including at least one display board.

50. The work space of claim 24 wherein the first work area and the second work area are physically separated by a container.

51. The work space of claim 33 wherein a team work area is defined within which information may be selectively revealed to team members by arrangement of the containers.

52. The work space of claim 33 wherein information may selectively be concealed from team members by arrangement of the containers and by association of the containers with articles of furniture.

53. The work space of claim 24 wherein the track system is substantially permanently attached to the mounting structure.

54. A work space for providing at least one work area comprising:

a track system;

an information display system including a plurality of display panels adapted to present information attached to the track system for both pivotal and translating movement with respect to the track system between a first arrangement and at least one second arrangement, the display panels having a size sufficient to at least partially spatially envelop an individual worker when positioned in the first arrangement;

wherein the first arrangement of panels is configured to display information on the panels to the individual worker in the work area and the second arrangement of panels is configured to share information on the panels with a group of workers in the work area.

55. The work space of claim 54 wherein the at least one work area presents an appearance at least partially defined by the arrangement of at least one display panel.

56. The work space of claim 55 wherein the appearance of the at least one work area is aesthetically defined by the information presented by at least one display panel.

57. The work space of claim 55 wherein the appearance of the at least one work area is physically defined by at least one display panel.

58. The work space of claim 54 further comprising a mounting structure comprising a panel wall.

59. The work space of claim 54 wherein the track system includes at least one substantially linear rail.

60. The work space of claim 54 further comprising at least one article of furniture providing a docking area having a space for stowing at least one container.

61. The work space of claim 54 further comprising a shelving unit providing a docking area having a space for stowing at least one container.

62. The work space of claim 60 wherein the article of furniture is a panel wall.

63. The work space of claim 54 further comprising a utility threshold movably attached to the track system.

64. The work space of claim 54 wherein the track system is coupled to a mounting structure.

65. The work space of claim 64 wherein the mounting structure is a partial height panel wall.

66. The work space of claim 54 wherein at least one display panel includes at least one display board.

67. The work space of claim 54 wherein at least one display panel includes a plurality of display boards.

68. The work space of claim 54 wherein each of the plurality of display panels are configured to provide a fully open display condition.

69. The work space of claim 68 wherein at least one display panel includes a first display panel and a second display panel and wherein the first display panel and the second display panel are coupled for independent pivotal movement with respect to a mounting structure.

70. The work space of claim 69 wherein at least a portion of the display panels cooperate to provide a fully open condition.

71. The work space of claim 63 wherein the first arrangement provides a first contextual appearance and the second arrangement provides a second contextual appearance.

72. The work space of claim 60 wherein at least one article of furniture includes a retractable screen adapted to provide at least partial concealment of at least one display panel.

73. The work space of claim 60 wherein the docking area includes a space for stowing a mobile article of furniture.

74. The work space of claim 73 wherein the docking area includes a space for stowing a utility threshold.

75. The work space of claim 54 further comprising at least one container having at least one display panel.

76. The work space of claim 74 wherein the utility threshold is mounted to the track system.

77. The work space of claim 74 wherein the utility threshold is configured to deliver a utility comprising power, lighting, voice and combinations thereof.

78. The work space of claim 60 wherein the at least one article of furniture includes an article of furniture providing a worksurface and the plurality of display panels are at a vertical height to provide for clearance above the worksurface.

79. The work space of claim 64 wherein at least one display panel includes a first display panel having a first surface treatment and a second display panel having a second surface treatment.

80. The work space of claim 54 wherein at least one work area includes a first work area and a second work area physically separated by at least one display panel.

81. The work space of claim 54 wherein the at least one work area comprises one work area configured to occupy the work space.

82. The work space of claim 54 wherein the at least one work area comprises three work areas.

83. The work space of claim 54 wherein the at least one work area includes a first work area including at least one container and a second work area including at least one container.

* * * * *